US012446624B2

(12) United States Patent
Singleton et al.

(10) Patent No.: US 12,446,624 B2
(45) Date of Patent: Oct. 21, 2025

(54) HEATING DEVICE FOR GENERATING CONSUMABLE AEROSOL

(71) Applicant: THOUGHT LEADERS, INC., Alexandria, VA (US)

(72) Inventors: Mark Singleton, Alexandria, VA (US); Veronica Spencer, Alexandria, VA (US); Leigh Ann Blevins Joyce, Alexandria, VA (US); Skeet M. Singleton, Alexandria, VA (US)

(73) Assignee: THOUGHT LEADERS, INC., Alexandria, VA (US)

( * ) Notice: Subject to any disclaimer, the term of this patent is extended or adjusted under 35 U.S.C. 154(b) by 410 days.

(21) Appl. No.: 17/969,305

(22) Filed: Oct. 19, 2022

(65) Prior Publication Data

US 2023/0117750 A1 Apr. 20, 2023

Related U.S. Application Data

(60) Provisional application No. 63/301,383, filed on Jan. 20, 2022, provisional application No. 63/290,734, filed on Dec. 17, 2021, provisional application No. 63/290,736, filed on Dec. 17, 2021, provisional application No. 63/257,847, filed on Oct. 20, 2021.

(51) Int. Cl.

| | |
|---|---|
| ***A24F 40/46*** | (2020.01) |
| ***A24F 40/51*** | (2020.01) |
| ***A24F 40/57*** | (2020.01) |

(52) U.S. Cl.

CPC ..... *A24F 40/46* (2020.01); *A24F 40/51* (2020.01); *A24F 40/57* (2020.01)

(58) Field of Classification Search

None

See application file for complete search history.

(56) References Cited

U.S. PATENT DOCUMENTS

| | | | |
|---|---|---|---|
| 4,513,756 | A | 4/1985 | Pittman et al. |
| 5,060,671 | A | 10/1991 | Counts et al. |
| 5,095,921 | A | 3/1992 | Losee et al. |
| 5,179,966 | A | 1/1993 | Losee et al. |

(Continued)

FOREIGN PATENT DOCUMENTS

| | | | |
|---|---|---|---|
| CN | 203435678 | U | 2/2014 |
| EP | 2782463 | B1 | 6/2016 |

(Continued)

OTHER PUBLICATIONS

Samsung (30" Smart Electric Wall Oven with Microwave Combination in Stainless Steel; Manufactured Date: 2018). Accessed via: https://www.samsung.com/us/home-appliances/wall-ovens/microwave-combination-oven/30-microwave-combination-wall-oven-in-stainless-steel-nq70t5511ds-aa/ (Year: 2018).*

(Continued)

*Primary Examiner* — Parviz Hassanzadeh

(74) *Attorney, Agent, or Firm* — Ruggiero McAllister & McMahon LLC

(57) ABSTRACT

A heating device is provided that creates inhalable aerosol that includes one or more heating elements and a temporary or permanently established cavity formed by a barrier between the heating elements and the external environment that envelops the heating elements to allow the insertion and removal of consumables from the cavity and allows for the replacement of the heating elements in the device.

27 Claims, 44 Drawing Sheets

(56) References Cited

U.S. PATENT DOCUMENTS

| | | | |
|---|---|---|---|
| 5,183,062 | A | 2/1993 | Clearman et al. |
| 5,240,012 | A | 8/1993 | Ehrman et al. |
| 5,269,327 | A | 12/1993 | Counts et al. |
| 5,322,075 | A | 6/1994 | Deevi et al. |
| 5,388,594 | A | 2/1995 | Counts et al. |
| 5,666,978 | A | 9/1997 | Counts et al. |
| 7,088,914 | B2 | 8/2006 | Whittle et al. |
| 8,689,804 | B2 | 4/2014 | Fernando |
| 8,881,737 | B2 | 11/2014 | Collett et al. |
| 8,915,254 | B2 | 12/2014 | Monsees et al. |
| 9,439,453 | B2 | 9/2016 | Conner et al. |
| 9,459,021 | B2 | 10/2016 | Greim et al. |
| 9,516,899 | B2 | 12/2016 | Plojoux et al. |
| 9,668,521 | B2 | 6/2017 | Kuczaj |
| 9,687,029 | B2 | 6/2017 | Liu |
| 9,693,587 | B2 | 7/2017 | Plojoux et al. |
| 9,795,168 | B2 | 10/2017 | Zhu |
| 9,833,021 | B2 | 12/2017 | Perez et al. |
| 9,839,238 | B2 | 12/2017 | Worm et al. |
| 9,901,123 | B2 | 2/2018 | Robinson et al. |
| 9,930,915 | B2 | 4/2018 | Worm et al. |
| 9,943,114 | B2 | 4/2018 | Batista |
| 9,999,250 | B2 | 6/2018 | Minskoff et al. |
| 10,004,259 | B2 | 6/2018 | Sebastian et al. |
| 10,015,986 | B2 | 7/2018 | Cadieux et al. |
| 10,080,851 | B2 | 9/2018 | Davidson et al. |
| 10,099,020 | B2 | 10/2018 | Davidson et al. |
| 10,159,283 | B2 | 12/2018 | Mironov |
| 10,219,543 | B2 | 3/2019 | Gill et al. |
| 10,219,548 | B2 | 3/2019 | Robinson et al. |
| 10,251,423 | B2 | 4/2019 | Mamoun et al. |
| 10,278,428 | B2 | 5/2019 | Perez et al. |
| 10,299,513 | B2 | 5/2019 | Perez et al. |
| 10,334,877 | B2 | 7/2019 | Qiu |
| 10,369,304 | B2 | 8/2019 | Davidson et al. |
| 10,448,673 | B2 | 10/2019 | Gill et al. |
| 10,575,557 | B2 | 3/2020 | Consolante |
| 10,595,558 | B2 | 3/2020 | Malgat et al. |
| 10,624,386 | B2 | 4/2020 | White |
| 10,624,393 | B2 | 4/2020 | Kuczaj |
| 10,653,180 | B2 | 5/2020 | Monsees et al. |
| 10,660,363 | B2 | 5/2020 | Cadieux et al. |
| 10,721,967 | B2 | 7/2020 | Raichman |
| 10,750,782 | B2 | 8/2020 | Batista |
| 10,750,787 | B2 | 8/2020 | Chong et al. |
| 10,757,975 | B2 | 9/2020 | Batista et al. |
| 10,786,005 | B2 | 9/2020 | Gavrielov et al. |
| 10,856,575 | B2 | 12/2020 | Gill et al. |
| 10,869,499 | B2 | 12/2020 | Fernando et al. |
| 10,918,127 | B2 | 2/2021 | Fuisz et al. |
| 10,925,321 | B2 | 2/2021 | Ouyang |
| 11,026,449 | B2 | 6/2021 | Mironov |
| 2006/0070633 | A1 | 4/2006 | Rostami et al. |
| 2011/0005535 | A1 | 1/2011 | Xiu |
| 2014/0202476 | A1 | 7/2014 | Egoyants et al. |
| 2015/0122252 | A1 | 5/2015 | Frija |
| 2016/0015082 | A1 | 1/2016 | Liu |
| 2016/0219937 | A1 | 8/2016 | Rado |
| 2016/0309782 | A1 | 10/2016 | Malgat et al. |
| 2016/0309786 | A1 | 10/2016 | Holtz et al. |
| 2017/0055574 | A1 | 3/2017 | Kaufman et al. |
| 2017/0119050 | A1 | 5/2017 | Blandino et al. |
| 2017/0143041 | A1 | 5/2017 | Batista et al. |
| 2018/0093054 | A1 | 4/2018 | Bowen et al. |
| 2018/0263290 | A1* | 9/2018 | Collett ..... A24F 40/51 |
| 2018/0295885 | A1 | 10/2018 | Rojo-Calderon et al. |
| 2018/0325173 | A1 | 11/2018 | Blandino et al. |
| 2018/0344954 | A1* | 12/2018 | Davidson ..... A61M 15/0045 |
| 2018/0360113 | A1 | 12/2018 | Reinitz et al. |
| 2019/0158938 | A1* | 5/2019 | Bowen ..... A24F 40/65 |
| 2019/0174828 | A1 | 6/2019 | Holtz et al. |
| 2019/0208823 | A1 | 7/2019 | Raichman |
| 2019/0274358 | A1 | 9/2019 | Reevell |
| 2020/0060340 | A1* | 2/2020 | Hejazi ..... A61M 15/06 |
| 2020/0120981 | A1 | 4/2020 | Yamada |
| 2020/0221767 | A1 | 7/2020 | Emmett et al. |
| 2020/0383377 | A1 | 12/2020 | Chong et al. |
| 2021/0068469 | A1 | 3/2021 | Ademe |
| 2021/0244092 | A1 | 8/2021 | Weigensberg et al. |
| 2022/0015429 | A1 | 1/2022 | Brown et al. |
| 2022/0095684 | A1 | 3/2022 | Ferrie et al. |

FOREIGN PATENT DOCUMENTS

| | | | |
|---|---|---|---|
| EP | 3281535 | A1 | 2/2018 |
| EP | 3463532 | B1 | 4/2020 |
| EP | 3307101 | B1 | 7/2020 |
| EP | 3490393 | B1 | 9/2020 |
| EP | 3280280 | B1 | 11/2020 |
| ES | 2417181 | T3 | 8/2013 |
| RU | 2 705 799 | C2 | 3/2019 |
| RU | 2 715 782 | C1 | 8/2020 |
| RU | 2 731 029 | C1 | 8/2020 |
| RU | 2 732 766 | C2 | 9/2020 |
| RU | 2 750 981 | C2 | 7/2021 |
| RU | 2 753 921 | C1 | 8/2021 |
| WO | 2020/083852 | A1 | 4/2020 |
| WO | 2020/089071 | A1 | 5/2020 |
| WO | 2020/119011 | A1 | 6/2020 |
| WO | 2020/148335 | A1 | 7/2020 |
| WO | 2020/239599 | A1 | 12/2020 |
| WO | 2020/248528 | A1 | 12/2020 |

OTHER PUBLICATIONS

International Search Report dated Feb. 7, 2023 from corresponding International Patent Application PCT/US2022/047135, 4 pages.

Written Opinion dated Feb. 7, 2023 from corresponding International Patent Application PCT/US2022/047135, 5 pages.

International Preliminary Report on Patentability dated Jun. 12, 2024 from corresponding International Patent Application PCT/US2022/047135, 5 pages.

* cited by examiner

1 Introduction

Definition: $A \subset R^3$ is convex if and only if $\forall\ \vec{a}, \vec{b} \in A,\quad \forall \lambda \in [0,1] : (\lambda \cdot \vec{a} + (1-\lambda) \cdot \vec{b}) \in A$.

Example: All Archimedean polyhedra are convex.

Example: The closed ball $\overline{B_r(a)} = \left\{ \vec{x}, \vec{a} \in R^3, r \in R^+ : \left\| \vec{x} - \vec{a} \right\| \leq r \right\} \subset R^3$ is convex.

Recall that there exists a homomorphism from the ellipsoidal coordinates (for elliptic radii $a, b, c \in R^+$) to the Cartesian coordinates ($(x, y, z) \in R^3$):

$$\theta \in \left[-\frac{\pi}{2}, \frac{\pi}{2}\right], \text{geocentric latitude,}$$

$$\Phi \in \left[0, 2\pi\right], \text{ geocentric longitude,}$$

$$R = \frac{a\,b\,c}{\sqrt{c^2 (b^2 \cos^2(\Phi) + a^2 \sin^2(\Phi)) \cos^2(\theta) + a^2 b^2 \sin^2(\theta)}},$$

$$x = R \sin(\theta) \cos(\Phi),$$

$$y = R \sin(\theta) \cos(\Phi),$$

$$z = R \cos(\theta).$$

Definitions: Height, width, and length are linear measures, each in a dimension perpendicular to the other two.

The SI unit for linear measurement is meters (m).

Example: The thickness to width ratio equals the height divided by whichever is greater, width or length.

Definition: Mass is a measure of how much matter is contained in an object. The SI unit of mass is the kilogram (kg).

Definition: Density is mass per unit volume, $p = \frac{m}{V}$, where m is mass and V is volume. Note that density is inversely proportional to its volume.

FIG. 39A

2 Ellipse and Ellipsoid

Let $h, w, l \in R^+$ represent the height, width and length (respectively) of the consumable. Also, let $l \leq 2h$ and let $w \leq 2h$, such that the thickness to width ratio is no greater than 1:2.

Let $a, b, c, d \in [0,l]$, where $a \leq b \leq c \leq d$, represent ordered segments of the length of the consumable.

[36.1, 36.3] For all $y \in [a,b] \cup [c,d]$, the ellipsoid is the convex function $f : R^3 \rightarrow R^3$ given by $f \equiv$ $\{ (x, y, z) \in R^3 : \frac{x^2+y^2}{(1/2\, w)^2} + \frac{z^2}{(1/2\, h)^2} \leq 1 \}$. The volume enclosed by $f$ is approximately $V = 1/3\pi hw\,(d-c)$, assuming $b - a = d - c$.

[002] For all $y \in [b,c]$, the ellipse is the convex function $g : R^2 \rightarrow R^2$ given by $g \equiv \{ (x,z) \in R^2 : \frac{x^2}{(1/2\, w)^2} + \frac{z^2}{(1/2\, h)^2} \leq 1 \}$. The area of the ellipse is given by $A(w, h) = 4\pi wh$. The volume is given by $V = \int_b^c dy\, A(w,h)$.

Definition: The ellipticity is given by $e \equiv \sqrt{1-h^2/w^2}$, where $w > h$.

FIG. 39B

3 Convex Consumable

Let *C* be the collection containing all convex sets whose thickness to width ratio is no greater than 1:2. Then volumes generated by *f* and *g* above are an element of *C*.

Let *S* be the set of all Archimedean polyhedra whose thickness to width ratio is no greater than 1:2. Then *S* is also an element of *C*.

As used herein, the term "convex consumable" refers to any of the elements in the collection *C*.

In addition to being convex, the elements in *C* can be continuously differentiable with a derivative of zero at the center. Other elements in *C* are convex with a thickness to width ratio no greater than 1:2, many of which attain a maxima or minima near the center.

4 Compressible Design Philosophy

Definition: Malleability is a material's or object's ability to deform elastically without failure under compressive stress. For example, non-destructive displacement, $\Delta_X = x_f - x_i$, the difference between the final position and the initial position could be a linear measure of malleability.

According to Maxwell's fourth relation for entropy *S* and temperature *T*, we have:

$$\left(\frac{\partial S}{\partial p}\right)_T = -\left(\frac{\partial V}{\partial T}\right)_p$$

The volume coefficient of expansion $\alpha_V \equiv \frac{1}{V}\left(\frac{\partial V}{\partial T}\right)_p$ can be measured from experiments. Hence, the following substitution:

$$\left(\frac{\partial S}{\partial p}\right)_T = -\frac{1}{\rho}\left(\frac{\partial \rho}{\partial T}\right)_p \alpha_V$$

FIG. 39C

Now consider $(\partial p)/(\partial T)_V$, where volume $V = V(T, p)$ is a function of temperature $T$ and pressure $p$:

$$dV = \left(\frac{\partial V}{\partial T}\right)_p dT + \left(\frac{\partial V}{\partial p}\right)_T dp$$

From which the isothermal compressibility $\beta$ can be derived:

$$\beta \equiv -\frac{1}{V}\left(\frac{\partial V}{\partial p}\right)_T \approx \frac{1}{\rho}\left(\frac{\partial \rho}{\partial p}\right)$$

Because some of the convex consumables may be irregularly shaped as well as contain heterogeneous, potentially-irregularly shaped objects with anisotropic characteristics — this is self-evident — equations to describe their precise nature (e.g. exact volume) will not always be readily available. Therefore, various simulation methods, relying on detailed geometric models of the consumable, are necessary to understand its properties, such as estimate upper and lower bounds for its internal contents.

For example, with respect to non-destructive displacement, the distribution of mass of various inputs and the resulting manufactured output can be used to estimate the density and, combined with the simulation methods mentioned above, estimate the radial distribution of particles $g(r)$.

2

---

These simulations, distributions and estimates can be used as inputs to the following equation, which relates the isothermal compressibility β to the convex consumables' internal structure $g(r)$, where $kT$ is thermal energy and the partial derivative of density ρ is taken with respect to pressure $p$:

FIG. 39D $$\beta = kT\left(\frac{\partial \rho}{\partial p}\right) = 1 + \rho\int_V dr\,[g(r) - 1]$$

To explain why this is necessary, the anisotropic material in the consumable allows it, as a whole, to assume different mechanical properties, similar to a spring. A naive estimation method might rely on Hooke's Law and linear regression. But such methods do not yield accurate results in practice because the cross-sectional area of a malleable object changes as some nonlinear function of the load $A_0 = \Phi(F_a)$.

To address this issue, we have made several improvements. First, we optimize the ellipticity or eccentricity ($e$) of the consumable to achieve uniform contact with the heater, and therefore uniform pressure and uniform thermal energy, within some accepted tolerance. Second, we regularize the problem so that it's well posed using experimental values of the strain $\varepsilon$ of the consumable, which is related to deformation in terms of relative displacement. Third, we optimize the design of the heater along multiple dimensions, including its surface area $A$, ellipticity or eccentricity, and heat $Q$. All of the previous considerations are made in conjunction with the following system of equations that describe a thermodynamic equilibrium, allowing for constant motion in the vector $\vec{\mu}$ of the chemical potentials of all components.

Macroscopic work $W$ relates to change in volume $V$ and mean pressure $\bar{p}$:

$$\int_{V_i}^{V_f} \partial W = \int_{V_i}^{V_f} \bar{p}(V)\, dV$$

Entropy $S$ is related to heat $Q$ and temperature $T$:

$$dS = S(E + \partial Q, V, \vec{N}) - S(E, V, \vec{N}) = \left(\frac{\partial S}{\partial E}\right)_{V,N} \partial Q = \frac{\partial Q}{T}$$

Vaporization in the device is governed by the first law of thermodynamics in the general case where the particles of the system are of different types, reactions may occur, and their respective numbers may not be constant:

$$dU = T\,dS - P\,dV + \vec{\mu}\,d\vec{N}$$

FIG. 39E

5 Additional Reduced Risk Mechanisms

Definition: Baffles are a system of heat transfer to remove heat from the viscous liquid once it has vaporized. This system reduces risk for the end user because it reduces the thermal energy transmitted into the lungs.

FIG. 39F

HEATING DEVICE FOR GENERATING CONSUMABLE AEROSOL

CROSS REFERENCE TO RELATED APPLICATIONS

This application claims the benefit of U.S. Provisional Application 63/257,847 filed Oct. 20, 2021, U.S. Provisional Application 63/290,734 filed Dec. 17, 2021, U.S. Provisional Application 63/290,736 filed Dec. 17, 2021, and U.S. Provisional Application 63/301,383 filed Jan. 20, 2022. The contents of U.S. Provisional Application 63/257,847 filed Oct. 20, 2021, U.S. Provisional Application 63/290,734 filed Dec. 17, 2021, U.S. Provisional Application 63/290,736 filed Dec. 17, 2021, and U.S. Provisional Application 63/301,383 filed Jan. 20, 2022, are incorporated by reference in their entirety herein.

BACKGROUND OF THE DISCLOSURE

1. Field of the Disclosure

The present disclosure is directed to a heating device for generating inhalable or consumable aerosol by application of heat to an aerosol generating formulation such that selected chemical compounds are efficiently extracted and transferred directly to the user. More particularly, the present disclosure relates to generating aerosol in a heating device without the need for a separate cartridge, connectable to the heating device, as a location for generating the aerosol.

2. Description of the Related Art

Conventional devices that generate aerosols to be inhaled by users generally utilize either a consumable shaped similar to a cigarette or a separate cartridge that includes a consumable containing an aerosol generating formulation. When there is a separate cartridge, the consumable may contain a built-in heater and/or polymer inclusions. Accordingly, heaters in these conventional devices are undesirably concealed in or attached to the consumable and are intended to be thrown away as part of each use leading to waste and litter.

Other conventional devices that generate aerosols to be inhaled by users generally have heaters that are permanently affixed to the device. Thus, these permanently affixed heaters must undesirably be cleaned to optimally generate consumable aerosol from the device. If the cleaning process is too difficult, the entire device may be discarded prematurely before the expiration of its potential useful life leading to excessive environmental waste and consumer cost to replace the item.

Accordingly, it has been determined by the present disclosure that there is a continuing need for a device that overcomes, alleviates, and/or mitigates one or more of the aforementioned and other deleterious effects of prior devices.

SUMMARY

The present disclosure provides a heating device, such as an inhaler device, that uses a proprietary aerosol-generating consumable that is more environmentally sensitive, as well as economical, for the consumer.

The present disclosure also provides such a heating device with heating elements arranged specifically with the intent to consistently and uniformly conduct, convect, and radiate heat across the surface area of the consumable.

The consumable for placement in the heating device can be, for example, a pellet, capsule, pillow, tablet, pouch, wafer, powder, granule, shred, spaghetti, strips or sheet. The consumable can be perforated or not perforated. The consumable can be wrapped or unwrapped. The wrapper can be porous or non-porous. Wrapper porosity can range from 24 to 30,000 CORESTA units.

The present disclosure further provides such a heating device in which the consumable is partially or completely surrounded by the heating elements, which maximizes product yield and the resultant aerosol through minimal energy expenditure.

The present disclosure provides such a heating device that creates inhalable aerosol and that can operate with one or more heating elements, and a temporary or permanently established cavity formed by a barrier between the heating elements and the external environment that envelops the heating elements and allows for the insertion and removal of consumables from the cavity, and allows for the replacement manually, mechanically, and/or electrically of the device's heating element(s).

The present disclosure further provides such a heating device that safeguards the user from burns or electric shock throughout operation and maintenance of the heating device by control mechanisms that prevent the consumer from opening the device while the heater is hot. The device can also have control mechanisms that prevent the heaters from turning on while the device is open. The device can also have a mechanism for authenticating the user and/or verifying the user's age.

The present disclosure also provides that the consumables could be made from tobacco, other botanicals, herbs, or plants, and/or synthetic (e.g., pharmaceutical) products. The consumable can also contain aerosol forming ingredients such as, but not limited to, glycerin, propylene glycol, and the like.

The present disclosure provides a heating device that creates inhalable aerosol and that can operate with: (1) one or more heating elements; (2) a temporary or permanently established cavity delineating the heating elements, circulated air filling the cavity, and the active consumable from both the device exterior and the non-heating portion of the device; (3) any method or mechanism that allows for the insertion and removal of consumables from the cavity; and (4) any method or mechanism that allows for the replacement manually, mechanically, and/or electrically of the device's heating element(s). Additionally, the heating device has control mechanisms that enable safe and lawful use of the heating device through a number of means, including but not limited to: (i) prevention of the consumer from opening the heating device while the heater remains hot enough to risk harm from burning; (ii) prevention of the heaters from turning on while the heating device is open; and/or (iii) prevention of unauthorized use of the heating device by an underage or otherwise ineligible user. For purposes of consumer product safety, the heaters should cool down to a temperature range from about 65° C., 55° C., 50° C., 45° C., 40° C. or lower, e.g., in an illustrative example, 45° C. or lower. The product may or may not have a feature for puncturing the encasement around the consumable should there be one.

The present disclosure additionally provides that such a heating device can indicate different statuses of the device with indicators that comprise, but are not limited to, lights, haptics, sounds, vibratory motor, buzzer, and any combination thereof that utilize different combinations of or changes in intensities or patterns that communicate to the user vital information about the device such as, but not limited to, device temperature, battery level, device cleanliness, and such advisory indications.

The above and other objects, features, and advantages of the present disclosure will be apparent and understood by those skilled in the art from the following detailed description, drawings, and accompanying claims. As shown throughout the drawings, like reference numerals designate like or corresponding parts.

BRIEF DESCRIPTION OF THE DRAWINGS

FIGS. 39*a*-39*f* are calculations for the consumable.

DETAILED DESCRIPTION OF THE DISCLOSURE

Figure 2:
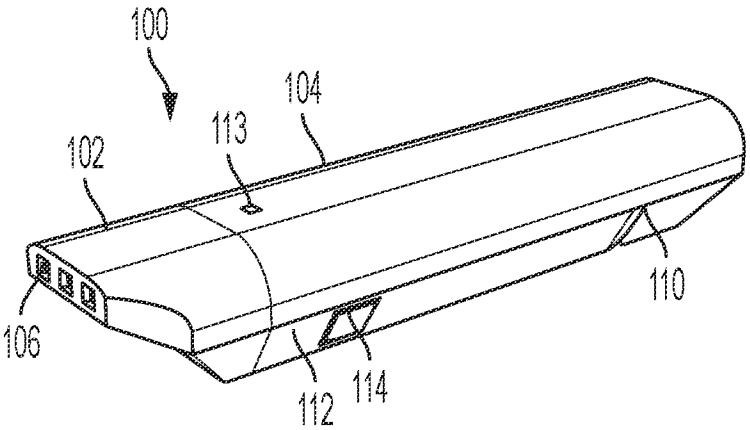
FIG. 2 is a top, perspective side view of the inhaler device of FIG. 1 in the closed position.

The present disclosure provides a heating device ("device") that creates inhalable aerosol and that can operate with: (1) one or more heating elements; (2) a temporary or permanently established cavity delineating the heating elements, circulated air, and the active consumable from both the device exterior and the non-heating portion of the device; (3) any method or mechanism that allows for the insertion and removal of consumables from the cavity; and (4) any method or mechanism that allows for the replacement, manually, mechanically and/or electrically, of the heating elements in the device.

Additionally, the device can have control mechanisms that prevent the consumer from opening the device while the heater remains hot enough to risk harm from burning. For purposes of consumer product safety, the heaters should cool down to a temperature range from about 65° C. or lower, preferably 60° C., 55° C., 50° C., 45° C., 40° C. or lower, e.g., in an illustrative example, 45° C. or lower. The device can also have control mechanisms that prevent the heaters from turning on while the device is open. The device can also have controls for authenticating and/or authorizing the user, and/or verifying the user's age. In one or more embodiments, the device can have one or more status indicators. These status indicators can comprise, but are not limited to, lights, haptics, sounds, vibratory motor, buzzer, and any combination thereof that utilize different combinations of, or changes in, intensities or patterns that communicate to the user vital information about the device such as, but not limited to, device temperature, battery level, device cleanliness, and such advisory indications. The device can also have a combination of physical and digital safeguard features, such as lock features to prevent the device from opening, or proximity authentication via peripheral established connections to authorized mobile phones.

The consumable, for example, consumable 132 discussed herein, for the heating device can be, for example, a pellet, capsule, pillow, tablet, pouch, wafer, powder, granule, shred, spaghetti, strip, or sheet. The consumable can be perforated or not perforated. The consumable can be wrapped or unwrapped. The wrapper may be porous or non-porous. Wrapper porosity can range from 24 to 30,000 CORESTA units Consumable 132 comprises a mixture of any proportion of any of the following components including, but not limited to, tobacco, hemp, other cellulosic materials, including but not limited to wood fibers or pulp, beet fibers, microcrystalline cellulose, botanical, solids, or semi-solids containing aerosolizing substances including, but not limited to, glycerin, propylene glycols, other glycols, or the like and any mixture thereof. The geometry of the consumable can be a convex or biconvex shape. As discussed herein convex can also mean biconvex. The consumable may or may not be able to be compressed during insertion into the device. The consumable can be one that when compressed maximizes the surface area of the consumable that will be heated relative to the cross-section or thickness of the consumable. This way a greater amount of the consumable will be in contact with the heater. The convex shape of the consumable can include, but is not limited to, rectangular, oval, circular, or elliptical. The convex shape is easier for the consumer to load into the heater cradle. Closing the heater consumable cradle can compress and better secure a convex consumable. The heaters that heat the consumable can include a convex portion. Convexity of the heater shape is important too. Such heater convexity shape could be defined as multiple bends instead of rounding, since rounded stainless has a tendency to revert back to its original shape from memory whereas bends do not. Moreover, rounding tools are more expensive and wear out more quickly than bending tools. Compressing the consumable can further break up static substrate crystals that can form and impede airflow. When compressed, the consumable can be heated more evenly, maximizing product yield, up to 100 percent, and maximizing the resultant aerosol with minimized energy. However, compressing the consumable immediately prior to use creates enough density to optimize deliverables, whereas compressing the density during the original manufacturing process may cause the consumable to become too dense for the air to flow through the consumable. Consumable density and good airflow strengthen flavor and taste, as well as aerosol constituent yield, and they in turn improve consumer sensory experience. The device can also have a structure for puncturing the encasement around the consumable should it be needed.

The device of the present disclosure is believed to create inhalable aerosol with minimal particle breakthrough, and preferably without particle breakthrough, so that no filter is needed. However, the device of the present disclosure can also be used with filters. In addition, the consumable can be wrapped or unwrapped. The wrapper can be porous or non-porous. Wrapper porosity can range from 24 to 30,000 CORESTA units. Porosity of the wrapper adds an additional protection by containing, screening or blocking particle breakthrough health risks.

Examples of the devices that include the features described above are set forth below as devices 100, 200, 300, 400, 500, and 600. However, the present disclosure is not limited to devices 100, 200, 300, 400, 500, and 600. Other devices including the features described above are also contemplated by the present disclosure. Further, devices 100, 200, 300, 400, 500, and 600 can each be modified to include any of the features of the other of devices 100, 200, 300, 400, 500, and 600.

Figure 1:
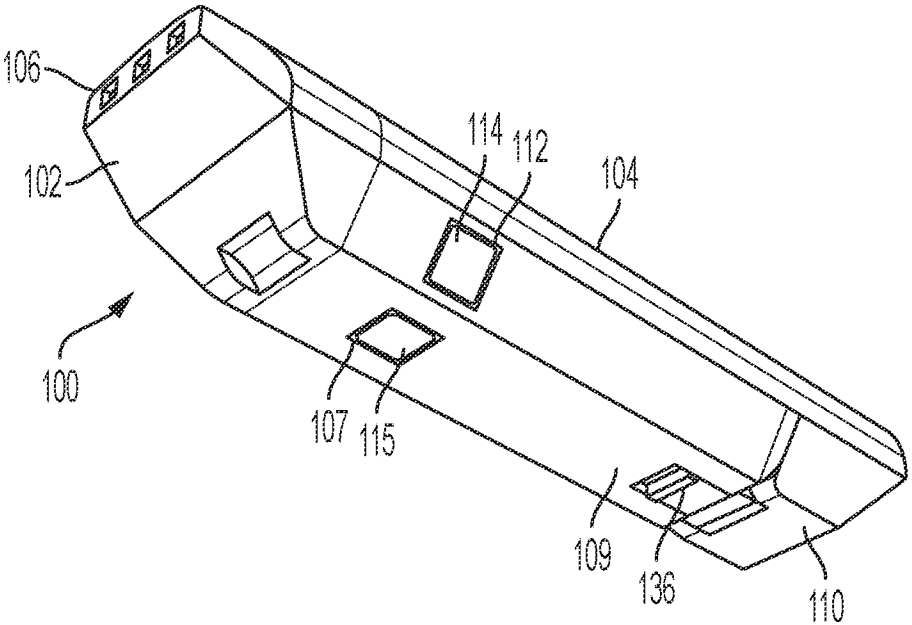
FIG. 1 is a front, bottom perspective view of a first embodiment of an inhaler device according to the present disclosure in a closed position.
Figure 4:
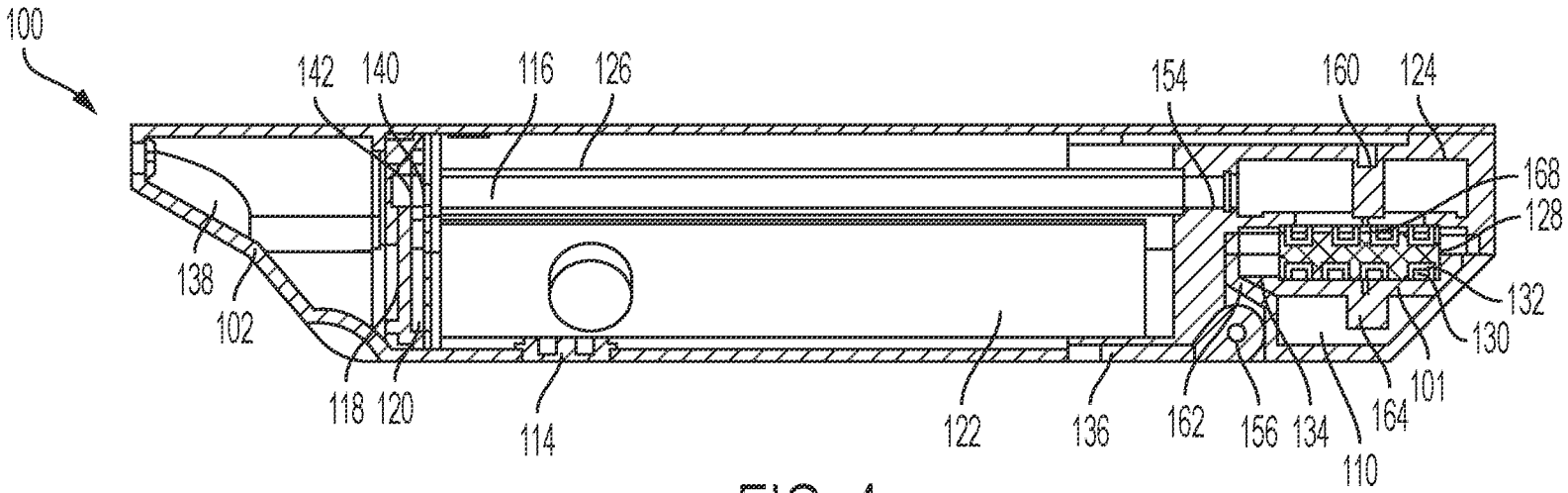
FIG. 4 is a side, cross-sectional view of the inhaler device of FIG. 1 in the closed position.

FIGS. 1 and 2 show a first embodiment of the plurality of heating devices of the present disclosure. As shown in these FIGS., the heating device is a heated inhaler or an inhaler device 100 ("device 100"). Device 100 heats a consumable, for example, consumable 132 that includes tobacco, to create inhalable aerosol. Advantageously, as directly compared to conventional devices that receive consumables with a built-in heater and/or plastics, device 100 is a more economically efficient and environmentally sensitive platform. Device 100 includes a self-contained cavity 101. Cavity 101 is an interior volume formed inside an upper portion 124 and a hinged lower portion 110 of device 100 when they are in a closed position as shown in FIG. 4. Upper portion 124 and hinged lower portion 110 form a barrier between the heating element, first heater 128 and second heater 130 (which are inside cavity 101), and the external environment. The external environment is outside of upper portion 124 and hinged lower portion 110 as shown in FIG. 4.

Device 100 has the heating elements, first heater 128 and second heater 130, specifically arranged with the intent to consistently and uniformly conduct and radiate heat across the surface area of the consumable. The surrounding of the consumable by the heating elements, first heater 128 and second heater 130, serves to help maximize product yield and the resultant aerosol, with minimal energy. In the current embodiments, the heating elements, first heater 128 and second heater 130, are resistive, but the arrangement of heaters can be applied to other heating technologies. Cavity 101 between upper portion 124 and hinged lower portion 110 as shown in FIG. 4 can repeatedly be disrupted, in other words opened, to receive consumables, then re-established, in other words closed, to process the consumables. Also, cavity 101 can be disrupted to allow for either manual, device assisted, or automatic ejection of the used consumable.

In some current products, the cavity and associated processing system is enclosed in a separate cartridge consumable, rather than the consumable being inserted into and heated by a portion of the device. In current products, the aerosol is generated in that separate cartridge and then transferred to the main body of the device. In contrast, the aerosol is generated by the heating elements placed at the end of device 100.

Additionally, device 100 provides safety measures throughout use including burn protection during operation, consumable replacement, and heater changing and/or cleaning. Device 100 also includes ways to make cleaning easier for the user of device 100, such as by ensuring user-friendly ways to remove and replace heaters that are worn out or dirty. This results in significantly lower consumable costs and reduced environmental impact. Such measures are unique to this device 100 as the heaters in some conventional devices are either undesirably concealed within or part of the consumable construction and intended to be thrown away at the end of each use, or they must be cleaned while in the device because they are permanently attached, which is not a desirable consumer maintenance requirement.

Referring to FIGS. 1 and 2, device 100 has a mouthpiece 102 and a housing 104. Mouthpiece 102 has one or more openings 106, preferably at least two or more. The user can inhale the aerosol generated in device 100 through openings 106. In this embodiment, housing 104 is connected to a hinged lower portion 110. Housing 104 has an opening 112 that receives a button cover 114 to initiate or deactivate heating and an opening 107 that receives a second button cover 115 to initiate unlocking and ejection. Housing 104 also has a cutout 109 for receipt of a cavity enforcing slide lock 136 ("slide lock").

Figure 3:
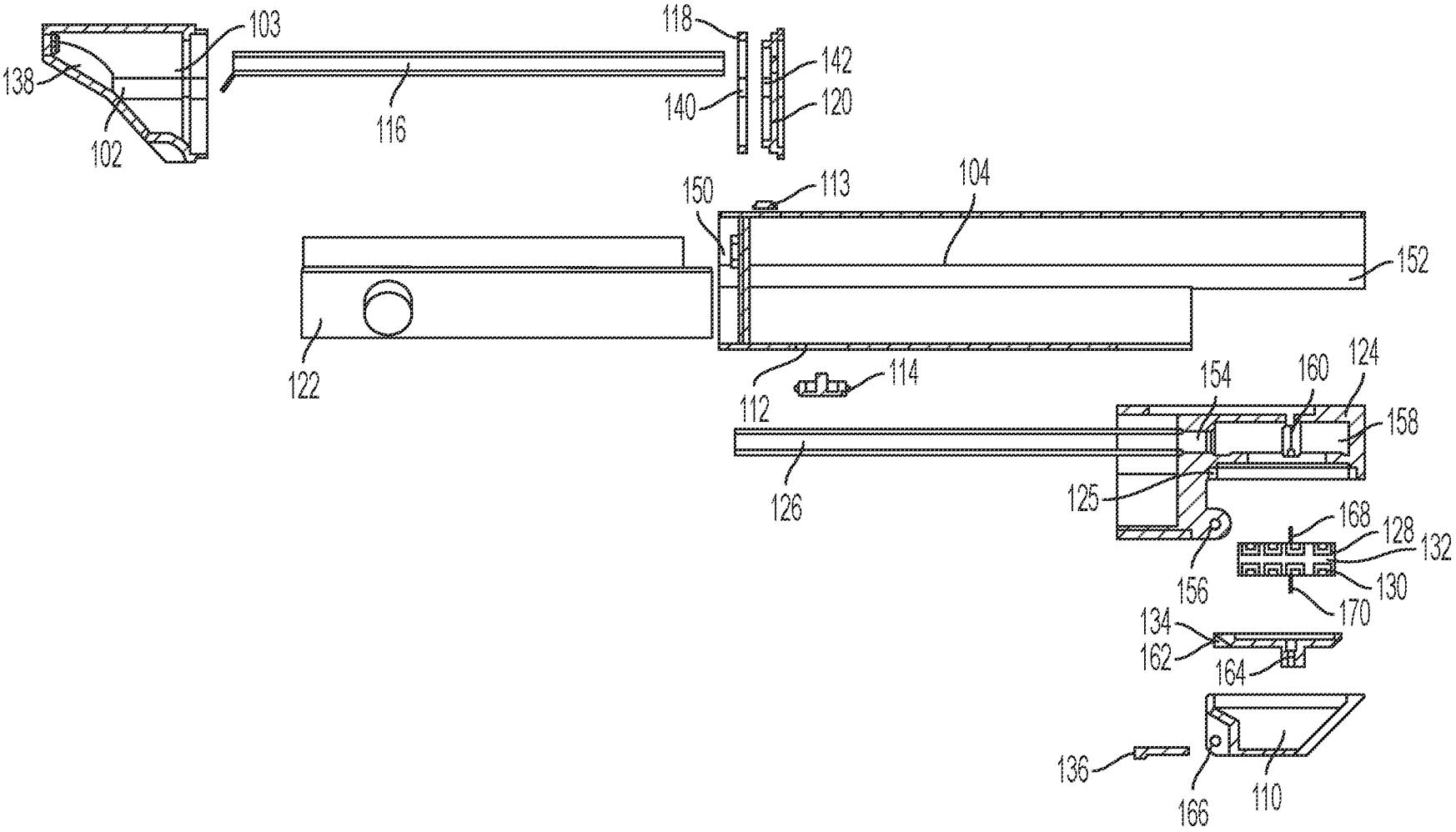
FIG. 3 is an exploded, side cross-sectional view of the inhaler device FIG. 1.

Referring to FIG. 3, device 100 has, as components connected together, mouthpiece 102, housing 104, hinged lower portion 110, button cover 114, a bottom button cover 115 (FIG. 1), an inner tube 116, a seal 118, a housing plate 120, an electronic assembly 122, upper portion 124, an outer tube 126, first heater 128, second heater 130, consumable 132 during use, a heater support 134, and slide lock 136.

Mouthpiece 102 has an interior cavity 138 so that openings 106 (FIG. 2) and cavity 138 are connected, and an open end 103 is opposite openings 106. Seal 118 has a hole 140 through a continuous surface that surrounds hole 140. Housing plate 120 has a hole 142 through a continuous surface that surrounds hole 142. Housing 104 has two openings, opening 107 and opening 112. In this and other embodiments of the present disclosure, electronic assembly 122 can have one or more conventional components, such as control boards, batteries, buttons, button covers, lights, and motors, that are used for a control and power system. A control board can also be referred to as controller board or a controller. Electronic assembly 122 can charge wirelessly or via a wired charging port connection.

Housing 104 also has an open front end 150 and an open rear end 152. Housing 104 has an opening 113 on the top of device 100 for a status light. The status light can be one or more status lights, for example, five status lights. Upper portion 124 has an opening 154 and is connected to outer tube 126 so that outer tube 126 overlaps opening 154 and has a hinge opening 156. Upper portion 124 has two terminal housings 158 (only one is shown), extending from a portion of upper portion 124, and two terminals 160, each in one of terminal housings 158. Heater support 134 has a platform portion 162 and two terminals 164 (only one is shown) in platform portion 162. Hinged lower portion 110 has a hinge opening 166 and a wire routing hole 133 (FIG. 5) for a wire to connect back through the wire routing hole to electronic assembly 122.

Figure 45:
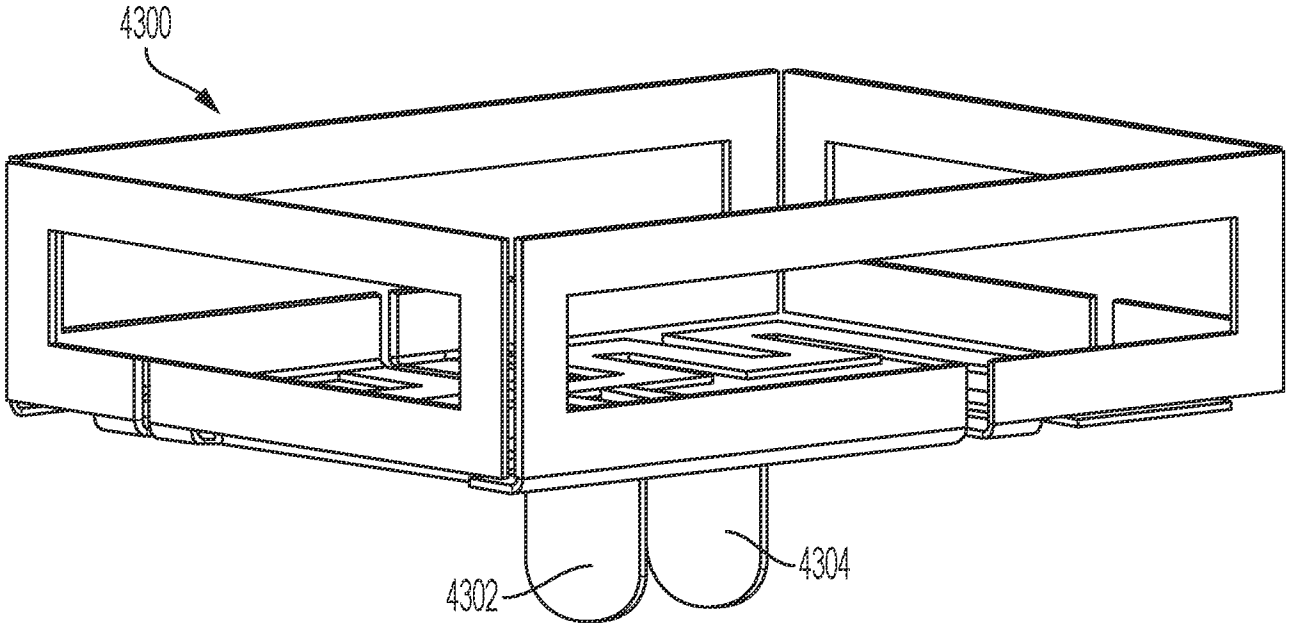
FIG. 45 is a front perspective view of a heating element that is modified to include prongs.
Figure 48:
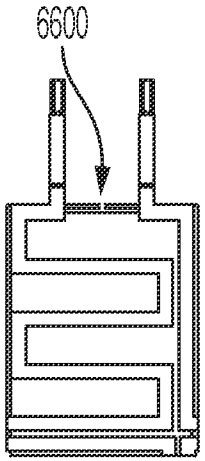
FIG. 48 is a top view of a heating element that has still another modified shape.
Figure 47:
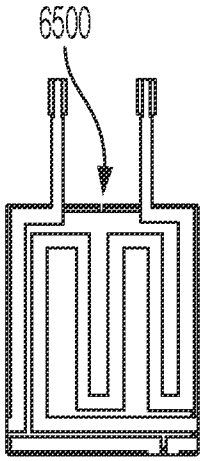
FIG. 47 is a top view of a heating element that has another modified shape.
Figure 46:
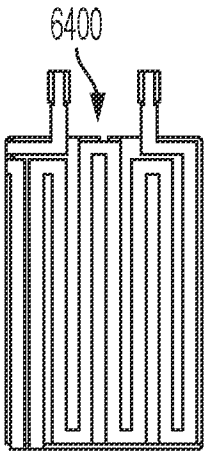
FIG. 46 is a top view of a heating element that has a modified shape.

Referring back to FIG. 3, first heater 128 has two conductors 168 (only one is shown in FIG. 3) and second heater 130 has two conductors 170 (only one is shown in FIG. 3). Referring to FIG. 45, first heater 128 and second heater 130 are preferably the same serpentine shape, for example, that is the same as heater 4300 shown in FIG. 45. In addition, first heater 128 can have the same shape or different shape as second heater 130.

Referring to FIGS. 3 and 4, when assembled, mouthpiece 102 connects to housing plate 120, so that housing plate 120 covers open end 103 of mouthpiece 102. Seal 118 is between mouthpiece 102 and housing plate 120 so that hole 140 of seal 118 overlaps hole 142 of housing plate 120. Inner tube 116 is adjacent to housing plate 120 so that a first opening of inner tube 116 overlaps hole 142 of housing plate 120 on a first side of housing plate 120 opposite a second side that is adjacent to seal 118. Accordingly, a mouthpiece sub-assembly can include mouthpiece 102, seal 118, housing plate 120 and inner tube 116. Inner tube 116 slides into outer tube 126 as a method of orientation, and a back portion of the mouthpiece sub-assembly press fits in and seals to open front end 150 of housing 104 so that housing plate 120 connects over open front end 150 of housing 104. Preferably, electronic assembly 122 is positioned in housing 104 to be free floating in the cavity of the main body of device 100.

As shown in FIG. 1, device 100 has two buttons with one in opening 112 and the second in opening 107. Button cover 114 covers opening 112 to initiate or deactivate heating and second button cover 115 covers opening 107 to initiate unlocking and ejection. Device 100 also has an electronically locked slider, namely, slide lock 136. The user can press or hold down button cover 114 to heat the consumable. Alternatively, the consumable could be heated by pressing and releasing button cover 114. Button cover 114 cannot be activated while the product is open. Button cover 114 will also need to be "shut off" or disengaged while device 100 is in the opened position.

Referring back to FIG. 3, housing 104 is positioned over inner tube 116 so that electronic assembly 122 is adjacent to inner tube 116. Upper portion 124 is connected in housing 104 covering open rear end 152. The load bearing of all mechanisms, outer tube 126, first heater 128, second heater 130, and heater support components is based entirely on the structure of upper portion 124 sliding into open rear end 152 of housing 104. Hinged lower portion 110 connects to upper portion 124 by a hinged connection. Slide lock 136 blocks hinged lower portion 110 in the closed position to prevent hinged lower portion 110 from moving to the opened position. A seal 125 is between hinged lower portion 110 and upper portion 124 so that seal 125 abuts heater support 134 in the closed position sealing cavity 101. Heater support 134 is connected in hinged lower portion 110. Each conductor 168 of first heater 128 is inserted in one of terminals 160 and each conductor 170 of second heater 130 is inserted into one of terminals 164. Consumable 132 is positioned between first heater 128 and second heater 130.

Figure 6:
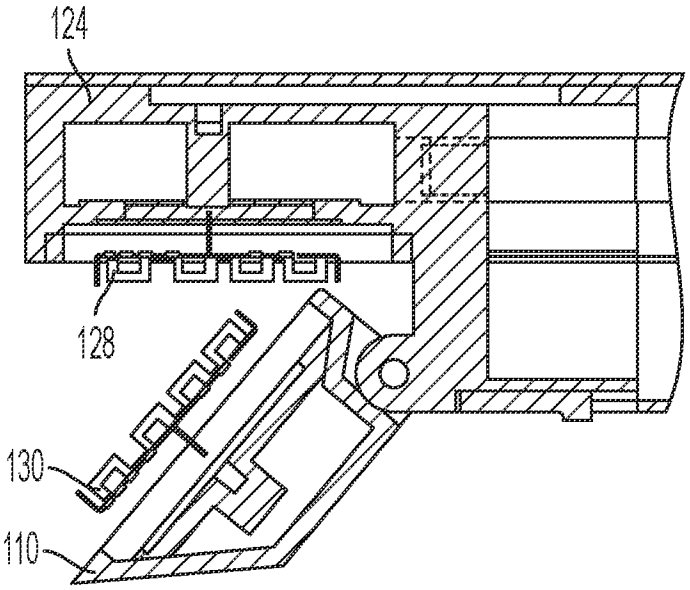
FIG. 6 is a partial enlarged, side, cross-sectional view of the inhaler device of FIG. 1 in an opened position.
Figure 5:
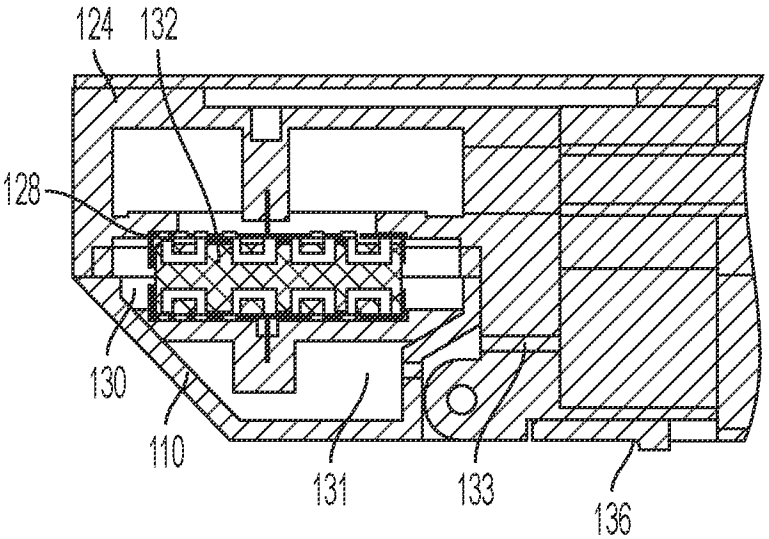
FIG. 5 is a partial enlarged, side, cross-sectional view of the inhaler device FIG. 1 in the closed position.

Referring to FIGS. 5 and 6, a user can move device 100 between a closed position as shown in FIG. 5 and an opened position as shown in FIG. 6. In the opened position, consumable 132 can be removed and replaced, first heater 128 can be removed and replaced, and second heater 130 can be removed and replaced.

Referring back to FIG. 4, in the closed position, device 100 can be activated by the user pressing and holding button cover 114. It is also possible that button cover 114 could be held during use, button cover 114 could be pressed and released, or could be turned on for a designated period of time. When the product is activated or turned on, a power source of electronic assembly 122 supplies power first to a control board of electronic assembly 122. Electronic assembly 122 receives this input from the user indicating that heat is needed. The control board directs an appropriate amount of current/voltage through terminals on the board, through the wire connecting the board to one of terminals 160, through one of conductors 168, through first heater 128, out the other of conductors 168 and terminals 160, through a return wire of the first heater 128/connected inbound wire for second heater 130, through one of terminals 164, through one of conductors 170, through second heater 130, out the other of conductors 170 (FIG. 3) and terminals 164, through the return wire of second heater 130 and back to the control board. The "appropriate amount of current/voltage" is tuned to the total unraveled length and cross-sectional area of the heaters so that the resistance of this path generates the desired amount of thermal energy directly into the consumable. The power passes through the circuit along the electrical connection to first heater 128 and to second heater 130 and each conducts heat to consumable 132 to create an inhalable aerosol between upper portion 124 and hinged lower portion 110 that are sealed together in the closed position. Thus, when the user places their lips on mouthpiece 102 and inhales to create a negative pressure through holes 106, the inhalable aerosol flows through opening 154 of upper portion 124, through inner tube 116, through hole 142 of housing plate, through hole 140 of seal 118, through holes 106 in mouthpiece 102 and into the mouth of the user. Device 100 can be deactivated by again pressing button cover 114 or by releasing button cover 114 so that the power source of electronic assembly 122 discontinues supplying current/voltage to first heater 128 and second heater 130 of device 100.

Accordingly, device 100 is a heating inhaler device with self-contained cavity 101 defined by upper portion 124 and hinged lower portion 110 of housing 104 of device 100.

Referring to FIG. 3, first heater 128 and second heater 130 connect to device 100 through standard electrical terminals 160, 164. Device 100 consists of a consumable exposure type that has hinged lower portion 110 that is a lower "jaw" that swings down, exposing the top of the consumable, namely, consumable 132. Thus, access to both first heater 128 and second heater 130 and the consumable, namely, consumable 132, is provided by lowering hinged lower portion 110 from upper portion 124 that preferably remains fixed. Accordingly, device 100 allows for replacing first heater 128 and second heater 130 by opening device 100, namely, moving hinged lower portion 110 away from upper portion 124; pulling first heater 128 away from housing 104 and pulling second heater 130 away from hinged lower portion 110 until they are disconnected from terminals 160, 164, respectively. Thus, each used heater can be disposed. Further, those heaters can be replaced, namely by inserting a new heater that is the same as first heater 128 in terminals 160 and inserting a new heater that is the same as second heater 130 in terminals 164 until the electrical connection is established.

Also, device 100 has a method of ejection of consumable 132 as described above where the user triggers ejection (mechanical or electrical) by pressing second button cover 115 (FIG. 1) so that a latch is unlocked and released to move hinged lower portion 110 away from upper portion 124 by gravity. A detent (not shown) stops hinged lower portion 110 at a predetermined location along its path. The user tips the used consumable, namely, consumable 132, out of second heater 130, which while open is the only support for consumable 132. To replace the consumable, namely consumable 132 in device 100, the user simply places a fresh consumable or consumable 132 into second heater 130. The user then pushes hinged lower portion 110, out of the detent lock position until it has firmly seated against upper portion 124. When hinged lower portion 110 swings upward towards upper portion 124 and passes slide lock 136, the latch is reactivated, preventing opening of device 100 until deliberately opened by the user.

Device 100 also provides burn prevention. Burn prevention is achieved by slide lock 136 not unlocking even after pressing button cover 114 until cavity 101 is sufficiently cool. This cooling is likely through a timeout of the controller of electronics assembly 122. For example, the controller uses a timer to count to a predetermined value after deactivating device 100 so that, once first heater 128 and second heater 130 do not generate heat, slide lock 136 is unlocked and allowed to disengage from lower hinged portion 110. Second button cover 115 is an additional safeguarding feature of device 100. Holding second button 115 momentarily down unlocks slide lock 136. The user can then slide lock 136, which allows hinged lower portion 110 to fall open due to gravity.

Referring to FIGS. 4 to 6, device 100 additionally ensures electrical connection. For example, upper portion 124 does not move, thus ensuring a reliable connection to the power source of electronics assembly 122 as long as the user does not tamper with first heater 128. Similarly, a permanent electrical connection is established through terminals 164 to the power source of electronic assembly 122 as long as the user does not tamper with second heater 130. Maintenance can be done with hinged lower portion 110 in the opened position. The user-facing components, such as upper portion 124 of device 100, are made of a poor thermal and electrical conductor preferably including a polymer. First heater 128 and second heater 130 are insulated from the exterior of device 100. This insulation can be air, insulating material such as glass fiber or other high heat resistant material, or any other insulating material. In addition, device 100 can have an addressable status light on top of device 100 which communicates to the user things like, "the device is hot", "battery is low", "the device is empty", "the device needs to be cleaned". This communication can be by a visual indicator, such as, for example, blinking the light in different colors and/or patterns. Alternatively, device 100 can use cover lights, haptics, or sounds, with any combination thereof to indicate different statuses of device 100.

Figure 7:
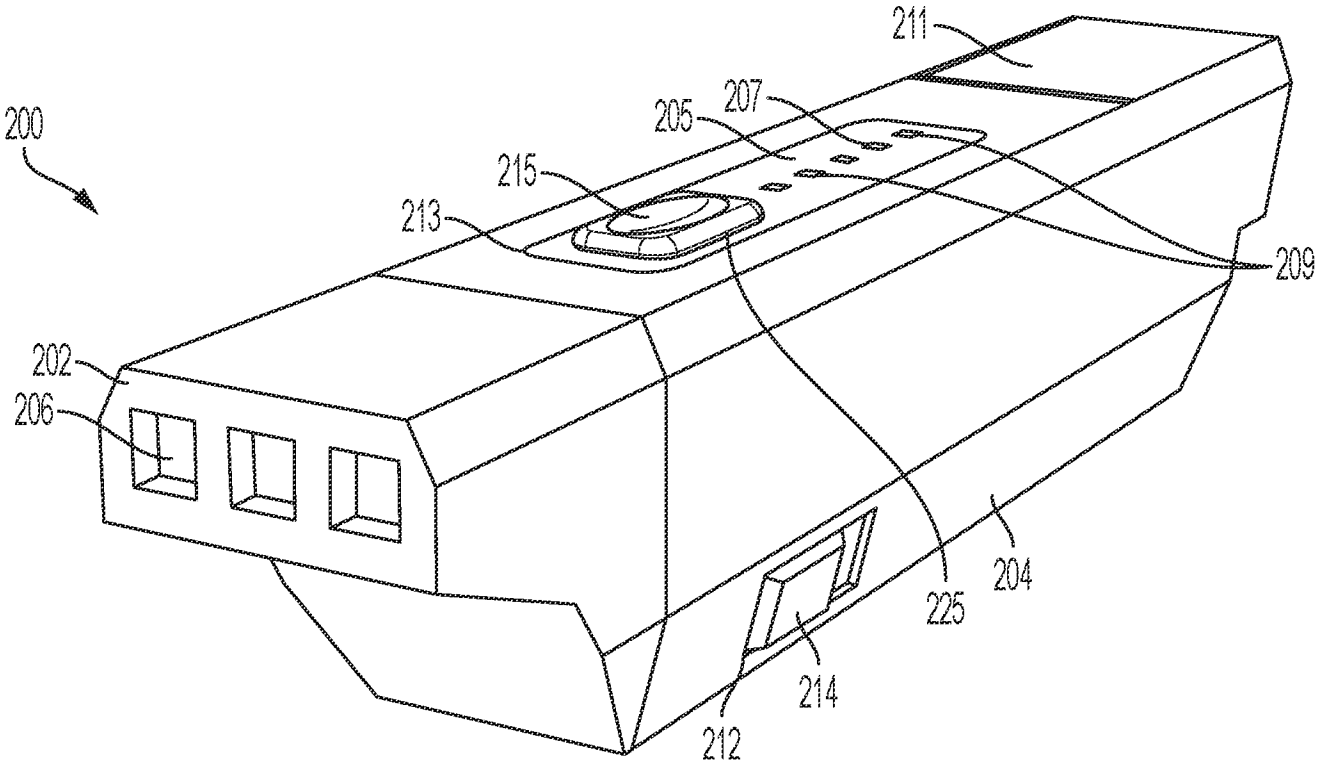
FIG. 7 is a front perspective view of a second embodiment of an inhaler device according to the present disclosure in a closed position.

FIG. 7 is a second embodiment of a heating inhaler device 200 according to the present disclosure ("device 200"). Device 200 has similar advantages described above for device 100. Device 200 has a mouthpiece 202 and a housing 204. Mouthpiece 202 has one or more, preferably more than two, openings 206. The user can inhale the aerosol generated in device 200 through openings 206. Hinged upper portion 211 is at the rear end of the device. Housing 204 has a first opening 212 that receives a slide switch cover 214. Housing 204 has a second opening 213 that receives control panel insert 205. Control panel insert 205 itself has a large opening 225 and five small openings 207 as shown. Large opening 225 accepts a button cover 215, and each small opening 207 accepts one signal LED 209. Accordingly, device 200 has one slide switch, one button, and five signal LEDs. Control panel insert 205 and all components are located on the top of device 200, and slide switch cover 214 is on the side of device 200.

Figure 8:
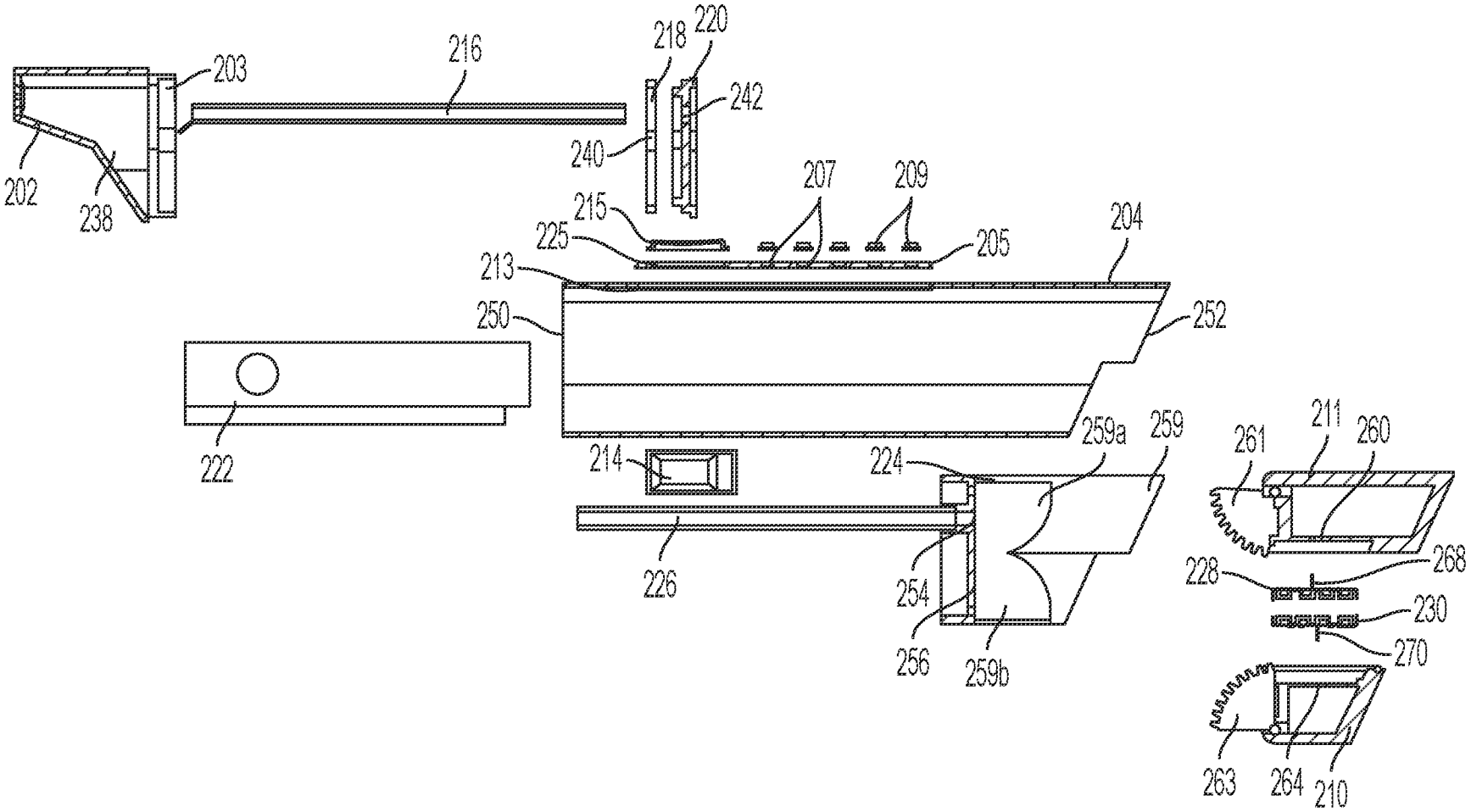
FIG. 8 is an exploded, side cross-sectional view of the inhaler device of FIG. 7.
Figure 11:
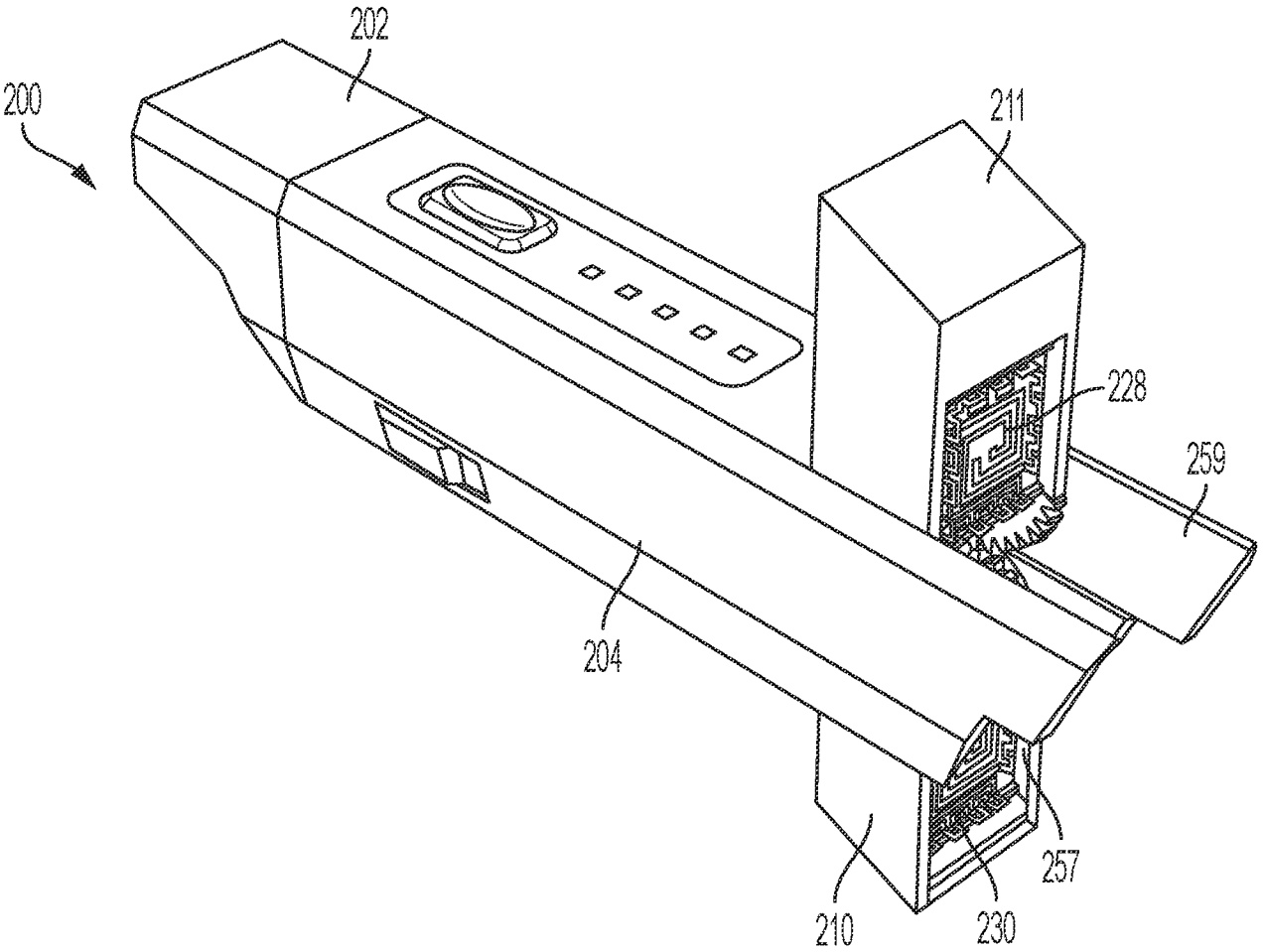
FIG. 11 is a back perspective view of the inhaler device of FIG. 7 in the opened position.

Referring to FIG. 8, device 200 has, besides mouthpiece 202 and housing 204, a hinged upper portion 211, a hinged lower portion 210, slide switch cover 214, button cover 215, an inner tube 216, a seal 218, a housing plate 220, an electronic assembly 222, a side portion 224, an outer tube 226, a first heater 228 and a second heater 230. Mouthpiece 202 has an interior cavity 238. Openings 206 and cavity 238 are connected and an open end 203 is opposite openings 206. Seal 218 has a hole 240 through a continuous surface that surrounds hole 240. Housing plate 220 has a hole 242 through a continuous surface that surrounds hole 242. In device 200, electronic assembly 222 can have one or more of control boards, buttons, LEDs, and batteries used for a control, power, and status indicator system. Again, a control board can also be referred to as a controller board or a controller. Electronic assembly 222 can charge via a wired charging port connection (not shown in figures). Housing 204 has a front end 250 and a rear end 252, both of which are open. Side portion 224 has a plate shape 256 with an opening 254 through it and a first sidewall 257 (FIG. 11) and a second side wall 259 extending from opposite sides of plate shape 256. First sidewall 257 and second side wall 259 are each shaped complementary to the shape of open rear end 252. Second side wall 259 has an upper cutout 259*a* and a lower cutout 259*b* that allow for the unobstructed motion of an upper gear 261 and a lower gear 263. Side portion 224 is connected to outer tube 226 so that outer tube 226 overlaps opening 254. Hinged upper portion 211 has two terminals 260 (only one is shown in FIG. 8), upper gear 261 and upper seal (not shown in drawings). Hinged lower portion 210 has two terminals 264 (only one is shown in FIG. 8) and lower gear 263. First heater 228 and second heater 230 can be the same or similar shape as first heater 128 and second heater 130. In addition, first heater 228 can have the same shape or different shape as second heater 230. First heater 228 has two conductors 268 (only one is shown in FIG. 8) and second heater 230 has two conductors 270 (only one is shown in FIG. 8).

Figure 9:
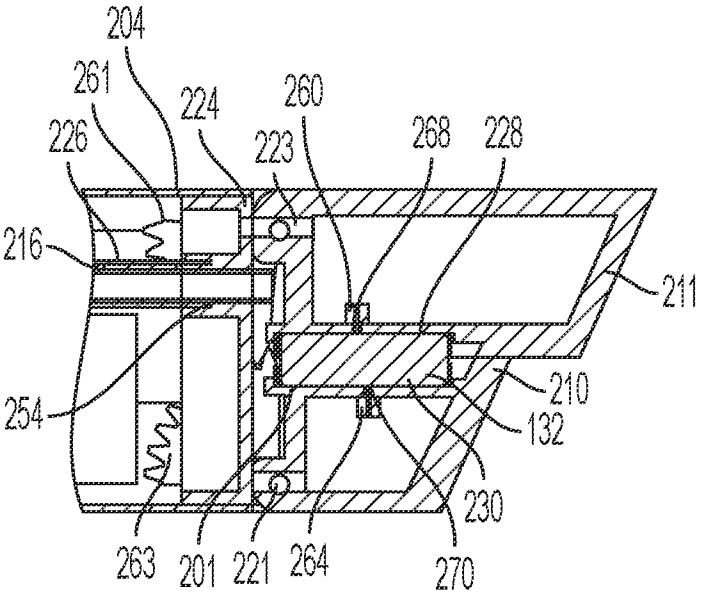
FIG. 9 is a partial enlarged, side, cross-sectional view of the inhaler device of FIG. 7 in the closed position.

Referring to FIGS. 8 and 9, when assembled, similar to device 100 shown in FIG. 3, mouthpiece 202 of device 200 connects to housing plate 220 so that housing plate 220 covers open end 203 of mouthpiece 202. Seal 218 is between mouthpiece 202 and housing plate 220 so that hole 240 of seal 218 overlaps hole 242 of housing plate 220. Inner tube 216 is adjacent to housing plate 220 so that a first opening of inner tube 216 overlaps hole 242 of housing plate 220 on a first side of housing plate 220 opposite a second side that is adjacent to seal 218. Electronic assembly 222 is positioned in housing 204. Housing 204 is positioned over inner tube 216 so that electronic assembly 222 is adjacent to inner tube 216, and housing 204 connects to housing plate 220 to cover open front end 250 of housing 204. Outer tube 226 is positioned over inner tube 216, and side portion 224 is connected to housing 204 covering open rear end 252. Hinged lower portion 210 connects to side portion 224 by a hinged connection so that lower gear 263 is positioned in lower cutout 259*b*. Hinged upper portion 211 connects to side portion 224 by a hinged connection so that upper gear 261 is positioned in upper cutout 259*a* and teeth of lower gear 263 engage with teeth of upper gear 261. Upper gear 261 and lower gear 263 are molded to be the same component as hinged upper portion 211 and hinged lower portion 210, respectively. Conductors 268 of first heater 228 are each inserted in one of terminals 260 and conductors 270 of second heater 230 are each inserted into one of terminals 264. Hinged upper portion 211 has a passage 223 and a lower portion has a passage 221 that allow flexible wiring to run back to electronic assembly 222. Consumable 132, that is the same as consumable 132 used with device 100, fits between first heater 228 and second heater 230. Upper portion 224 physically supports inner tube 216, outer tube 226, and all other moving parts of device 200 by the fit of upper portion 224 into housing 204.

Figure 10:
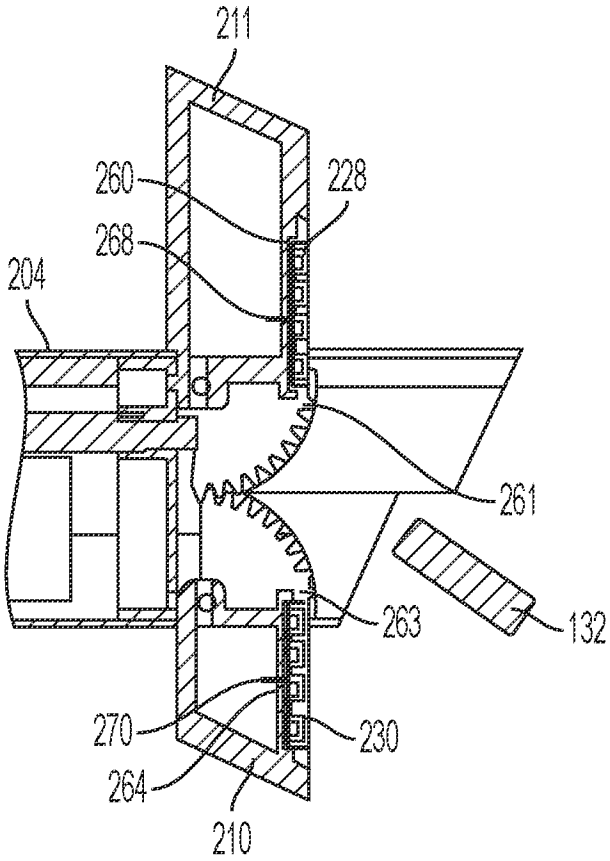
FIG. 10 is a partial enlarged, side, cross-sectional view of the inhaler device of FIG. 7 in an opened position.

Referring to FIGS. 9 and 10, a user can move device 200 between the closed position as shown in FIG. 9 and an opened position as shown in FIG. 10. In the closed position as shown in FIG. 9, device 200 can be activated by the user holding button cover 215 (FIG. 7) such that a power source of electronic assembly 222 (FIG. 8) supplies power first to a control board of electronic assembly 222. Electronic assembly 222 receives this input from the user indicating that heat is needed. The control board directs an appropriate amount of current/voltage through terminals on the board, through the wire connecting the board to one of terminals 260, through one of conductors 268, through first heater 228, out the other of conductors 268 and terminals 260, through a return wire of the first heater 228/connected inbound wire for second heater 230, through one of terminals 264, through one of conductors 270, through second heater 230, out the other of conductors 270 and terminals 264, through the return wire of second heater 230 and back to the control board. As with the first embodiment, the "appropriate amount of current/voltage" is tuned to the total unraveled length and cross-sectional area of the heaters so that the resistance of this path generates the desired amount of thermal energy directly into the consumable. The power passes through the circuit along the electrical connection to first heater 228 and second heater 230 to heat consumable 132 creating an inhalable aerosol between side portion 224, hinged lower portion 210 and hinged upper portion 211 that are sealed together in the closed position. Thus, when the user places their lips on mouthpiece 202 and inhales to create a negative pressure through holes 206, the inhalable aerosol flows through opening 254 of side portion 224, through inner tube 216, through hole 242 of housing plate, through hole 240 of seal 218, through holes 206 in mouthpiece 202 and into the mouth of the user. Device 200 can be deactivated by releasing button cover 215 so that the power source of electronic assembly 222 discontinues supplying current/voltage to first heater 228 and second heater 230.

In the opened position, consumable 132 can be removed and replaced, first heater 228 can be removed and replaced, and second heater 230 can be removed and replaced. To move device 200 from the closed position as shown in FIG. 9 to the opened position as shown in FIG. 10, the user pushes hinged upper portion 211 up and away from hinged lower portion 210 (FIG. 7), so that the upper gear 261 and lower gear 263 turn in opposite directions until a detent is reached. The user tips device 200 to tip consumable 132 out of second heater 230.

To move device 200 from the opened position as shown in FIG. 10 to the closed position as shown in FIG. 9, a force is applied by the user to both of hinged lower portion 210 and hinged upper portion 211 to overcome the bias of the torsion spring (not pictured) to move hinged lower portion 210 and hinged upper portion 211 together. Once hinged upper portion 211 and hinged lower portion 210 are in place, the electromagnetic lock (not pictured) engages to keep the device in the closed position.

Accordingly, device 200 is a heating inhaler device with a self-contained cavity 201 at the end of housing 204 of device 200 as shown in FIG. 9 formed by side portion 224, hinged lower portion 210, hinged upper portion 211, and upper seal (not shown) that is a seal between hinged upper portion 211 and hinged lower portion 210 when in the closed position. Access to both the heaters, namely, first heater 228 and second heater 230, and the consumable, namely, consumable 132, is provided by hinged jaws of hinged lower portion 210 and hinged upper portion 211. Both jaws of hinged lower portion 210 and hinged upper portion 211 open opposite each other with possible stops in the opening along the way to fully open. Consumable 132 can be held in place during motion of hinged lower portion 210 and hinged upper portion 211 by a non-heating support feature or can drop from bottom heater due to gravity. The shape of this non-heating support feature can also puncture any potential covering options of the consumables. Device 200 has a consumable exposure type of both jaws of hinged lower portion 210 and hinged upper portion 211 that swing open, exposing the consumable, namely, consumable 132, possibly suspended in place.

First heater 228 and second heater 230 can be replaced by opening device 200 as described below. The user can urge the jaws of hinged lower portion 210 and hinged upper portion 211 away from one another past the first detent. The jaws of hinged lower portion 210 and hinged upper portion 211 can open to a second detent, revealing a maintenance mode. The used heater of first heater 228 is slid slightly away from hinged upper portion 211 to be disconnected from terminals 260 of hinged upper portion 211 and thus the used heater 228 is then disposed. A new heater of first heater 228 has conductors 268 that are each pressed into one of terminals 260 of hinged upper portion 211 so first heater 228 slides down one of terminals 260 towards hinged upper portion 211 until first heater 228 stops moving. Analogously, the used heater of second heater 230 is slid slightly away from hinged lower portion 210 to be disconnected from one of terminals 264 of hinged lower portion 210 and thus the used heater is disposed. A new heater of second heater 230 has conductors 270 that are each pressed into one of terminals 264 of hinged lower portion 210 so second heater 230 slides down one of terminals 264 towards hinged lower portion 210 until second heater 230 stops moving. Electronic assembly 222 of device 200 has an internal counter that keeps electromagnetic lock engaged if button cover 215 is activated within a certain amount of time—i.e., this is a timer keeping track of whether first heater 228 and second heater 230 are cool enough to touch.

Device 200 provides burn prevention via a normally-on electromagnetic circuit. The exterior of device 200 insulates first heater 228 and second heater 230 from the user of device 200. This insulation can be air, insulating material such as glass fiber or other high heat resistant material, or any other non-thermally conducting material. Device 200 has a maintenance mode when the jaws of hinged upper portion 211 and hinged lower portion 210 are folded apart from each other from slightly open to completely flat as shown in FIG. 10, to provide maximum access to cleaning.

Device 200 conveys device status through the series of five LED lights 209 which are part of the electronic assembly 222. As compared to device 100 that has an addressable status light on top of the device, the lighting patterns of the five LED lights 209 instead communicates to the user statuses such as, but not limited to, "the device is hot", "battery is low", "the device is empty", "the device needs to be cleaned" by varying duration, intensity, and pattern of illumination as explained to the user in the user manual.

First heater 228 and second heater 230 can be replaced by opening device 200 as described above.

The user can urge the jaws of hinged lower portion 210 and hinged upper portion 211 away from one another past the first detent. The jaws of hinged lower portion 210 and hinged upper portion 211 can open to a second detent, revealing a maintenance mode. The used heater of first heater 228 is slid slightly away from hinged upper portion 211 to be disconnected from terminals 260 of hinged upper portion 211 and thus the used heater 228 is then disposed. A new heater of first heater 228 has conductors 268 that are each pressed into one of terminals 260 of hinged upper portion 211 so first heater 228 slides down one of terminals 260 towards hinged upper portion 211 until first heater 228 stops moving. Analogously, the used heater of second heater 230 is slid slightly away from hinged lower portion 210 to be disconnected from one of terminals 264 of hinged lower portion 210 and thus the used heater is disposed. A new heater of second heater 230 has conductors 270 that are each pressed into one of terminals 264 of hinged lower portion 210 so second heater 230 slides down one of terminals 264 towards hinged lower portion 210 until second heater 230 stops moving. Electronic assembly 222 of device 200 has an internal counter that prevents slide lock 219 from unlocking if first button cover 214 is activated within a certain amount of time—i.e., this is a timer keeping track of whether first heater 228 and second heater 230 are cool enough to touch.

Device 200 provides burn prevention via an electrical or mechanical lock on the slide lock 219. The exterior of device 200 insulates first heater 228 and second heater 230 from the user of device 200. This insulation can be air, insulating material such as glass fiber or other high heat resistant material, or any other non-thermally conducting material. Device 200 has a maintenance mode when the jaws of hinged upper portion 211 and hinged lower portion 210 are folded apart from each other from slightly open to completely flat as shown in FIG. 10, to provide maximum access to cleaning.

Device 200 is shown as having a visual display of status, namely, status lights 207. Device 200 can also convey device status through haptic technology which is part of electronic assembly 222. As compared to device 100 that has an addressable status light on top of the device, device 200 can have pulsing of haptics that instead communicates to the user statuses such as, but not limited to, "the device is hot", "battery is low", "the device is empty", "the device needs to be cleaned" by varying duration, intensity, and pattern of vibration as explained to the user in the user manual. However, device 200 can be modified to include the addressable status light of device 100, and, similarly, device 100 can be modified to include the vibrating motor of device 200. Alternatively, device 200 can use lights, haptics, sounds, and any combination thereof to indicate different statuses of device 200.

Figure 12:
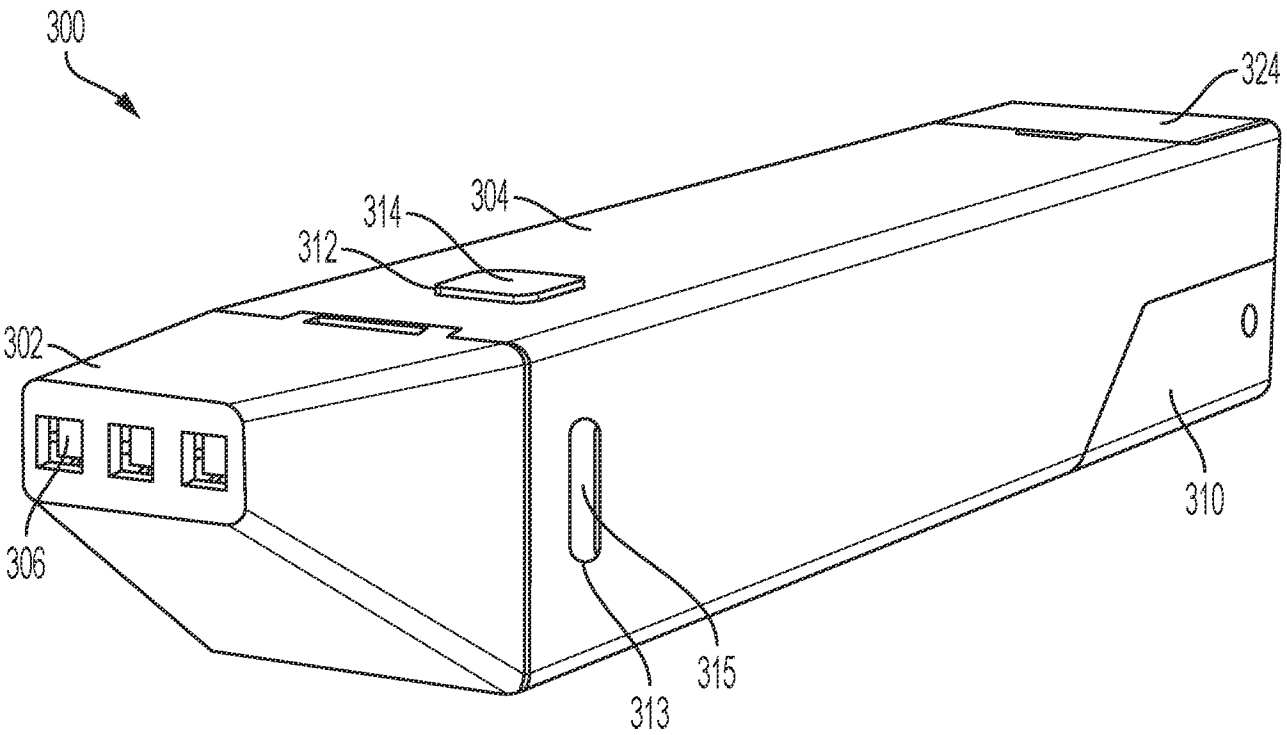
FIG. 12 is a front perspective view of a third embodiment of an inhaler device according to the present disclosure in a closed position.

Referring to FIG. 12, a heating inhaler device 300 according to a third embodiment of the present disclosure is shown ("device 300"). Device 300 has similar advantages described above for device 100 with major changes in functionality occurring in the method of disruption of the heating cavity and exposure of the consumable 132. Device 300 has a mouthpiece 302 and a housing 304. Mouthpiece 302 has openings 306, preferably at least two or more openings 306. The user can inhale the aerosol generated in device 300 through openings 306, which openings are preferably more than one. Housing 304 is connected to a hinged door 310 and an upper portion 324. Housing 304 has an opening 312 that receives a button cover 314. Body 308 has a second opening 313 on one side of housing 304 that exposes a charging port 315.

Figure 13:
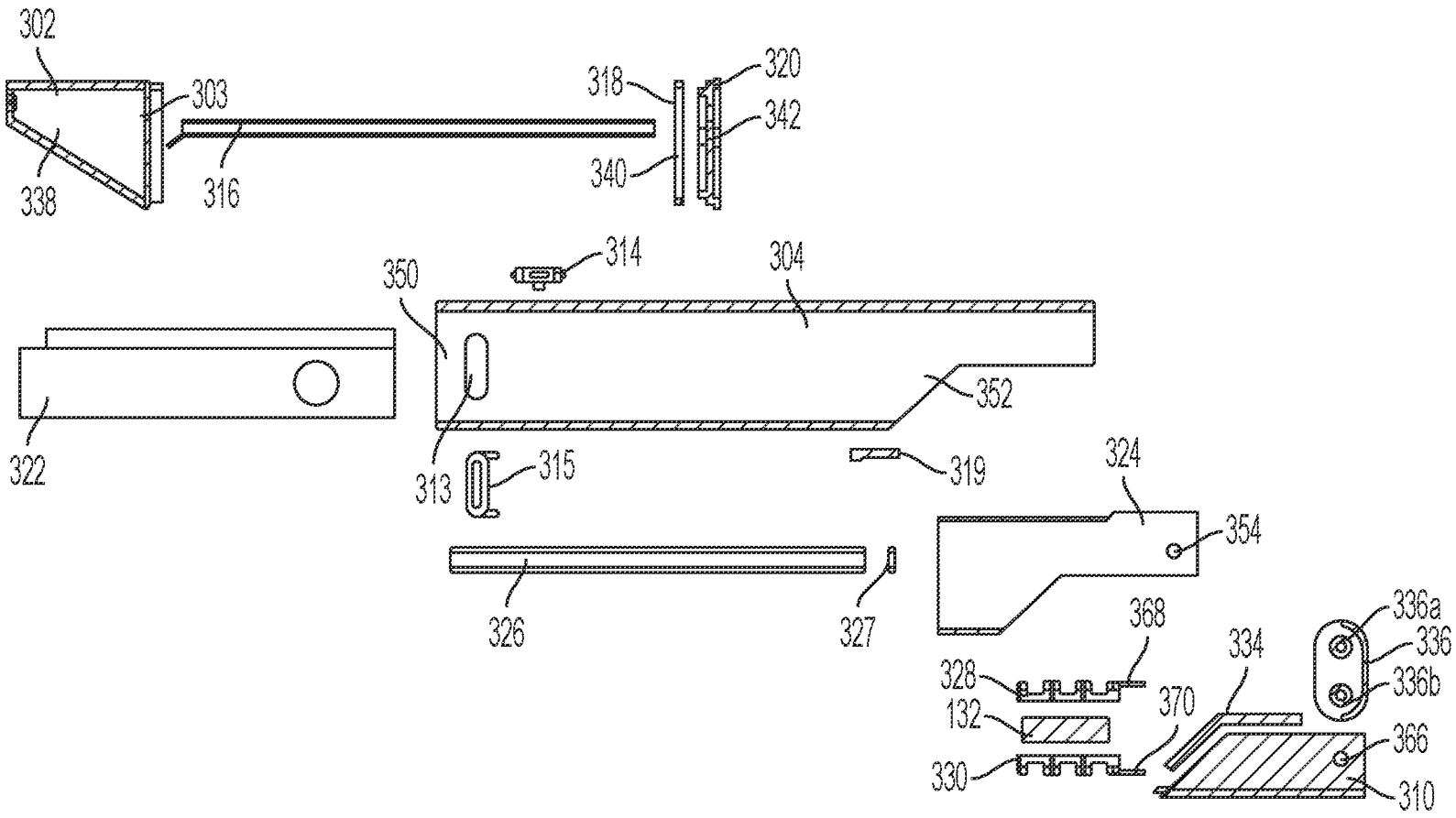
FIG. 13 is an exploded, side cross-sectional view of the inhaler device of FIG. 12.

Referring to FIG. 13, device 300 has mouthpiece 302, housing 304, a hinged door 310, opening 313, a first button cover 314, an inner tube 316, a seal 318, a cavity establishing and enforcing slide lock 319 ("slide lock"), a housing plate 320, an electronic assembly 322, upper portion 324, an outer tube 326, tube seal 327, a first heater 328, a second heater 330, a heater support 334 and a hinge support 336, and consumable 132 for use in device 300.

Mouthpiece 302 has an interior cavity 338 so that openings 306 (FIG. 12) and cavity 338 are connected, and an open end 303 is opposite openings 306. Seal 318 has a hole 340 through a continuous surface that surrounds hole 340. Housing plate 320 has a hole 342 through a continuous surface that surrounds hole 342. Electronic assembly 322 can have one or more of control boards, batteries, button covers, lights, and motors that are used for a control and power system. As stated herein, a control board can also be referred to as a controller board or a controller. Electronic assembly 322 can charge wirelessly or through charging port 315. Housing 304 has an open front end 350 and an open rear end 352. Upper portion 324 has an opening 354. Hinged door 310 has a hinge opening 366. Hinge support 336 has an upper opening 336*a* and a lower opening 336*b*. First heater 328 and second heater 330 can be the same shape as first heater 128 and second heater 130, respectively, of device 100; however, first heater 328 and second heater 330 can be different shapes. In addition, first heater 328 can have the same shape or different shape as second heater 330. First heater 328 has portions that are two conductors 368 and second heater 330 has portions that are two conductors 370.

Referring to FIG. 13, when assembled, similar to device 100 shown in FIG. 3, mouthpiece 302 connects to housing plate 320 so that housing plate 320 covers open end 303 of mouthpiece 302. Seal 318 is between mouthpiece 302 and housing plate 320 so that hole 340 of seal 318 overlaps hole 342 of housing plate 320. Inner tube 316 is adjacent to housing plate 320 so that a first opening of inner tube 316 overlaps hole 342 of housing plate 320 on a first side of housing plate 320 opposite a second side that is adjacent to seal 318. Housing 304 has opening 312 (FIG. 12) that is covered by button cover 314. Slide lock 319 fits in a cutout 323 (FIG. 14) in housing 304. Slide lock 319 is connected to housing 304 and is biased, for example, by a spring, in a direction away from opening 350 of housing 304. Accordingly, device 300 has one button covered by button cover 314, a charging port 315, and an electronically locked slider, namely, slide lock 319. Button cover 314 is on top of device 300, slide lock 319 is on bottom of device 300, and charging port 315 is on the side of device 300. Button cover 314 signals to heat consumable 132. Button cover 314 is a push button where one push of button cover 314 activates device 300 to supply current/voltage to first heater 328 and second heater 330 and a second push of button cover 314 deactivates device 300 to stop supply of current/voltage to first heater 328 and second heater 330. The controller of electronic assembly 322 keeps track of the number of seconds that elapsed while first heater 328 and second heater 330 have been on consumable 132 to determine when the consumable may need to be replaced.

Figure 14:
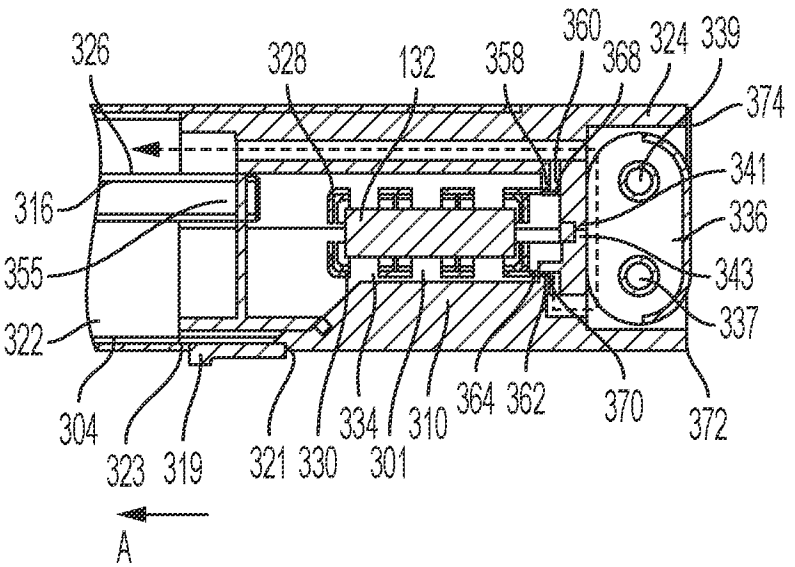
FIG. 14 is a partial enlarged, side, cross-sectional view of the inhaler device of FIG. 12 in the closed position.

Referring to FIG. 14, electronic assembly 322 is positioned in housing 304. Housing 304 is positioned over inner tube 316 so that electronic assembly 322 is adjacent inner to tube 316 and housing 304 connects to housing plate 320 to cover open front end 350 of housing 304. Outer tube 326 is positioned over inner tube 316 and upper portion 324 is connected in housing 304 covering open rear end 352. Upper portion 324 is connected to outer tube 326 so that outer tube 326 overlaps an opening 355 in upper portion 324 and tube seal 327 is between outer tube 326 and upper portion 324. Upper portion 324 physically supports inner tube 316, outer tube 326 and all other moving parts of device 300 by the fit between upper portion 324 and housing 304.

Figure 15:
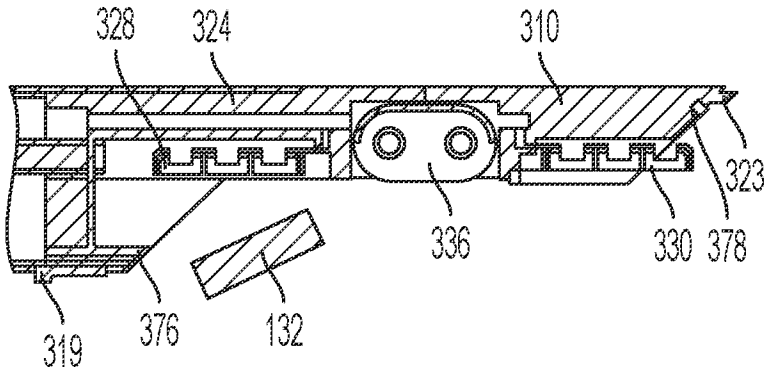
FIG. 15 is a partial enlarged, side, cross-sectional view of the inhaler device of FIG. 12 in an opened position ejecting a consumable.

Referring to FIGS. 14-15, while any hinge mechanism can be used, preferably hinged door 310 connects to hinged support 336 by aligning hinge opening 366 of hinged door 310 and lower opening 336*b* (FIG. 13) of hinge support 336 so that pin 337 is inserted through opening 366 and opening 336*b*. Likewise, upper portion 324 connects to hinged support 336 by aligning opening 354 of upper portion 324 and upper opening 336*a* of hinge support 336 so that pin 339 is inserted through opening 354 and opening 336*b*. Heater support 334 is connected to hinged door 310. Upper portion 324 has two terminal housings 358 (only one is shown) extending from a portion of upper portion 324 each having a terminal 360 in terminal housing 358. Hinged door 310 has two terminals 364 (only one is shown) in a terminal housing 362. Each of conductors 368 of first heater 328 is inserted in one of terminals 360 of upper portion 324 and each of conductors 370 of second heater 330 is inserted into one of terminals 364 of hinged door 310. Consumable 132 fits between first heater 328 and second heater 330. Hinged door 310 has a lip 321 on an end opposite opening 366 (FIG. 13). Slide lock 319 fits over lip 321 in the closed position.

Referring to FIGS. 14 and 15, a user can move device 300 between a closed position as shown in FIG. 14 and an opened position as shown in FIG. 15 due to gravity. In the closed position, device 300 can be activated by the user pressing or holding button cover 314 (FIG. 12) such that a power source of electronic assembly 322 supplies power first to a control board of electronic assembly 322 to heat the consumable, namely, consumable 132. Electronic assembly 322 receives this input from the user indicating that heat is needed. The control board directs an appropriate amount of current/voltage through terminals on the board, through the wire connecting the board to one of terminals 360, through one of conductors 368, through first heater 328, out the other of conductors 368 and terminals 360, through a return wire of the first heater 328/connected inbound wire for second heater 330, through one of terminals 364, through one of conductors 370, through second heater 330, out the other of conductors 370 and terminals 364 of the second heater 330, through the return wire of second heater 330 and back to the control board. The "appropriate amount of current/voltage" is tuned to the total unraveled length and cross-sectional area of the heaters so that the resistance of this path generates the desired amount of thermal energy directly into the consumable. The power passes through the circuit along the electrical connection to first heater 328 and second heater 330 that heat consumable 132 to create an inhalable aerosol between upper portion 324 and hinged door 310 that are sealed together in the close position to form cavity 301. Thus, when the user places their lips on mouthpiece 302 and inhales to create a negative pressure through holes 306, the inhalable aerosol flows through opening 355 through upper portion 324, through inner tube 316, through hole 342, through hole 340 (FIG. 13), through holes 306 in mouthpiece 302 and into the mouth of the user. Device 300 can be deactivated by again pressing button cover 314 so that the power source of electronic assembly 322 discontinues supplying current/voltage to first heater 328 and second heater 330.

In the opened position, consumable 132 can be removed and replaced, first heater 328 can be removed and replaced, and second heater 330 can be removed and replaced. To move device 300 from the closed position as shown in FIG. 14 to the opened position as shown in FIG. 15, the user triggers the action to open hinged door 310 by moving slide lock 319 in a direction A toward mouthpiece 302 to displace slide lock 319 off of lip 321 of hinged door 310 so that the user can move hinged door 310 away from upper portion 324 to the opened position. To move device 300 from the opened position as shown in FIG. 15 to the closed position as shown in FIG. 14, the user applies force to hinged door 310 to move hinged door 310 toward upper portion 324. On transition to the closed position, slide lock 319 temporarily moves in a direction opposite direction A along groove 323. Once lip 321 passes the plane of slide lock 319, slide lock 319 returns to position and re-engages lip 321, which thereby maintains hinged door 310 in the closed position.

Accordingly, device 300 is a heating, inhaler device with a self-contained cavity 301 formed by hinged door 310 and upper portion 324 at the end of the housing 304 of device 300. Due to hinged door 310, access to first heater 328, second heater 330, and the consumable, namely, consumable 132, is provided at the end of device 300.

Figure 16:
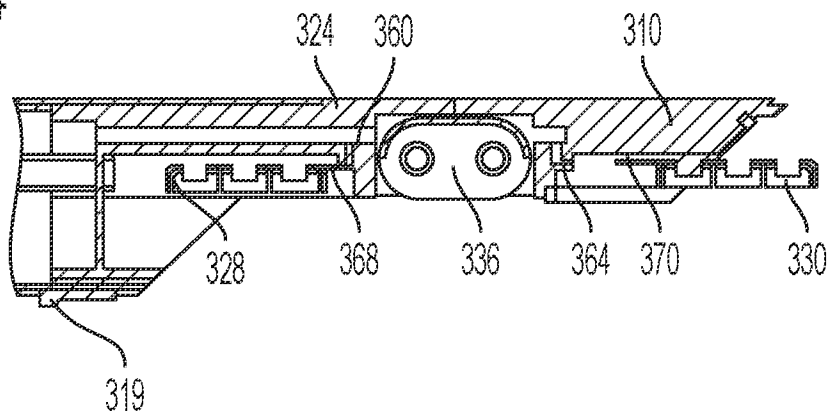
FIG. 16 is a partial enlarged, side, cross-sectional view of the inhaler device of FIG. 12 in the opened position.

Device 300 provides for replacement of first heater 328 and second heater 330 by the user's trigger action to open device 300 so that a closed lock holding hinged door 310 is released as described herein. The user pushes hinged door 310 into a maintenance mode, namely, the opened position as shown in FIG. 16. First heater 328 is pulled radially away from hinge support 336. The user disposes of old first heater 328. A fresh first heater 328 is pushed radially towards hinge support 336 and joins electrically by conductors 368 of first heater 328 that are each inserted in one of terminals 360 of upper portion 324. Similarly, second heater 330 is pulled radially away from hinge support 336. The user disposes of old second heater 330. A fresh second heater 330 is pushed radially towards hinge support 336 and joins electrically by conductors 370 of second heater 328 so that each is inserted in one of terminals 364 of hinged door 310.

Device 300 provides for ejection of consumable 132 by the user moving device 300 from the closed position as shown in FIG. 14 to the opened position as shown in FIG. 15 so that consumable 132 falls out of device 300 by gravity. Alternatively, a non-heated structure, for example, a fork structure similar to the feature described in device 200, holds the consumable 132 in place for the user to remove it. Device 300 provides for replacing the consumable 132 by the user rotating the device 180 degrees, or in other words face up, to insert a new pellet in first heater 328. Alternatively, the user could push a new consumable 132 onto the non-heated structural feature, for example, a fork structure similar to device 200. The user then closes hinged door 310 by moving device 300 from the opened position as shown in FIG. 16 to the closed position as shown in FIG. 14.

First heater 328 and second heater 330 are insulated from the exterior of device 300 by a polymer of device 300. This insulation can be air, insulating material such as glass fiber or other high heat resistant material, or any other insulating material. Slide lock 319 and the controller of electronic assembly 322 prevent hinged door 310 from opening while device 300 is hot.

Device 300 ensures electrical connection in device 300 by an electrical connection for the wiring between first heater 328 and second heater 330. A connector 341 is pushed back into a receptacle 343 to establish an electrical connection between first heater 328 and second heater 330 when the system is closed so that the power source of electronic assembly 322 can conduct electric current to first heater 328 and thus to second heater 330. Alternatively, the electrical connection between first heater 328 and second heater 330 may not necessarily be broken while the device is open. Upper portion 324 has a sensor 376 that communicates with the controller of electronic assembly 322, and hinged door 310 has a sensor member 378 that is detectable by sensor 376. When in the closed position, sensor member 378 is detectable by sensor 376. When in the opened position, sensor member 378 is not detectable by sensor 376. The controller of electronic assembly 322 controls operation so that current/voltage from electronic assembly 322 is supplied to first heater 328 and second heater 330 only when sensor 376 detects sensor member 378 to indicate that hinged door 310 is in the closed position.

Device 300 has a maintenance mode. The maintenance mode is when device 300 is in the opened position where a magnetic, electrical, or mechanical connection can hold hinged door 310 open. In particular, hinged door 310 can have magnetic portion 372 adjacent to hinge support 336, and upper portion 324 can have a magnetic portion 374 adjacent to an opposite side of hinge support 336 so that when device 300 is in the opened position, magnetic portion 372 abuts magnetic portion 374 to maintain hinged door 310 in the opened position.

Device 300 has no visual display of status. Device 300 has a tone generating buzzer—much like the noise generation capabilities of a microwave oven—which pulses to indicate status via sound—rather than by sight. This buzzer is part of the electronic assembly 322. In contrast to device 100 that has an addressable status light on top of the device, the pulsing of the buzzer of device 300 communicates to the user device status, such as but not limited to, "the device is hot", "battery is low", "the device is empty", "the device needs to be cleaned". It does so by varying duration, pitch, and pattern of sound in different patterns. However, device 300 can be modified to include the addressable status light of device 100 or the haptics of device 200, and, similarly, device 100 and device 200 can be modified to include the buzzer of device 300. Alternatively, device 300 can use haptics, sounds, and any combination thereof to indicate different statuses of device 300.

Device 300 has a safeguarding feature and provides for burn prevention that includes an internal counter in of electronic assembly 322 that keeps slide lock 319 locked while first heater 328 and second heater 330 are too hot to touch. After the required time has elapsed, the user can then move slide lock 319, which clears the path of motion for hinged door 310 that swings down because of gravity. The consumable 132 falls out. For a maintenance mode, lower door 310 can be manually pushed to its limit, where magnetic portion 372 of hinged door 310 abuts magnetic portion 374 of upper portion 324 to maintain hinged door 310 in the opened position. To close device 300, the user simply pivots lower door 310 into position and pushes it shut where the latch will then reactivate and hold lower door 310 closed.

Figure 17:
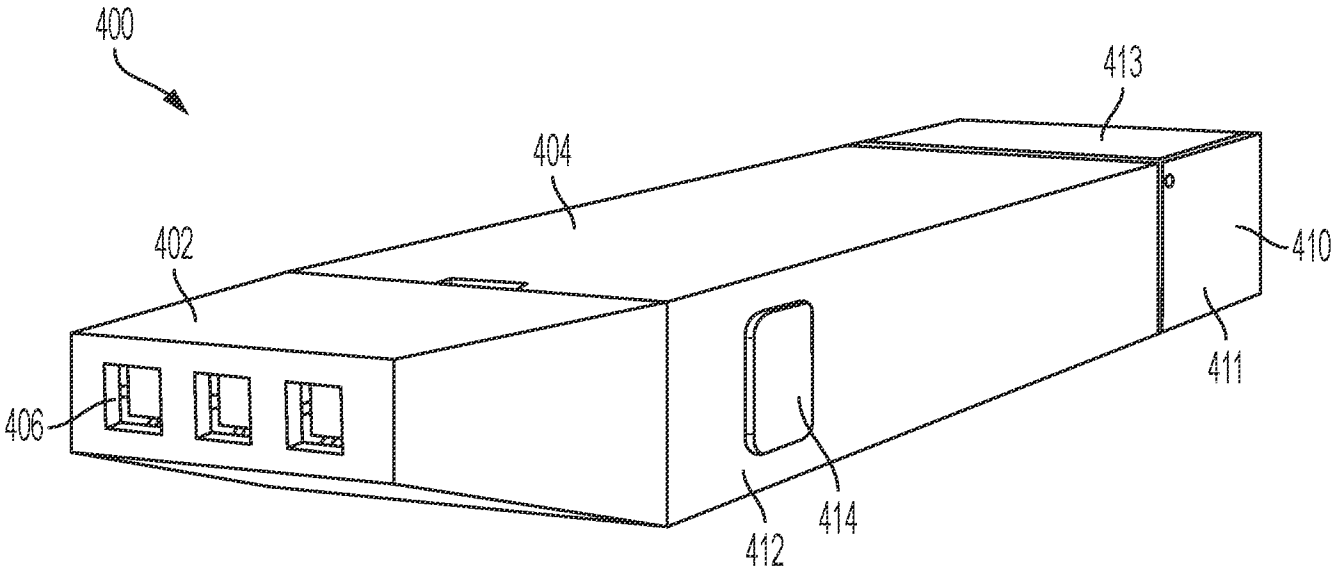
FIG. 17 is a front perspective view of a fourth embodiment of an inhaler device according to the present disclosure in a closed position.

FIG. 17 is a fourth embodiment of a heated, inhaler device 400 according to the present disclosure ("device 400"). Device 400 has similar advantages described above for device 100 with major changes in functionality occurring in the method of disruption of the heating cavity and exposure of the consumable 132. Device 400 has a mouthpiece 402 and a housing 404. Mouthpiece 402 has one or more openings 406, preferably at least two or more. The user can inhale the aerosol generated in device 400 through openings 406. Housing 404 is connectable to a cap 410. Housing 404 has an opening 412 that receives a button cover 414. Cap 410 includes a cap body 411 and a cap door 413 that is preferably hinged to cap body 411.

Figure 18:
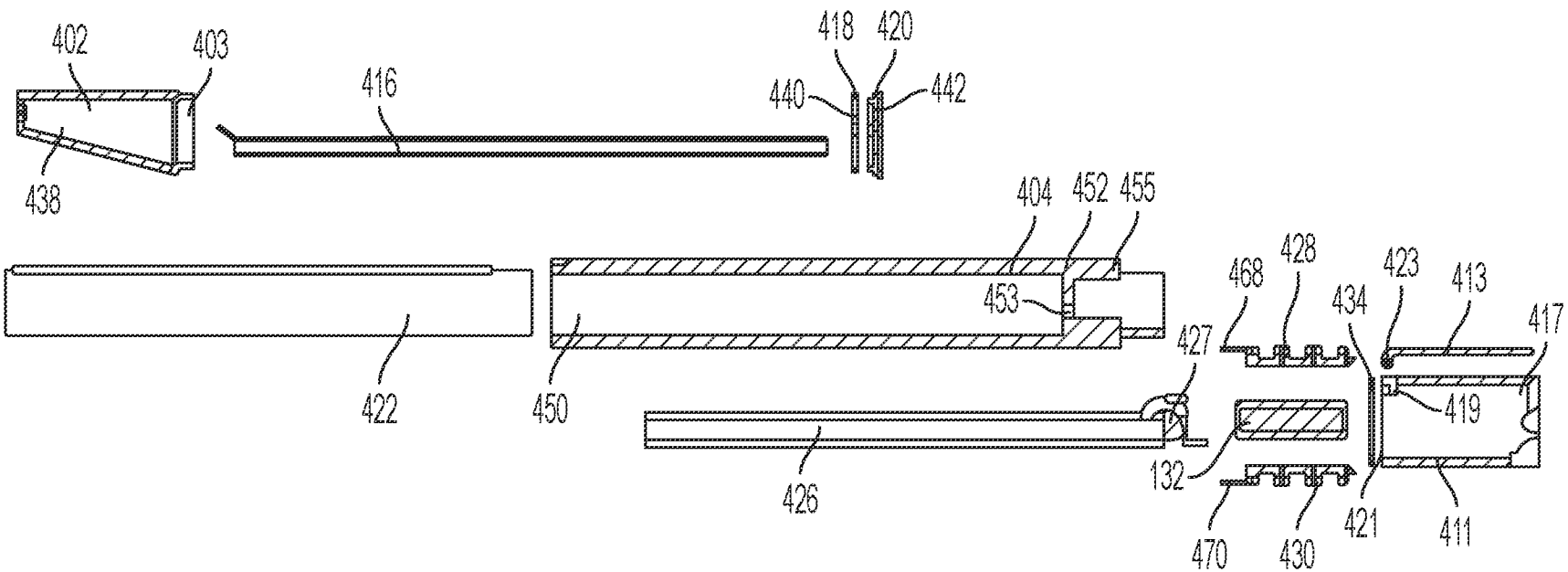
FIG. 18 is an exploded, side cross-sectional view of the inhaler device of FIG. 17.

Referring to FIG. 18, device 400 has mouthpiece 402, housing 404, a cap body 411, a cap door 413, an inner tube 416, a seal 418, a housing plate 420, an electronic assembly 422, an outer tube 426, an ejection mechanism 427, a first heater 428, a second heater 430, and a cap seal 434, and consumable 132 for use in device 400. Mouthpiece 402 has an interior cavity 438 so that openings 406 (FIG. 17) and cavity 438 are connected and an open end 403 is opposite openings 406. Seal 418 has a hole 440 through a continuous surface that surrounds hole 440. Housing plate 420 has a hole 442 through a continuous surface that surrounds hole 442. Electronic assembly 422 can have one or more of control boards, batteries, button covers, lights, and motors, used for a control and power system. Again, a control board can also be referred to as a controller board or a controller. Electronic assembly 422 can charge wirelessly and can have a charging port. Housing 404 has a connector 455 extending from rear end wall 452. First heater 428 and second heater 430 preferably have the same serpentine shape as first heater 128 and second heater 130; however, first heater 428 and second heater 430 can have a different shape. In addition, first heater 428 can have the same shape or different shape as second heater 430. First heater 428 has two connection portions 468 and second heater 430 has two connection portions 470. Cap body 411 has an open rear side 421, an opening 417 through a top side and a hinge opening 419 adjacent to open rear side 421. Cap door 413 has a hinge opening 423 on a rear side.

Figure 19:
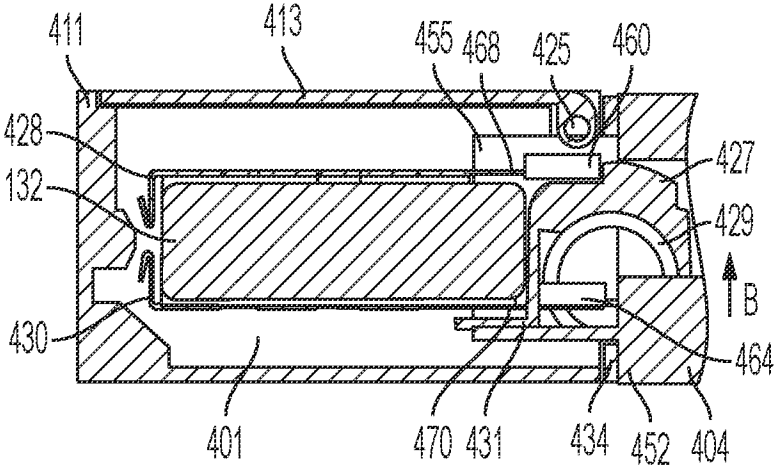
FIG. 19 is a partial enlarged, side, cross-sectional view of the inhaler device of FIG. 17 in the closed position.

Referring to FIG. 18, when assembled, similar to device 100 shown in FIG. 3, mouthpiece 402 connects to housing plate 420 so that housing plate 420 covers open end 403 of mouthpiece 402. Seal 418 is between mouthpiece 402 and housing plate 420 so that hole 440 of seal 418 overlaps hole 442 of housing plate 420. Inner tube 416 is adjacent to housing plate 420 so that a first opening of inner tube 416 overlaps hole 442 of housing plate 420 on a first side of housing plate 420 opposite a second side that is adjacent to seal 418. Electronic assembly 422 is positioned in housing 404. Housing 404 is positioned over inner tube 416 so that electronic assembly 422 is adjacent to inner tube 416 and housing 404 connects to housing plate 420 to cover open front end 450 of housing 404. Outer tube 426 is positioned over inner tube 416 and ejection mechanism 427 extends through rear end wall 452. Referring to FIG. 19, ejection mechanism 427 has a spring 429 and an L-shape member 431 that is biased in a direction B by spring 429. Consumable 132 fits/is positioned between first heater 428 and second heater 430. L-shape member 431 has a portion between consumable 132 and second heater 430. Connection portions 468 of first heater 428 are each inserted in one of two terminals 460 in ejection mechanism 427, and connection portions 470 of second heater 430 are each inserted into one of two terminals 464 in ejection mechanism 427. Cap body 411 removably connects to connector 455 of housing 404 by friction or snap fit having cap seal 434 between cap body 411 and housing 404. A pin 425 is inserted through hinge opening 423 (FIG. 18) of cap door 413 and hinge opening 419 (FIG. 18) of cap body 411 to form a hinge connection between cap door 413 and cap body 411.

Figure 20:
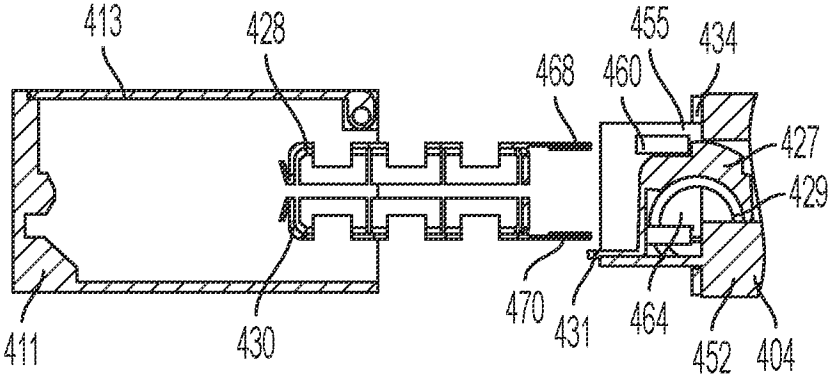
FIG. 20 is a partial enlarged, side, cross-sectional view of the inhaler device of FIG. 17 with an end cap disconnected.

Referring to FIGS. 19 and 20, a user can connect cap 410 (FIG. 17) to housing 404 in a closed position as shown in FIG. 19 and cap 410 can be disconnected from housing 404 as shown in FIG. 20. When cap 410 is connected to housing 404, device 400 can be activated by the user pressing or holding button cover 414 (FIG. 17) so that a power source of electronic assembly 422 (FIG. 18) supplies power first to a control board of electronic assembly 422 to heat the consumable, namely, consumable 132. Electronic assembly 422 receives this input from the user indicating that heat is needed. The control board directs an appropriate amount of current/voltage through terminals on the board, through the wire connecting the board to one of terminals 460, through one of connection portions 468, through first heater 428, out the other of connection portions 468 and terminals 460, through a return wire of the first heater 428/connected inbound wire for second heater 430, through one of terminals 464, through one of connection portions 470, through second heater 430, out the other of connection portions 470 and terminals 464 of the second heater 430, through the return wire of second heater 430 and back to the control board. The "appropriate amount of current/voltage" is tuned to the total unraveled length and cross-sectional area of the heaters so that the resistance of this path generates the desired amount of thermal energy directly into the consumable. The power passes through the circuit along the electrical connection to first heater 428 and second heater 430 that heat consumable 132 creating an inhalable aerosol between cap 410, ejection mechanism 427, cap seal 434 and rear end wall 452 that are sealed together in the closed position to form cavity 401. Thus, referring back to FIG. 18, when the user places their lips on mouthpiece 402 and inhales to create a negative pressure through holes 406 (FIG. 17), the inhalable aerosol flows through the open rear side 421, through opening 453, through inner tube 416, through hole 442, through hole 440, through holes 406 in mouthpiece 402 and into the mouth of the user. Device 400 can be deactivated by again pressing button cover 414 (FIG. 17) so that the power source of electronic assembly 422 discontinues supplying current/voltage to first heater 428 and second heater 430 of device 400.

As shown in FIG. 20, the user can disconnect cap 410 (FIG. 17) to replace first heater 428 and second heater 430. The user pulls first heater 428 axially, away from housing 404. The user disposes of old first heater 428. The user then aligns connection portions 468 of a new first heater 428 with terminals 460 and pushes heater axially, towards housing 404 connecting first heater 428 to terminals 460. Similarly, the user pulls second heater 430 axially, away from housing 404. The user disposes of old second heater 430. The user then aligns connection portions 470 of a new second heater 430 with terminals 464 and pushes heater axially, towards housing 404 connecting second heater 430 to terminals 464.

Figure 21:
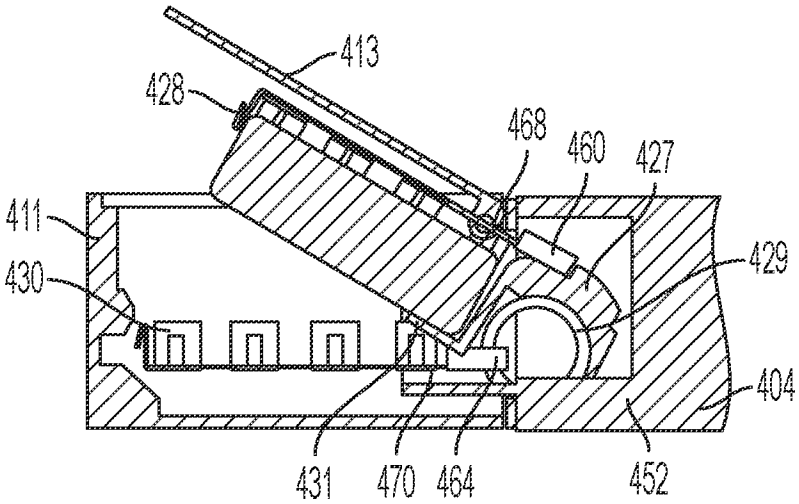
FIG. 21 is a partial enlarged, side, cross-sectional view of the inhaler device of FIG. 17 with a door of the end cap in an opened position.

Referring to FIGS. 19 and 21, a user can move device 400 between the closed position as shown in FIG. 19 and an opened position as shown in FIG. 21 to insert consumable 132. Device 400 provides for ejection of the consumable by the user pressing button cover 414 (FIG. 17) two or more times, preferably three times, in rapid succession, so that the circuit board of electronic assembly 422 (FIG. 18) translates that to open cap door 413 and allows consumable 132 to eject. This is one possible way to eject the consumable. It is noted that this is not the only way and methods used in other products, for example, devices 100, 200, 300, could be used with device 400. This process can also be adapted to fit all other embodiments of this disclosure. Movement of cap door 413 releases a latch compressing spring 429. L-shaped member 431 of ejection mechanism 427 connected to terminals 460 spins simultaneously with terminals 460 and first heater 428 when cap door 413 is moved to the opened position. L-shaped member 431 pushes the consumable, namely, consumable 132, out of cap body 411. Consumable 132 may be fully or partially ejected. Alternatively, device 400 may have a multi-action lockout trigger device including mechanical, electrical, or some combination of those to prevent accidental ejection of consumable. The user then replaces the consumable with a new consumable 132 by sliding the new consumable 132 between L-shaped member 431 and first heater 428. The user then pushes down on cap door 413 to latch spring 429 back into place in the closed position as shown in FIG. 19.

Accordingly, device 400 is a heating device with cavity 401 at the end of the main body of the device, where the heaters, first heater 428 and second heater 430, are exposed, while maintaining electrical connection to the device. First heater 428 and second heater 430 can be removed and replaced as needed to maintain the functionality of device 400. Cap 410 slides over the end of device 400 to complete cavity 401 and device 400. Device 400 has a consumable exposure type of a hinged door, namely, cap door 413, on top of cap 410 that is opened by spring 429.

Device 400 provides for burn prevention by having cap door 413 and ejection mechanism 427 that do not unlock until the cavity between cap 410 and housing 404 is sufficiently cool. Cap door 413 is held down via either a latch or a magnetic force and can only be opened from the outside when cooled and by user engagement that relies on force to open. In an alternate embodiment, device 400 has a multi-action lockout trigger device including mechanical, electrical, or some combination thereof, to prevent accidental opening of the lid.

Device 400 is shown having no visual display of status. Device 400 has a tone generating buzzer—much like the noise generation capabilities of a microwave oven—which pulses to indicate status via sound—rather than by sight. This buzzer is part of the electronic assembly 422. In contrast to device 100 that has an addressable status light on top of the device, the pulsing of the buzzer of device 400 communicates to the user things, such as but not limited to, "the device is hot", "battery is low", "the device is empty", "the device needs to be cleaned" by varying duration, pitch and pattern of sound. However, device 400 can be modified to include the addressable status light of device 100 or the haptics of device 200. Alternatively, device 400 can use cover lights, haptics, sounds, and any combination thereof to indicate different statuses.

Device 400 has one button cover 414, a tilt/vibration sensor, and an electronically locked ejector. Button cover 414 is on the side of device 400, and cap body 410 with hinged door 413 is slid over the end of housing 404 protecting the user from first heater 428 and second heater 430. The user presses button-cover 414 to heat consumable 132. In one embodiment, all electronic functions of device 400 can only be enabled by the proximity presence of a paired Bluetooth authenticator or wireless authenticator that are compatible with WIFI and marketed under the trademark, BLUETOOTH®—such as the user's cellular phone. This prevents aerosol generation by unauthorized users and is a safeguarding feature. Device 400 has a burn safeguarding feature that can override the signal of button cover 414 by the user if first heater 428 and second heater 430 are too hot to touch. The lock holding the spring in place is released, and hinged door 413 on cap body 411 is lifted by the motion of first heater 428 and ejection mechanism 427. Consumable 132 is exposed, and the user can tilt consumable 132 out of device 400. To close device 400, the user can push gently on hinged door 413 on cap body 411 until hinged door 413 engages an electronic torsion spring lock.

Device 400 ensures electrical connection by first heater 428 and second heater 430 plug into receptacles, namely, terminals 460 and 464, which are built into ejection mechanism 427. Device 400 has a maintenance mode when cap 410 is disconnected from housing 404 where first heater 428 and second heater 430 are accessible for replacement and the cavity between cap 410 and housing 404 can be cleaned.

Figure 22:
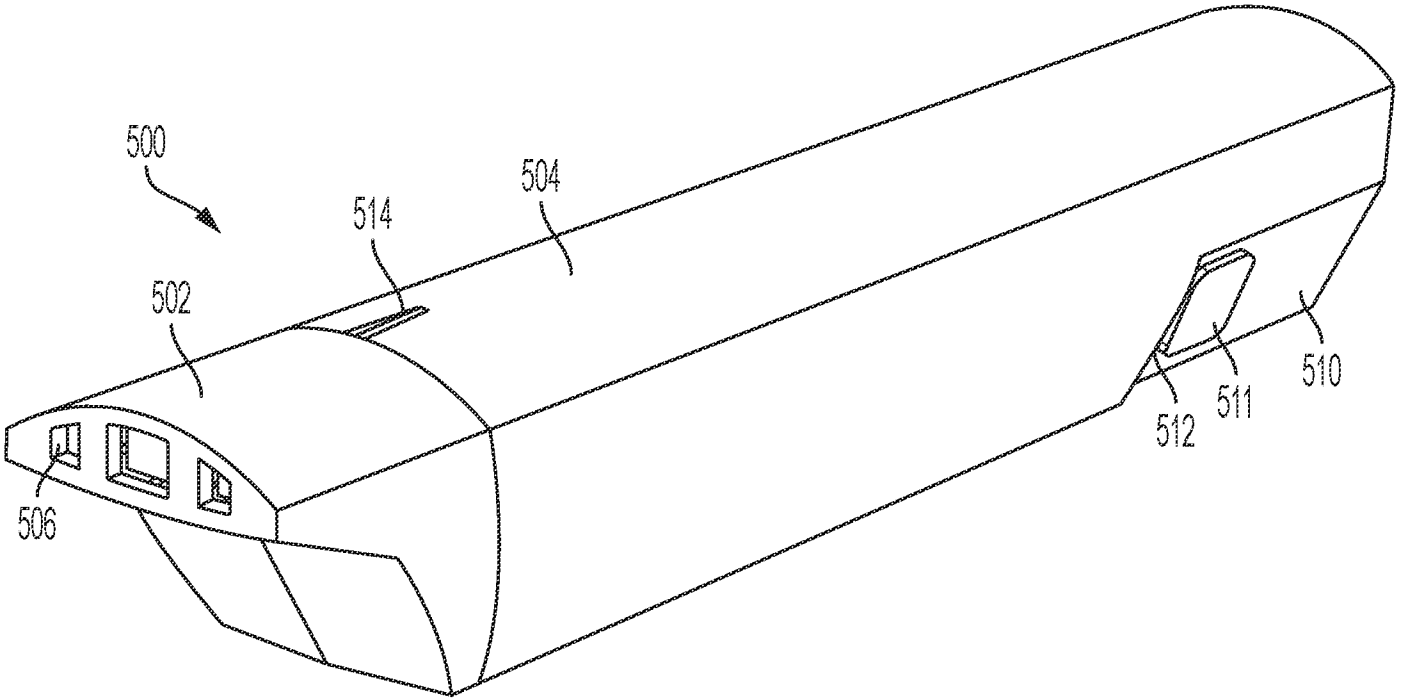
FIG. 22 is a front perspective view of a fifth embodiment of an inhaler device according to the present disclosure in a closed position.

Referring to FIG. 22, a heating, inhaler device 500 according to the fifth embodiment of the present disclosure is shown ("device 500"). Device 500 has similar advantages described above for device 100 with major changes in functionality occurring in the method of disruption of the heating cavity and exposure of the consumable 132. Device 500 has a mouthpiece 502 and a housing 504. Mouthpiece 502 has one or more, preferably more than two, openings 506. The user can inhale the aerosol generated in device 500 through openings 506. Housing 504 is connected to a drawer 510. Drawer 510 has an opening 512 that receives a button cover 511.

Figure 23:
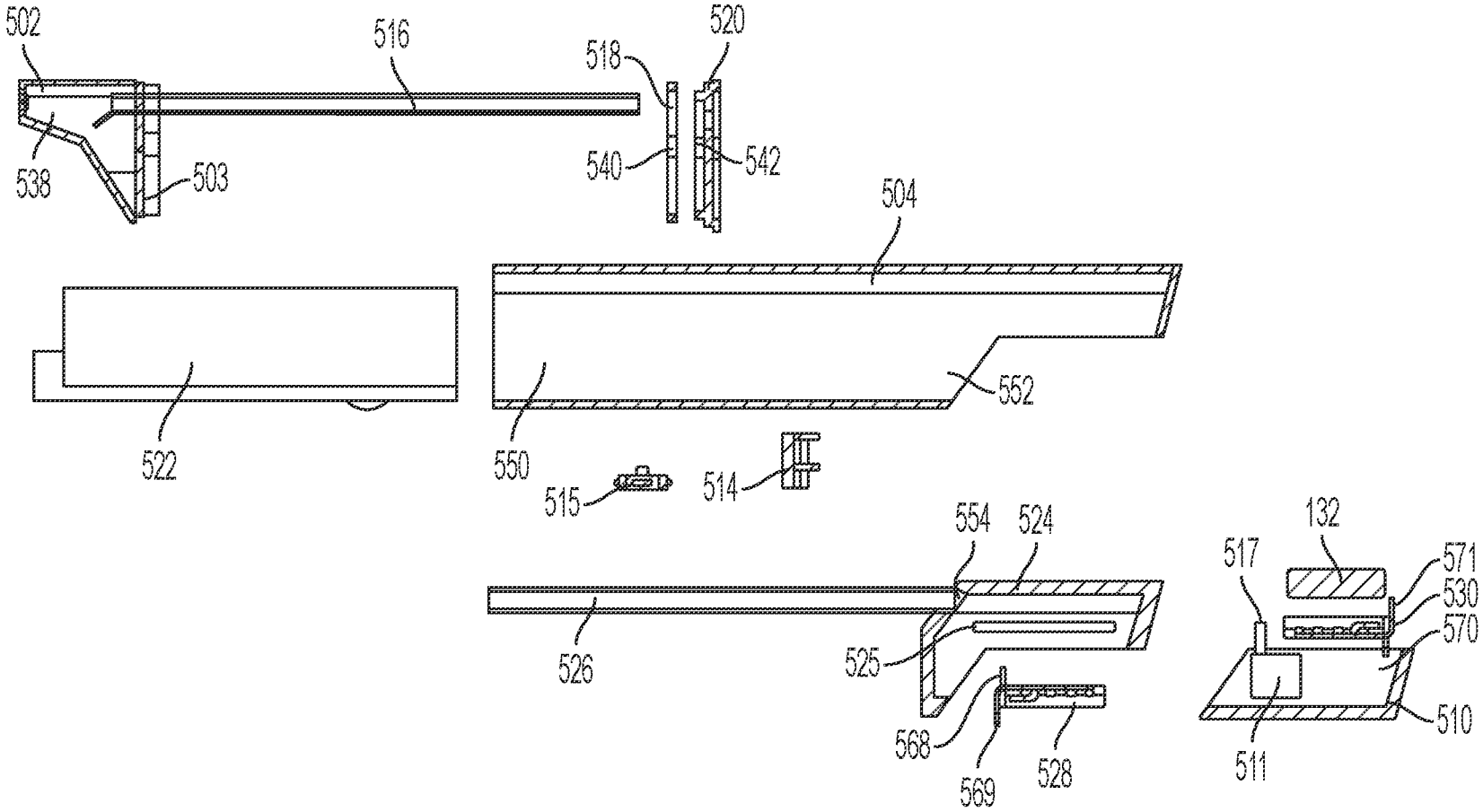
FIG. 23 is an exploded, side cross-sectional view of the inhaler device of FIG. 22.

Referring to FIG. 23, device 500 has besides mouthpiece 502 and housing 504, drawer 510, status indicator light 514, second button cover 515, an inner tube 516 connected in mouthpiece 502, a seal 518, a housing plate 520, an electronic assembly 522, an upper portion 524, an outer tube 526, a first heater 528, and a second heater 530, and consumable 132 for use in the device. Mouthpiece 502 has an interior cavity 538 so that openings 506 and cavity 538 are connected and an open end 503 is opposite openings 506 (FIG. 22). Seal 518 has a hole 540 through a continuous surface that surrounds hole 540. Housing plate 520 has a hole 542 through a continuous surface that surrounds hole 542. Electronic assembly 522 can have one or more of control boards, batteries, button covers, lights and motors, used for a control and power system. A control board can also be referred to as a controller board or a controller. Electronic assembly 522 can charge wirelessly and can have a charging port. Housing 504 has opening in a bottom portion of housing 504 that is covered by second button cover 515. Housing 504 has an open front end 550 and an open rear end 552. Upper portion 524 has an opening 554. Upper portion 524 is connected to outer tube 526 so that outer tube 526 overlaps opening 554. Upper portion 524 has interior groove 525. First heater 528 has two conductors 568 and consumable support 569, and second heater 530 has two conductors 570 and consumable support 571. First heater 528 and second heater 530 are preferably the same shape as first heater 128 and second heater 130 of device 100; however, first heater 528 and second heater 530 can be a different shape. In addition, first heater 528 can have the same shape or different shape as second heater 530. Drawer 510 is connected to buttons 511 on opposite sides of drawer 510. Each of buttons 511 is connected to a peg 517 that extends upward and outward and is sized to fit in grooves 525 on opposite sides of upper portion 524.

Referring to FIG. 23, when assembled, similar to device 100 shown in FIG. 3, mouthpiece 502 connects to housing plate 520 so that housing plate 520 covers open end 503 of mouthpiece 502. Seal 518 is between mouthpiece 502 and housing plate 520 so that hole 540 of seal 518 overlaps hole 542 of housing plate 520. Inner tube 516 is adjacent to housing plate 520 so that a first opening of inner tube 516 overlaps hole 542 on a first side of housing plate 520 opposite a second side that is adjacent to seal 518. Electronic assembly 522 is positioned in housing 504. Housing 504 is positioned over inner tube 516 so that electronic assembly 522 is adjacent to inner tube 516 and housing 504 connects to housing plate 520 to cover open front end 550. Outer tube 526 is positioned over inner tube 516 and upper portion 524 is connected in housing 504 covering open rear end 552. Upper portion 524 physically supports inner tube 516, outer tube 526, and all other moving parts of device 500 by the fit of upper portion 524 into housing 504. Buttons 511 that are each connected to opposite sides of drawer 510 are also each connected to grooves 525 on opposite sides of upper portion 524 so that peg 517 of each of buttons 511 fits in one of grooves 525 to be slidable therein and connecting drawer 510 to upper portion 524. Accordingly, device 500 has second button cover 515 on the bottom of housing 504, opposite the status light 514, and the remaining buttons 511 are on opposite sides of drawer 510. Conductors 568 of first heater 528 each plug into terminals located within upper portion 524. Conductors 570 of second heater 530 plugs into terminals located within drawer 510.

Figure 24:
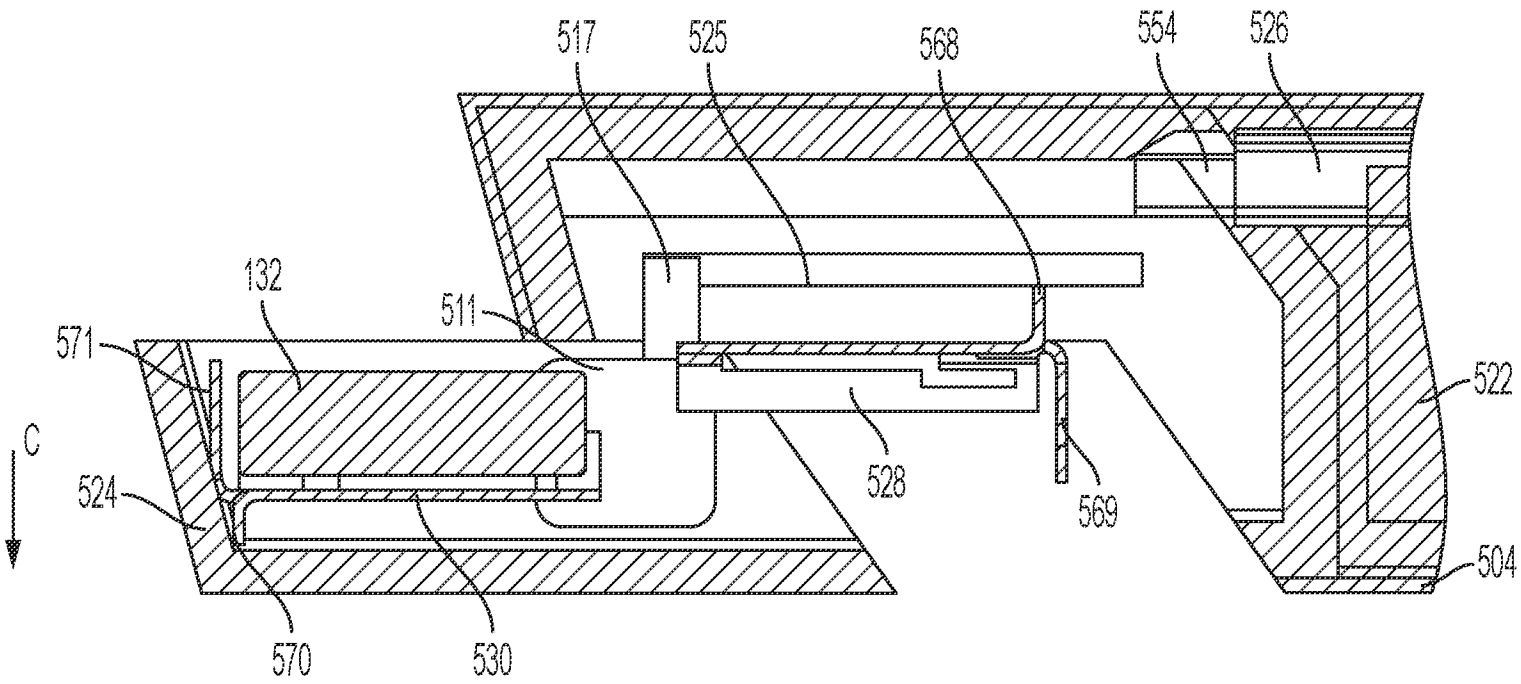
FIG. 24 is a partial enlarged, side, cross-sectional view of the inhaler device of FIG. 22 in an opened position.

Referring to FIGS. 23 and 24, each of pegs 517 slides in one of grooves 525 and connects drawer 510 to upper portion 524 so that drawer 510 is slidable between an opened position as shown in FIG. 24 and a closed position as shown in FIG. 22. Device 500 is activated by the user pressing and releasing or pressing and holding second button cover 515 so that a power source of electronic assembly 522 supplies power to a control board of electronic assembly 522. Second button cover 515 is the one that the user presses to heat the consumable 132. Electronic assembly 522 receives this input from the user indicating that heat is needed. The control board directs an appropriate amount of current/voltage through terminals on the board, through the wire connecting the board to one of the terminals of first heater 528, through one of conductors 568, through first heater 528, through another of conductors 568, back to the terminals of first heater 528, through a return wire of the first heater 528/connected inbound wire for second heater 530, through the terminals of second heater 530, through one of conductors 570, through second heater 530, through another of conductors 570, back to the terminals of second heater 530, through the return wire of second heater 530 and back to the control board. The "appropriate amount of current/voltage" is tuned to the total unraveled length and cross-sectional area of the heaters so that the resistance of this path generates the desired amount of thermal energy directly into the consumable. The power passes through the circuit along the electrical connection to conduct heat from first heater 528 and second heater 530 to heat consumable 132 that is between first heater 528 and second heater 530 to create an inhalable aerosol between upper portion 524 and drawer 510 that are sealed together in the close position. When the user places their lips on mouthpiece 502 and inhales to create a negative pressure through holes 506, the inhalable aerosol flows through opening 554 through upper portion 524 that overlaps outer tube 526, through inner tube 516, through hole 542, through hole 540, through holes 506 in mouthpiece 502 and into the mouth of the user. Device 500 can be deactivated by again pressing and releasing or only releasing second button cover 515 so that the power source discontinues supplying power to the heater of device 500.

In the opened position, consumable 132 can be removed and replaced, first heater 528 can be replaced, and second heater 530 can be replaced. To move device 500 from the closed position as shown in FIG. 22 to the opened position as shown in FIG. 24, drawer 510 is slid to the opened position where second heater 530 is disconnected from first heater 528 so electrical current cannot be conducted from first heater 528 to second heater 530. First heater 528 is maintained in upper portion 524. To move device 500 from the opened position as shown in FIG. 24 to the closed position as shown in FIG. 22, the user applies force to slide drawer 510 toward housing 504.

Accordingly, device 500 is a consumable product heating inhaler device with a self-contained cavity between drawer 510 and upper portion 524 at the end of housing 504 of device 500. Access to both the first heater 528 and second heater 530 and the consumable, namely, consumable 132, is provided by a permanently affixed, sliding drawer 510. Device 500 has a consumable exposure drawer 510 that simply slides axially away from housing 504.

Device provides for replacing first heater 528 and second heater 530 where the user triggers device 500 to the opened position and the user removes old consumable 132 if one is present. Referring back to FIG. 24, first heater 528 is pressed radially in direction C. First heater 528 slides off of a first spring electrical connection. The user disposes of first heater 528 and a new first heater 528 is slid onto the first spring electrical connection. The new first heater 528 is pressed radially in a direction opposite direction C. Second heater 530 is pressed radially in the direction opposite direction C. Second heater 530 slides off of a second spring electrical connection. The user disposes of second heater 530 and a new second heater 530 is slid onto the second spring electrical connection. The new second heater 530 is pressed radially in direction C.

Device 500 provides for ejection that is gravity assisted so that when drawer 510 is opened as shown in FIG. 24, consumable 132 drops out of device 500 by gravity. Thus, consumable 132 can exit one side and be replaced on the other side. The consumable could alternately exit and enter from the same location. Other options include, lifting out the consumable, tapping the device on a surface, and the like.

Device 500 provides for burn prevention of an electrical or mechanical lock on movement of drawer 510. Buttons 511 are part of the safeguarding feature of device 500. To unlock and slide drawer 510 to the opened position, both buttons 511 must be pushed and held at the same time while drawer 510 is manually pulled axially away from mouthpiece 502. Electronic assembly 522 also has an internal control that prevents drawer 510 from being moved if second button cover 515 is activated prior to the time when first heater 528 and second heater 530 are cool enough to touch. The exterior of device 500 insulates first heater 528 and second heater 530 from the user of device 500. This insulation can be air, insulating material such as glass fiber or other high heat resistant material, or any other insulating material.

Device 500 has an addressable status light on top of the device which communicates to the user things such as but not limited to, "the device is hot", "battery is low", "the device is empty", "the device needs to be cleaned" by blinking the light in different colors and/or patterns. However, device 500 can be modified to include the vibratory motor of device 200 or the buzzer of device 300 and 400. Alternatively, device 500 can use cover lights, haptics, sounds, and any combination thereof to indicate different statuses of device 300.

Figure 25:
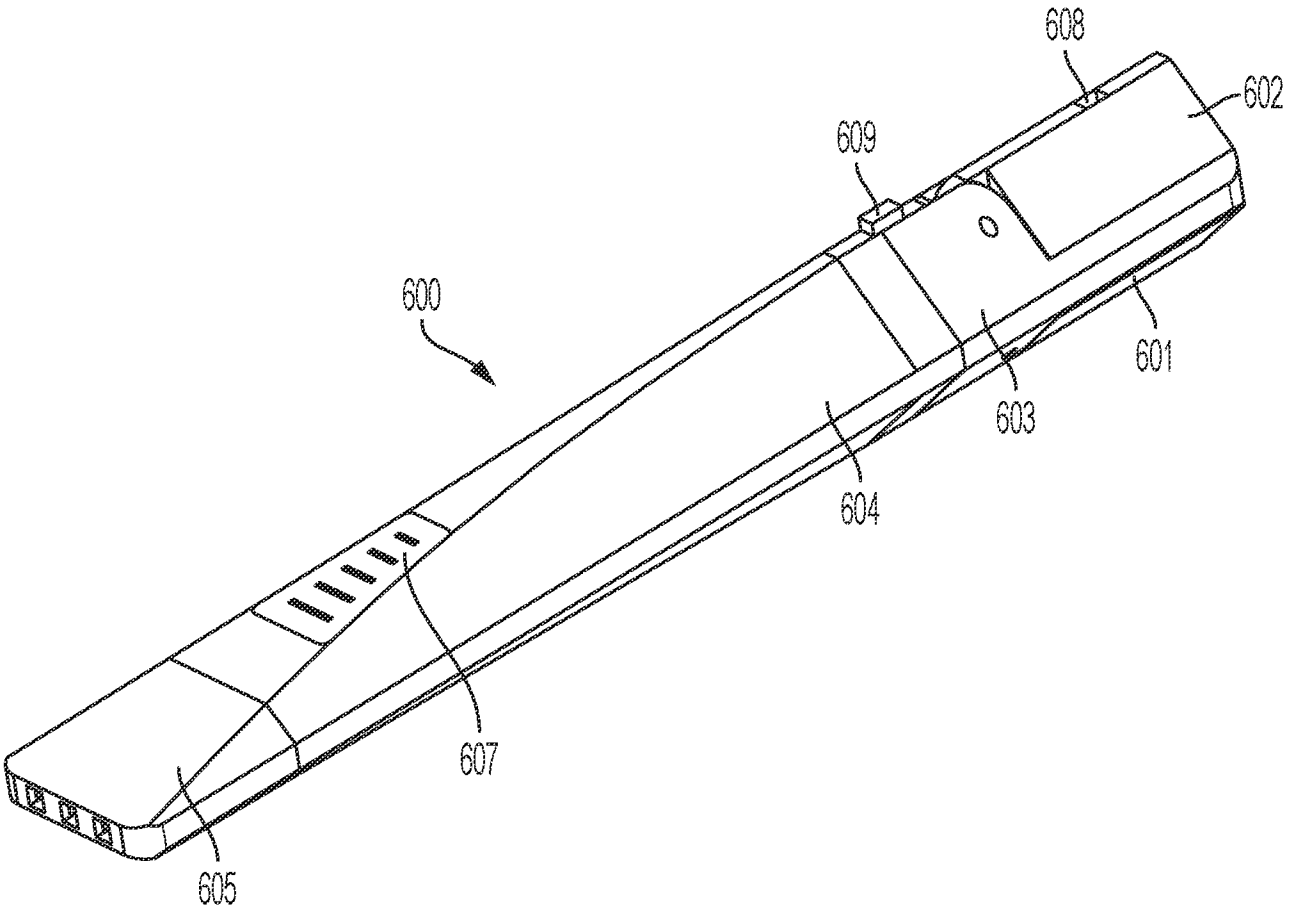
FIG. 25 is a top, perspective side view of a sixth embodiment of an inhaler device according to the present disclosure in a closed position.
Figure 26:
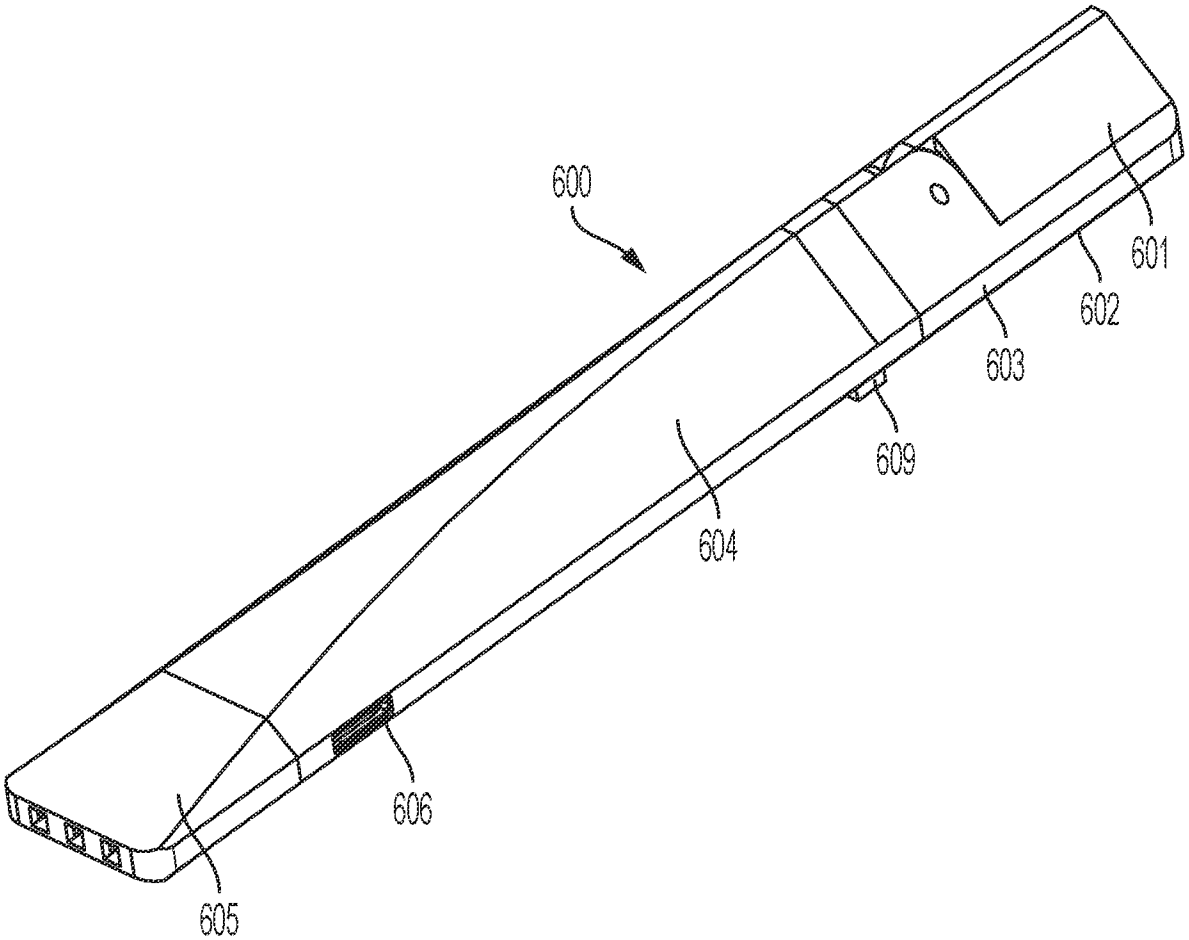
FIG. 26 is a bottom, perspective side view of the inhaler device of FIG. 25 in the closed position.
Figure 28:
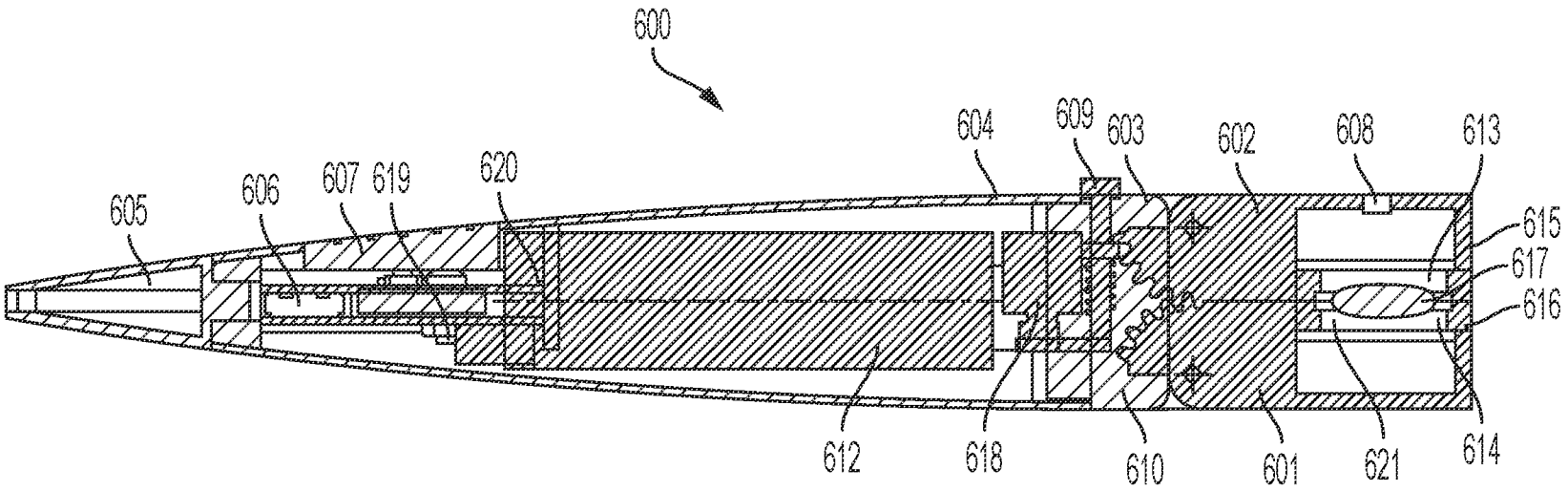
FIG. 28 is a side, cross-sectional view of the inhaler device of FIG. 25 in the closed position.
Figure 29:
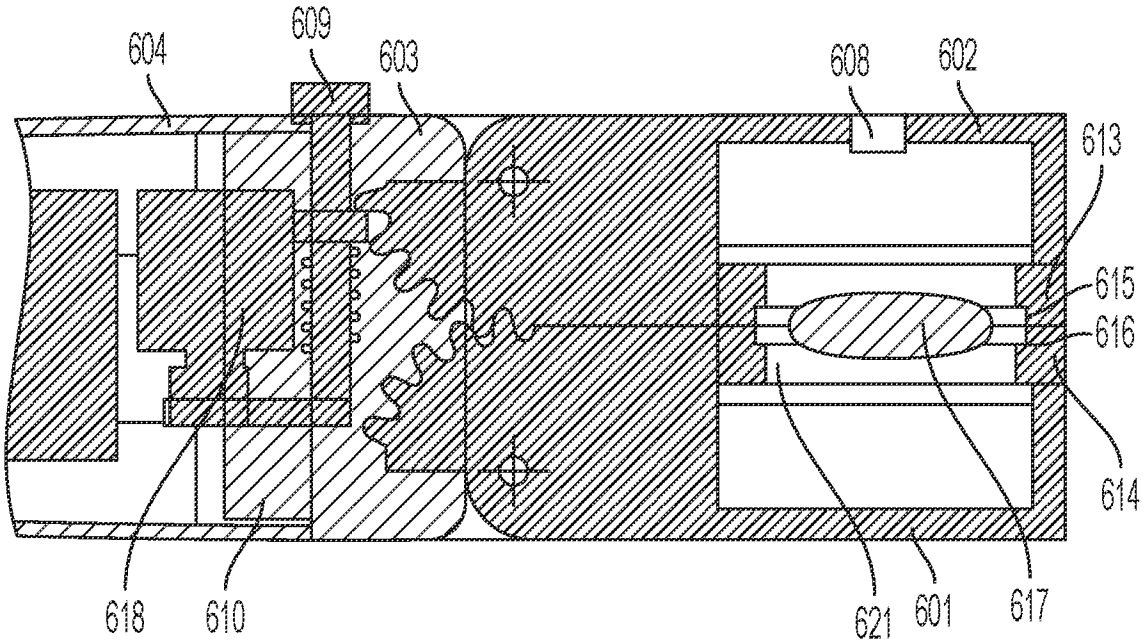
FIG. 29 is a partial enlarged, side, cross-sectional view of the inhaler device FIG. 25 in the closed position.

FIGS. 25 and 26 show a sixth embodiment of a heating inhaler device 600 according to the present disclosure ("device 600"). Device 600 has similar advantages described for the devices above. Device 600 heats a consumable, for example, consumable 617 (FIG. 28) that includes tobacco, to create inhalable aerosol. Advantageously, as directly compared to conventional devices that receive consumables with a built-in heater and/or plastics, device 600 is a more economically efficient and environmentally sensitive platform. Device 600 includes a self-contained cavity 621 that is an interior volume formed inside an upper door 602 and a lower door 601 of device 600 when they are in a closed position as shown in FIG. 28. Upper door 602 and lower door 601 form a barrier between the heating elements, first heater 615 and second heater 616 (which are inside cavity 621), and the external environment. The external environment is outside of upper door 602 and lower door 601 as shown in FIGS. 28 and 29.

Still referring to FIG. 28, device 600 has the heating elements, first heater 615 and second heater 616, specifically arranged to consistently and uniformly conduct and radiate heat across the surface area of the consumable. The surrounding of the consumable by the heating elements, first heater 615 and second heater 616, help maximize product yield and the resultant aerosol, with minimal energy. In the current embodiments, the heating elements, first heater 615 and second heater 616, are resistive, but the arrangement of heaters can be applied to other heating technologies. Cavity 621 between upper door 602 and lower door 601 as shown in FIG. 28 can repeatedly be disrupted, in other words opened, to receive consumables, then re-established, in other words closed, to process the consumables. Also, cavity 621 can be disrupted to allow for either manual, device assisted, or automatic ejection of the used consumable.

In some current products, the cavity and associated processing system is enclosed in a separate cartridge consumable, rather than the consumable being inserted into and heated by a portion of the device. In current products, the aerosol is generated in that separate cartridge and then transferred to the main body of the device. In contrast, the aerosol is generated by the heating elements in contact with the consumable placed at the end of device 600.

Additionally, device 600 provides safety measures throughout use including burn protection during operation, consumable replacement, and heater changing and/or cleaning. Device 600 also includes ways to make cleaning easier for the user of device 600, such as by ensuring user-friendly ways to remove and replace heaters that are worn out or dirty. This results in significantly lower consumable costs and reduced environmental impact. Such measures are unique to this device 600 as the heaters in some conventional devices are either undesirably concealed within or part of the consumable construction and intended to be thrown away at the end of each use, or they must be cleaned while in the device because they are permanently attached, which is not a desirable consumer maintenance requirement.

Referring to FIGS. 25 and 26, device 600 has a mouthpiece 605, a shell 604 and a housing 603. Mouthpiece 605 has one or more openings, preferably at least two or more. The user can inhale the aerosol generated in device 600 through openings in mouthpiece 605. In this embodiment, shell 604 is connected to housing 603. Housing 603 is connected to upper door 602 and lower door 601, which together define cavity 621. Shell 604 has an activation button 607. Button 607 turns the device on and off and displays the amount of battery life for the device via a set of one or more lights. Housing 603 also has a lock 609 for opening the doors 601 and 602. Additionally, lock 609 can be disabled if device 600 is hot or the device is open. Upper door 602 also has an air inlet 608 to draw outside air into device 600. Shell 604 has a charging port 606 for charging device 600.

Figure 27:
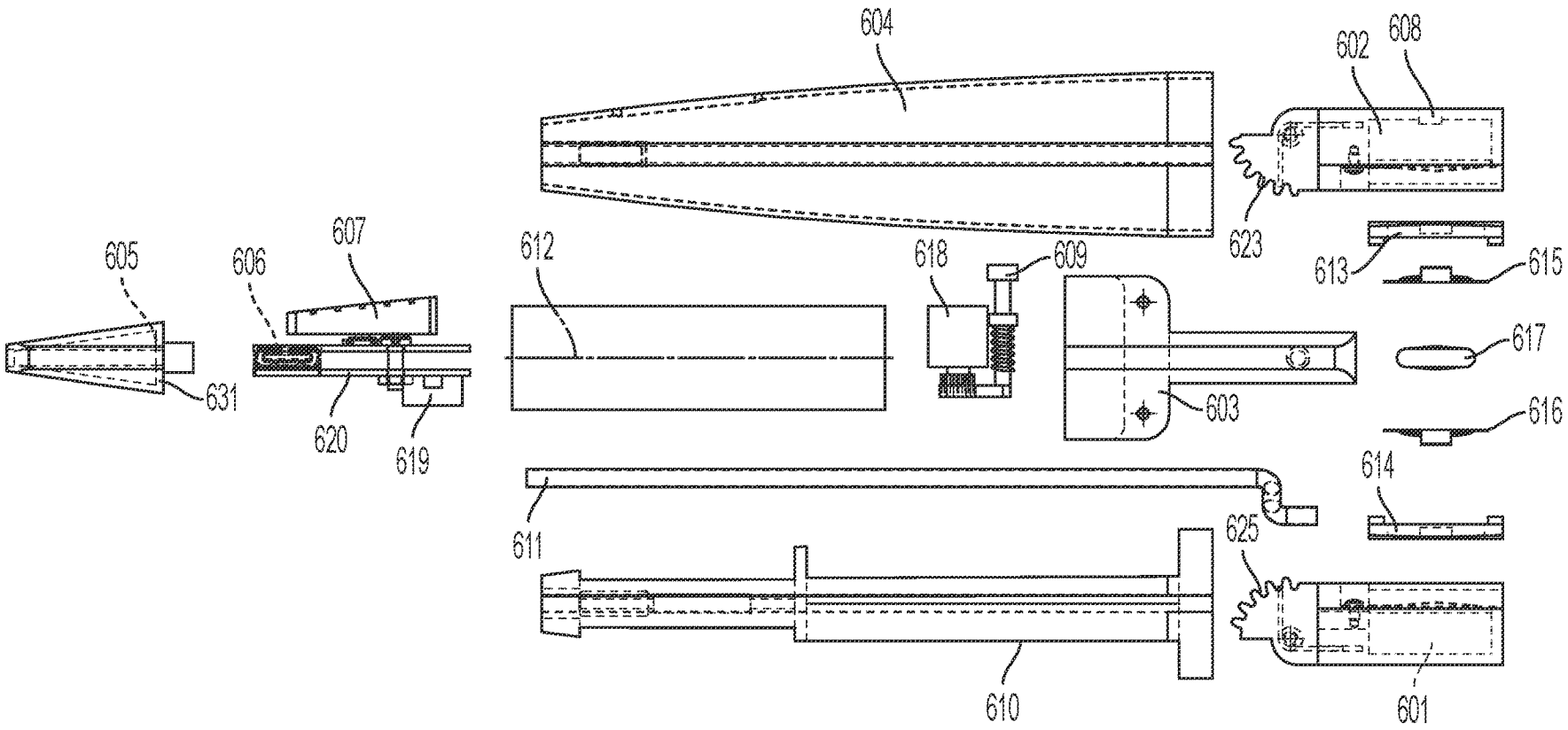
FIG. 27 is an exploded, side cross-sectional view of the inhaler device FIG. 25.

Referring to FIG. 27, device 600 has, as components operatively connected together, mouthpiece 605, shell 604, housing 603, lower door 601, upper door 602, activation button 607, an inner tube 611, a chassis 610, a charging port 606, a controller 620, a battery 612, a vibratory motor 619, an unlock button 609 with e-lock motor 618, first heater 615, second heater 616, heater trays 613 and 614, and consumable 617. Battery 612 and consumable 671 are not components of the structural device 600.

Mouthpiece 605 has an interior cavity 631 so that openings in the mouthpiece and the cavity within mouthpiece 605 are connected. The mouthpiece cavity 631 is connected to the aerosol generating cavity 621 by straw 611. In this and other embodiments of the present disclosure, the electronic assembly can have one or more conventional components, such as control boards 620, batteries 612, button(s) 607, lights, and motors 619, that are used for a control and power system. A control board can also be referred to as controller board or a controller. Electronic assembly is shown with a charging port 606, but charging can take place wirelessly. Batteries 612 can be charged by connecting a wire or cord to batteries 612 through charging port 606 that connects batteries 612 to a power source, for example, an electrical outlet. Alternatively, batteries 612 can be replaceable or charged wirelessly.

Figure 32:
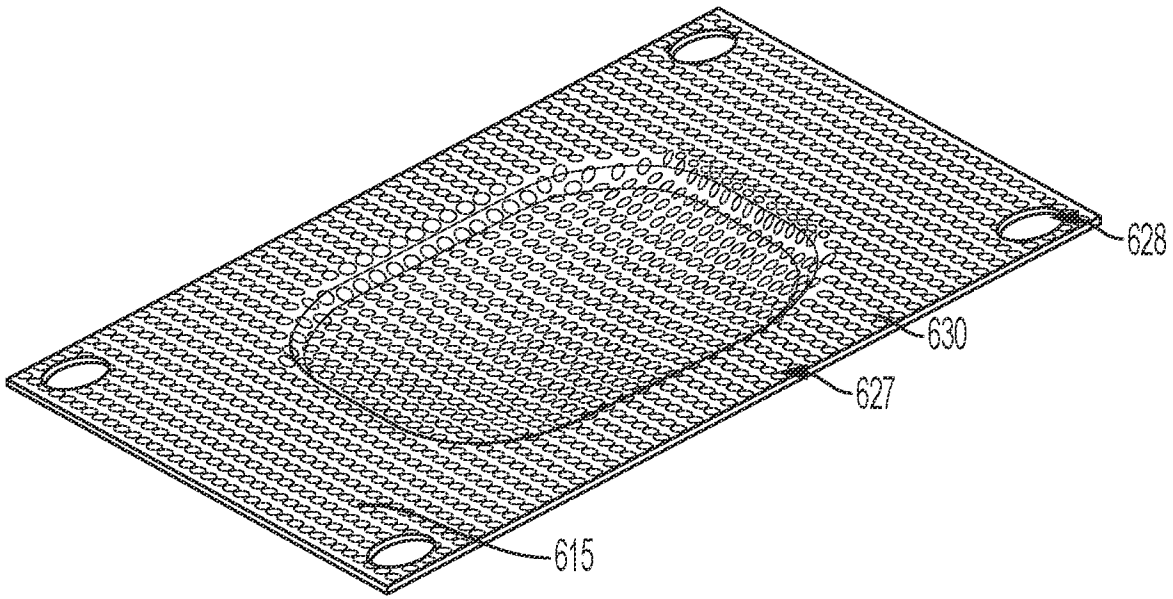
FIG. 32 is a front perspective view of a heating element that is concave.
Figure 33:
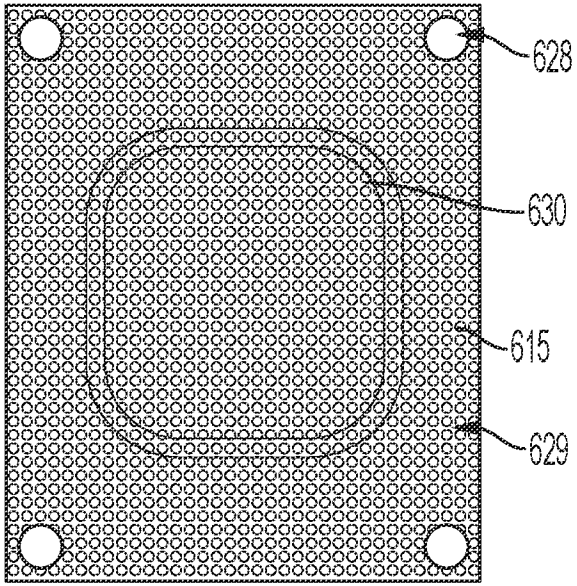
FIG. 33 is a front orthogonal projection view of the heating element of FIG. 32.

Referring to FIGS. 32-33 first heater 615 and second heater 616 are preferably the same shape. In addition, first heater 615 can have the same shape or different shape as second heater 616. Heaters can also take the form or heaters 4300, 6400, 6500, 6600, 6701, 6715, 6750 shown in FIGS. 45-51). First heater 615 and second heater 616 preferably are outer concave in shape which together match the convex shape of the consumable, for example, first heater 615 and second heater 616 are each a heater 6750 that surround a consumable 6751, as shown in FIG. 52. Heaters can also be other shapes.

Referring to FIG. 32, first heater 615 is a mesh material 627 that is shaped to form a concave portion 630 that is surrounded by a flat portion 629. First heater 615 has four holes 628 through mesh material 627. Four holes 628 can removably connect first heater 615 to heater tray 613 to connect to device 600 so that first heater 615 is heated during use of device 600 and can be selectively removed and replaced. First heater 615 can be removed from heater tray 613 to remove first heater 615 from device 600 to replace first heater 615, or, alternatively, heater tray 613 that is connected to first heater 615 can be removable from device 600 to remove both first heater 615 and heater tray 613 from device 600 to replace first heater 615. Second heater 616 can be the same as first heater 615 so that second heater 616 is mesh material 627 that is shaped to form concave portion 630 that is surrounded by flat portion 629 and has four holes 628 through mesh material 627. Four holes 628 can removably connect second heater 616 to heater tray 614 to connect to device 600 so that second heater 616 is heated during use of device 600 and can be selectively removed and replaced. Second heater 616 can be removed from heater tray 614 to remove second heater 616 from device 600 to replace second heater 616, or, alternatively, heater tray 614 that is connected to second heater 616 can be removable from device 600 to remove both second heater 616 and heater tray 614 from device 600 to replace second heater 616. Concave portion 630 can be defined as multiple bends instead of rounding, since rounded stainless has a tendency to revert back to its original shape from memory whereas bends do not. Another alternative is that first heater 615 and second heater 616 could also be snap heaters or heaters without heater trays 613, 614.

Figure 49:
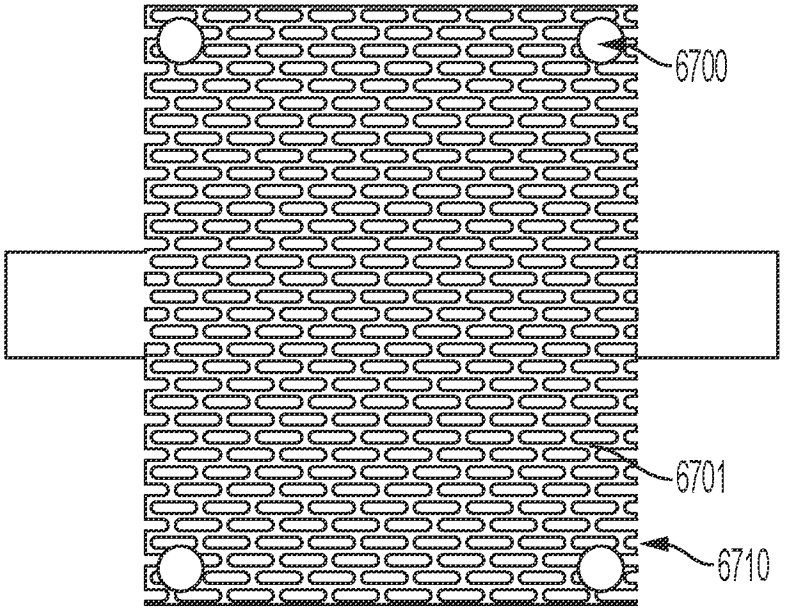
FIG. 49 is a top view of a heating element that has still another modified shape.
Figure 50:
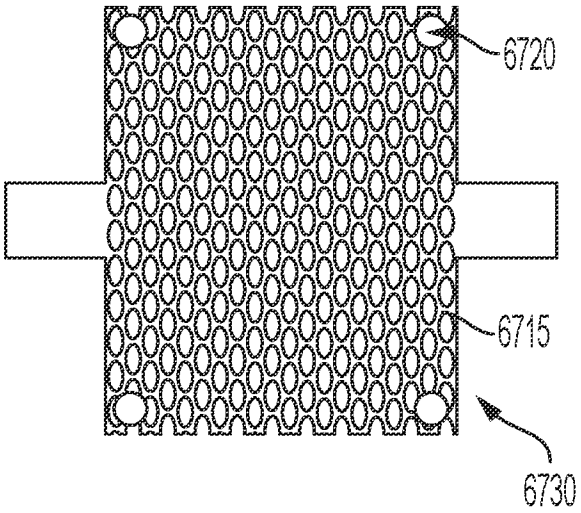
FIG. 50 is a top view of a heating element that has still another modified shape.
Figure 51:
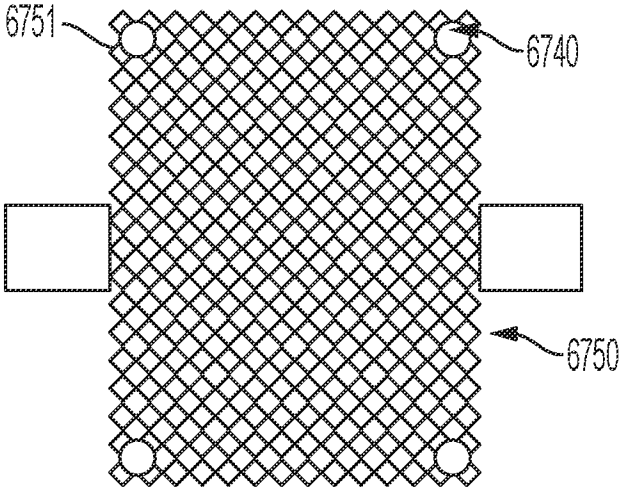
FIG. 51 is a top view of a heating element that has still another modified shape.
Figure 52:
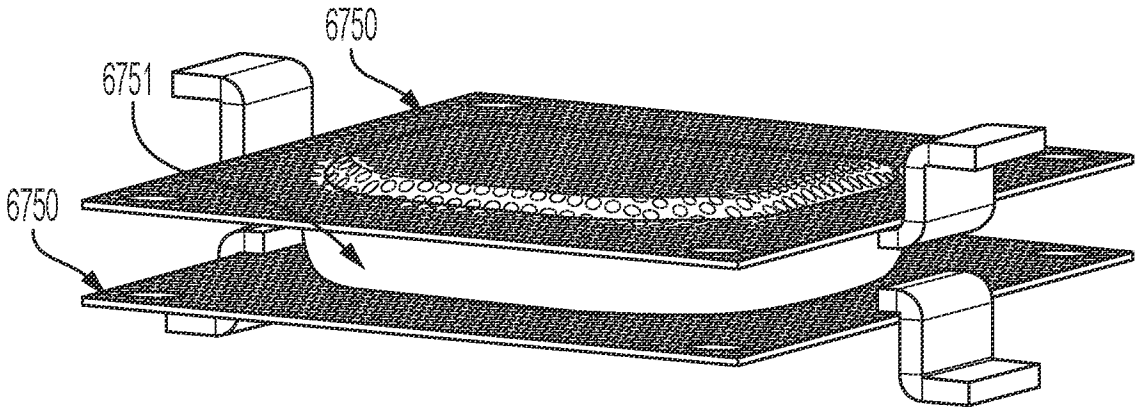
FIG. 52 is a perspective view of heating elements of FIG. 32 and the consumable of FIG. 40

Referring to FIGS. 49-51, first heater 615 and second heater 616 can alternatively, each be a heater that includes different types of mesh, for example, heaters 6701, 6715, 6750. Referring to FIG. 49, heater 6701 has mesh 6710 that has heater mounting holes 6700 on a first side and heater mounting holes 6710 on a second opposite side. Heater mounting holes 6700, 6710 can connect heater 6701 to heater tray 613 or heater tray 614 to connect to device 600 so that heater 6701 is heated during use of device 600 and can be selectively removed and replaced. Heater 6701 can be removed from heater trays 613, 614 to remove heater 6701 from device 600 to replace heater 6701, or, alternatively, one of heater trays 613, 614 that is connected to heater 6701 can be removable from device 600 to remove both heater 6701 and one of heater trays 613, 614 from device 600 to replace heater 6701. Referring to FIG. 50, heater 6715 has mesh 6730 that has heater mounting holes 6720. Heater mounting holes 6720 can connect heater 6715 to heater tray 613 or heater tray 614 to connect to device 600 so that heater 6715 is heated during use of device 600 and can be selectively removed and replaced. Heater 6715 can be removed from heater trays 613, 614 to remove heater 6715 from device 600 to replace heater 6715, or, alternatively, one of heater trays 613, 614 that is connected to heater 6715 can be removable from device 600 to remove both heater 6715 and one of heater trays 613, 614 from device 600 to replace heater 6715. Referring to FIG. 51, heater 6750 has mesh 6751 that has heater mounting holes 6740. Heater mounting holes 6740 can connect heater 6750 to heater tray 613 or heater tray 614 to connect to device 600 so that heater 6750 is heated during use of device 600 and can be selectively removed and replaced. Heater 6750 can be removed from heater trays 613, 614 to remove heater 6750 from device 600 to replace heater 6750, or, alternatively, one of heater trays 613, 614 that is connected to heater 6750 can be removable from device 600 to remove both heater 6750 and one of heater trays 613, 614 from device 600 to replace heater 6750. Each of heaters 6701, 6715, 6750 can include the concave portion 630 of heater 615 shown in FIG. 32. Another alternative is that first heater 615 and second heater 616 could also be snap heaters or heaters without heater trays 613, 614.

Referring to FIGS. 27 and 28, when assembled, mouthpiece 605 connects to shell 604 and chassis 610 that is positioned in shell 602. Preferably, charging port 606, battery 612, controller 620, straw 611, and vibratory motor 619 are contained between the shell 604 and the chassis 610. Straw 611 connects cavity 621 where aerosol is generated to mouthpiece 605 where aerosol is delivered to the consumer. Activation button 607 is positioned in shell 604 to extend through an opening in shell 604. Shell 604 is connected to housing 603. Unlock button 609 with e-lock motor 618 is positioned between shell 604 and housing 603 so that unlock button 609 is outside of shell 604 and housing 603 and e-lock motor 618 is positioned in an interior volume formed by shell 604 and housing 603. Upper door 602 and lower door 601 are rotatably connected to housing 603. Upper door 602 has a gear portion 623 that engages a gear portion 625 of lower door 601 when upper door 602 and lower door 601 are rotatably connected to housing 603. Heater tray 613 is connected to upper door 602 to support first heater 615. Heater tray 614 is connected to lower door 601 to support second heater 616. Consumable 617 can be inserted between first heater 615 and second heater 616 during use.

Figure 30:
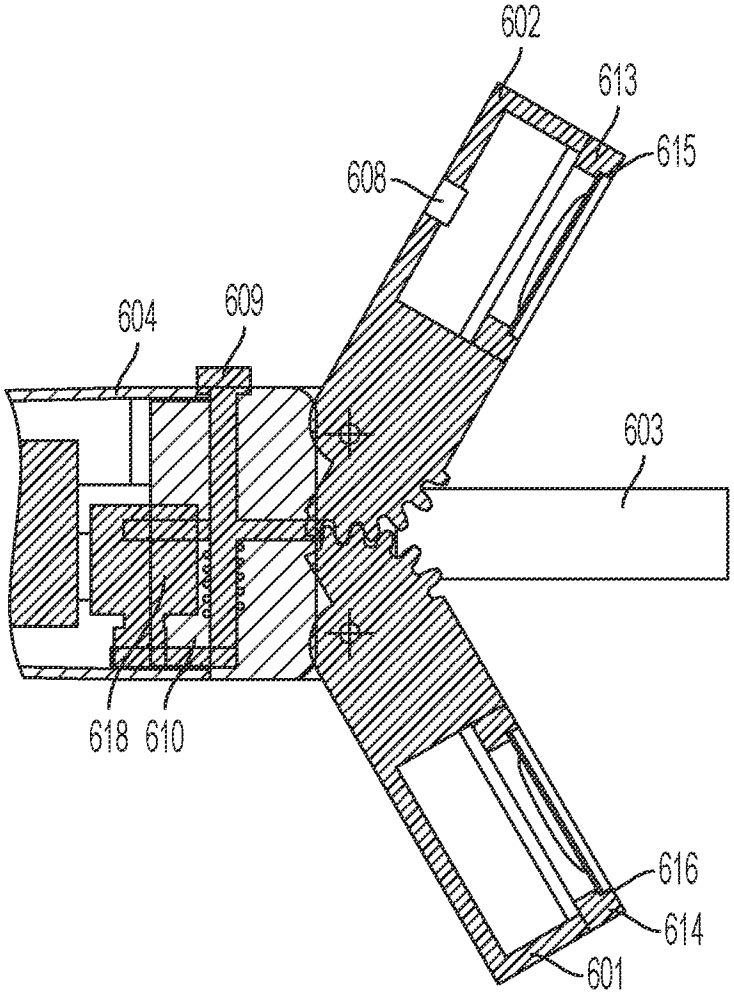
FIG. 30 is a partial enlarged, side, cross-sectional view of the inhaler device of FIG. 25 in an opened position.
Figure 31:
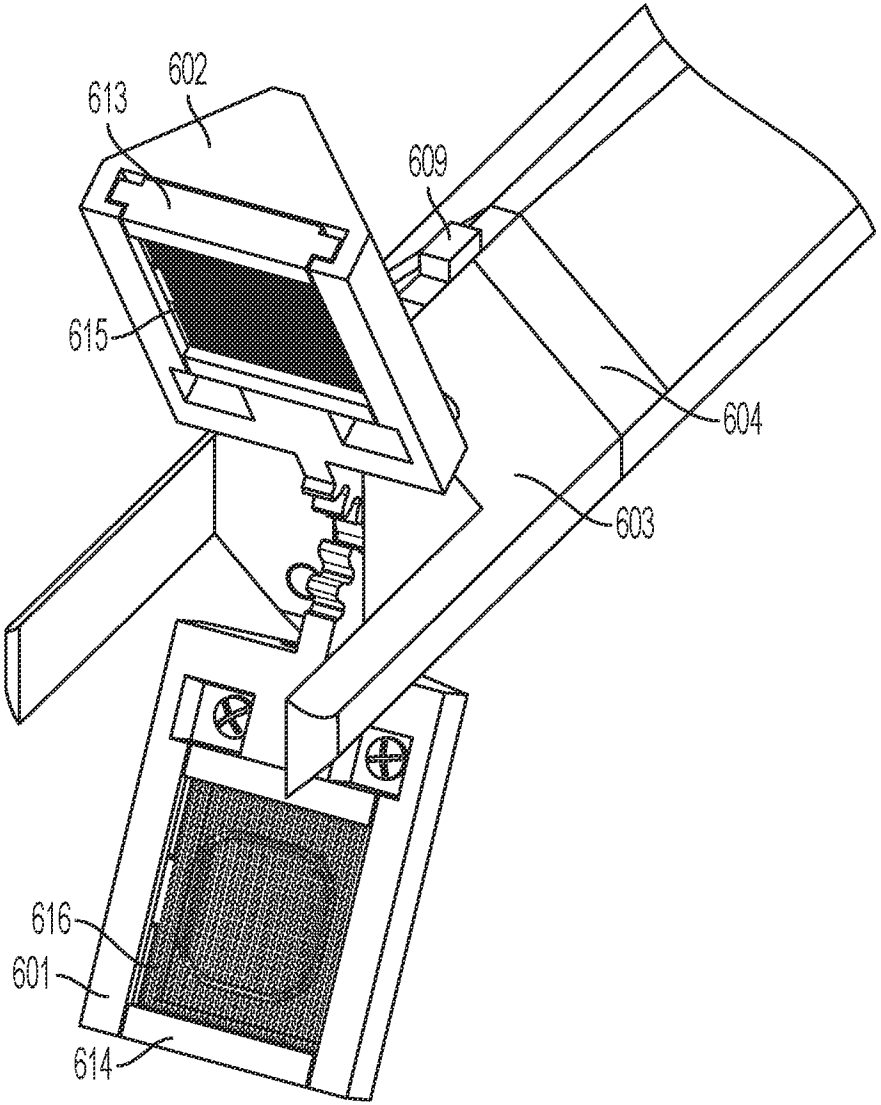
FIG. 31 is a back perspective view of the inhaler device of FIG. 25 in the opened position.
Figure 53:
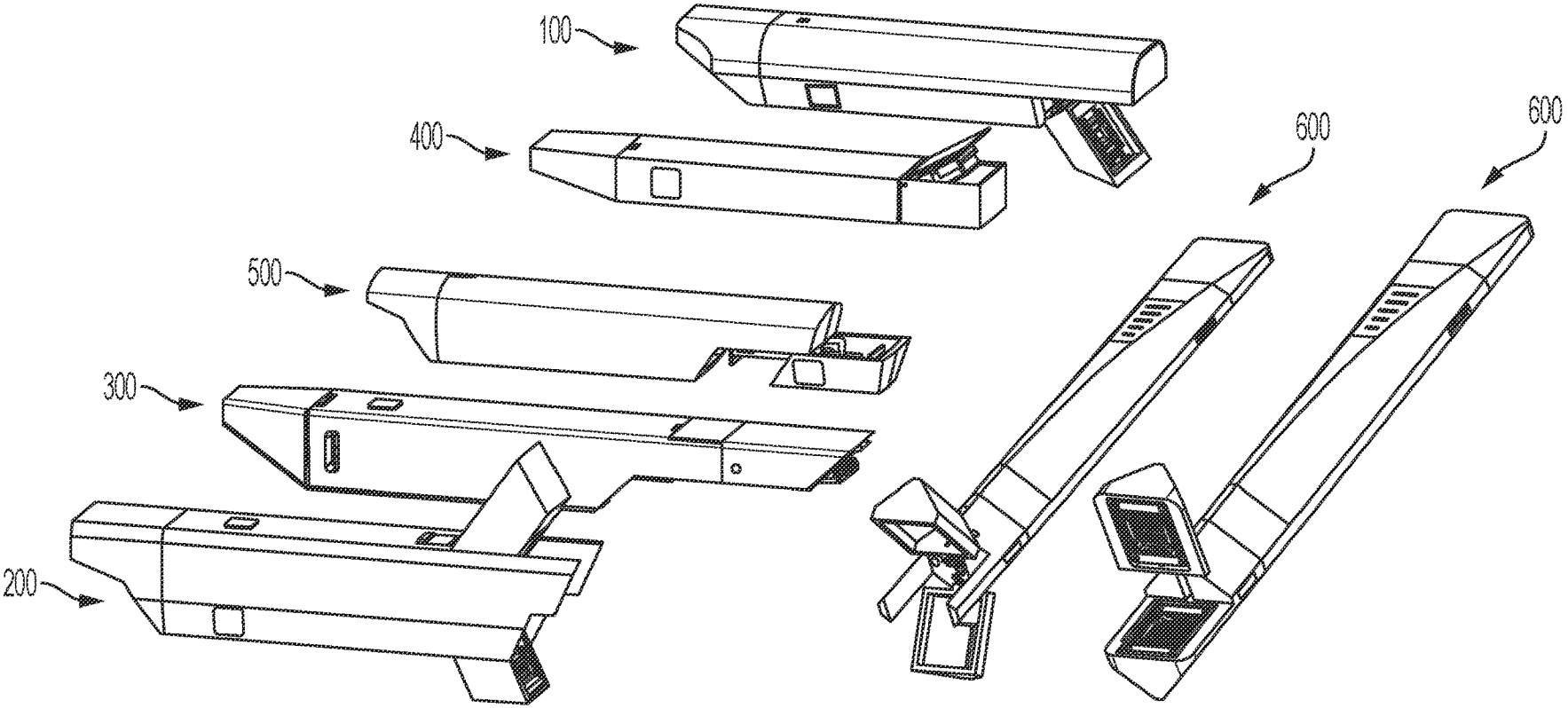
FIG. 53 is a perspective view of the inhaler devices FIGS. 1, 7, 12, 17, 22, and 25 in the opened position.

Referring to FIGS. 29-31, a user can move device 600 between a closed position as shown in FIG. 29 and an opened position as shown in FIGS. 30 and 31. In the opened position, consumable 617 can be removed and replaced, first heater 615 can be removed and replaced, and second heater 616 can be removed and replaced. Additionally, only upper door 602 can open while lower door 601 stays stationary as shown in FIG. 53. This added stability allows the consumable 617 to be more easily removed and replaced. Heaters 615 and 616 can also be removed and replaced with only upper door 602 open. Alternatively, device 600 could be designed to open only lower door 601.

Referring back to FIG. 28, in the closed position, device 600 can be activated by the user pressing and holding button 607. It is also possible that button 607 could be pressed and released, or pressed multiple times, to activate device 600. Device 600 could be turned on for a designated period of time once activated. Button 607 cannot be activated when device 600 is open. When device 600 is activated or turned on, power is sourced from the electronic assembly including battery 612 and controller 620. The "appropriate amount of current/voltage" is tuned to the total area of the heaters so that the resistance of this path generates the desired amount of thermal energy directly into the consumable. The power passes to first heater 615 and to second heater 616 and each conducts heat to consumable 617 to create an inhalable aerosol between upper door 602 and lower door 601 that are sealed together in the closed position. Thus, when the user places their lips on mouthpiece 605 and inhales to create a negative pressure through holes in the mouthpiece, air flows into opening 608 and across the consumable 617 creating an inhalable aerosol. The inhalable aerosol flows from cavity 621 through straw 611 and into mouthpiece 605, through holes in mouthpiece 605 and into the mouth of the user. Device 600 can be deactivated by again pressing button cover 607 or by releasing button 607 so that the power source of electronic assembly discontinues supplying current/voltage to first heater 615 and second heater 616 of device 600.

Accordingly, device 600 is a heating inhaler device with self-contained cavity 621 defined by upper door 602 and lower door 601 of housing 603 of device 600.

Referring to FIG. 30, device 600 has upper door 602 that is an upper "jaw" and lower door 601 that open away from each other, exposing the top of the consumable, namely, consumable 617. Thus, access to both first heater 615 and second heater 616 and the consumable, namely, consumable 617, is provided by opening the lower door 601 and the upper door 602. Accordingly, device 600 allows for replacing first heater 615 and second heater 616 by opening device 600, namely, moving lower door 601 and upper door 602 away from each other; sliding first heater 615 and heater tray 613 away from upper door 602 and sliding second heater 616 and heater tray 614 away from lower door 601 until they are disconnected. Thus, each used heater can be removed. Further, those heaters can be replaced, namely by inserting a new heater and heater support that is the same as first heater 615 and heater tray 613 into upper door 602 and inserting a new heater and heater support that is the same as second heater 616 and heater tray 614 into lower door 601 until the electrical connection is established. Additionally, heaters could be held in place by snaps, magnets, or other methods mentioned elsewhere herein. Device 600 can have both upper door 602 and lower door 601 open as shown in FIG. 30, or it could only have the top portion 602 open or only the bottom portion 601 open. This allows for easy access to remove and replace consumable 617

Device 600 also provides burn prevention. Burn prevention is achieved by lock 609 not unlocking until cavity 621 and/or heaters 615, 616 are sufficiently cool. This cooling is likely through a timeout of the controller. It could also be achieved through a temperature sensor. For example, the controller uses a timer to count to a predetermined value after deactivating device 600 so that, once first heater 615 and second heater 616 do not generate heat, lock 609 is unlocked and allowed to open upper door 602 and lower door 601.

The user-facing components, such as upper door 602 and lower door 601 of device 600, are made of a poor thermal and electrical conductor material preferably including a polymer. First heater 615 and second heater 616 are insulated from the exterior of device 600. This insulation can be air, insulating material such as glass fiber or other high heat resistant material, or any other insulating material. In addition, device 600 can have an addressable status light on top of device 600 which communicates to the user things like, "the device is hot", "battery is low", "the device is empty", "the device needs to be cleaned". This communication can be by a visual indicator, such as, for example, blinking the light in different colors and/or patterns. Alternatively, device 600 can use lights, haptics, or sounds, with any combination thereof to indicate different statuses of device 600.

Figure 34:
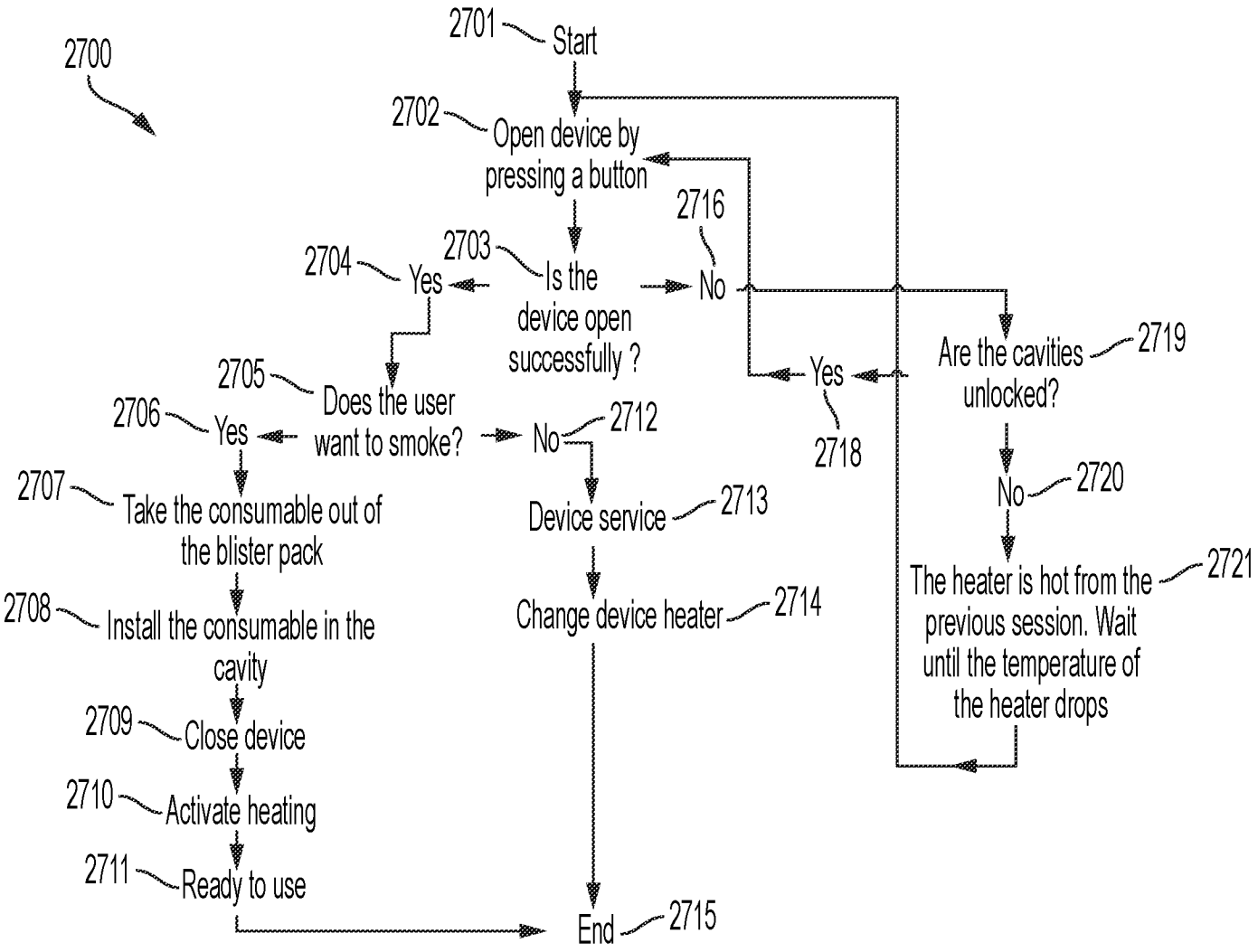
FIG. 34 is a safeguard method of the inhaler devices of the present disclosure.

Referring to FIG. 34, a method 2700 for using device 600 for burn prevention is shown. However, a similar logic structure can be employed and adjusted for each of devices 100, 200, 300, 400, and 500. In step 2701, method 2700 starts and proceeds to step 2702 where a user presses to unlock button 609 and method 2700 proceeds to step 2703. In step 2703, controller 620 determines if device 600 moves from the closed position to the open position. If controller 620 determines that device 600 did not move from the closed position to the open position, then method 2700 proceeds to step 2716 and step 2719.

In step 2719, controller 620 determines if upper door 602 and lower door 601 are unlocked. If upper door 602 and lower door 601 are unlocked, then method 2700 repeats step 2702. If upper door 602 and lower door 601 are not unlocked, then method 2700 proceeds to step 2720 and step 2721. In step 2721, controller 620 determines that heaters 615, 616 are hot from the previous session and controller 620 keeps upper door 602 and lower door 601 locked until heaters 615, 616 are cooled after time has passed and then method 2700 then repeats step 2702. In step 2703, if controller 620 determines that device 600 did move from the closed position to the open position, then method proceeds to step 2704 and step 2705. In step 2705, method 2700 proceeds to step 2706 if the user wants to smoke and then to step 2707. In step 2707, the user gets a consumable 617, for example, by removing consumable 617 from a blister pack, and method 2700 proceeds to step 2708 where the user inserts consumable 617 between upper door 602 and lower door 601. Method 2700 then moves to step 2709. In step 2709, the user closes device 600 and method 2700 moves to step 2710 where the user presses button 607 to activate heating, and method proceeds to step 2711. In step 2711, device 600 indicates to the user that device 600 can be used to inhale inhalable aerosol generated by device 600, then method 2700 proceeds to step 2715 to end method 2700. In step 2705, method 2700 proceeds to step 2712 if the user does not want to smoke and then to step 2713. In step 2713, the user determines device 600 needs service and proceeds to step 2714. In step 2714, the user changes heaters 615, 616 and method 2700 proceeds to step 2715 to end method 2700.

Figure 36:
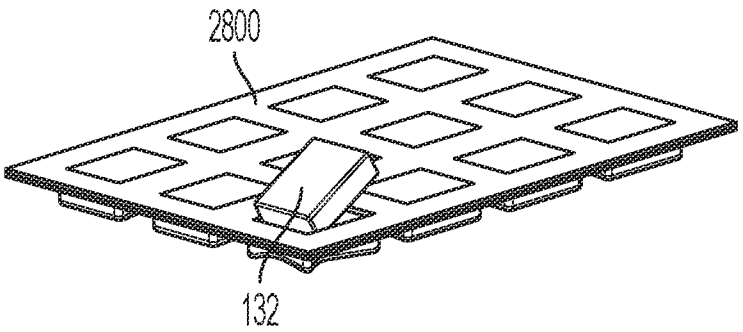
FIG. 36 is a front perspective view of the packaging of FIG. 35 that has one compartment that is opened.
Figure 35:
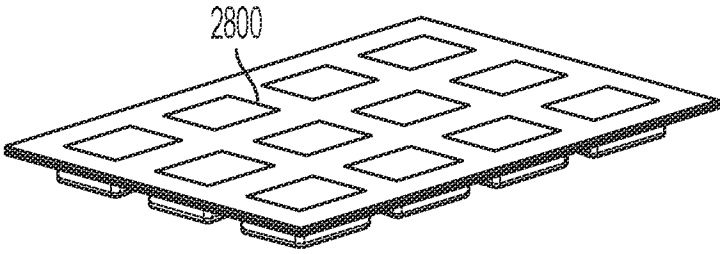
FIG. 35 is a front perspective view of a packaging for the consumable that is sealed.

Referring to FIGS. 35 and 36, one or more consumables 132 can be packaged in a blister package 2800. Consumable 132 can be a correlated heat activated consumable that has the following qualities: sized and shaped to be encompassed or mostly encompassed by first heater 128, 228, 328, 428, 528, 615 and second heater 130, 230, 330, 430, 530; 616, consumable could alternatively be a pouch, capsule, wafer, powder, granules, pellets, shreds, spaghettis, strips or sheets and treatments for manufacture can include, but are not limited to, cut, reconstituted, shredded, diced, extruded, or pelleted substances; made of tobacco, hemp, other cellulosic materials, including but not limited to wood fibers, beet fibers, microcrystalline cellulose, botanical, solids or semi-solids containing aerosolizing substances included, but not limited to, glycerin, propylene glycols, other glycols, or any mixture thereof; where the fibers are arranged or organized in any orientation in the consumable; flavors can also be incorporated into the consumable; where the body of the consumable could be encapsulated by a substance including, but not limited to, an internal or external binding agent, a shell of aerosolizing substance, a shell of binder, paper, foil, tobacco paper, tobacco sheet, pouching materials such as non-woven, a paper and foil laminate, or any substance that facilitates heat conduction as material could be heat conducting or could be such that it does not limit the transfer of heat; where the encapsulation may or may not be perforated; where the encapsulation method can provide the opportunity to mark the individual capsules for branding and/or control purposes via stamping, printing, burning, embossing, or any other method to impart the information; where one embodiment of the disclosure is that the individual capsules are packaged for distribution in such a way that maintains cleanliness, prevents tampering, and prevents moisture changes; and where one embodiment of consumable 132 creates signal or other data to be transmitted to and interpreted by the heating device for the purposes of limiting the use of unauthorized consumables. Moisture uptake can be minimized or eliminated prior to consumption due to blister packaging, for example, blister package 2800.

Devices 100, 200, 300, 400, 500, 600 are each a heating device that creates inhalable aerosol and that can operate with: (1) one or more heating elements; (2) a temporary or permanently established cavity formed by a barrier between the heating elements and the external environment that envelops the heating elements; (3) any method or mechanism allows the insertion and removal of consumables from the cavity; and (4) any method or mechanism that allows for the replacement manually, mechanically, and/or electrically of the heating elements in the device. Additionally, the product has control mechanisms that prevent the consumer from opening the device while the heater is hot and also prevents the heaters from turning on while the device is open. The device can also have a mechanism for age verifying the user. The product may or may not provide for puncturing the encasement around the consumable should there be an encasement. Separate removal and replacement of the heater and consumable minimizes environmental impact and lowers device and consumable costs. Separate removal and replacement of the heater also eliminates the need for cleaning heaters. Heating elements can be designed to consistently and uniformly conduct and radiate heat across the surface area of the consumable. Heaters and consumables can be made to match each other. Therefore, overheating risk from human and/or technological error is minimized. It also reduces chip and circuit board complexity and related cost of goods manufactured. Heating elements that surround the consumable maximize product yield and aerosol quality with minimal energy expenditure.

Device 100, 200, 300, 400, 500, 600 is an electrical heating inhaler that has one or more heating elements, for example, first heater 128, 228, 328, 428, 528, 615 and second heater 130, 230, 330, 430, 530, 616 that envelope and processes a solid consumable. The one or more heating elements can have a heat-up time of less than four seconds, and preferably, less than two seconds. Alternatively, one or more heating elements can have a heat-up time of more than four seconds. The device 100, 200, 300, 400, 500, 600 has one or more of the heating elements where configurations of the heating elements are available so that in the operating configurations they surround the consumable, either partially or fully; they create an electrically complete circuit that enables the heating elements to generate heat through electrical resistance, which then transfer heat energy to the consumable. The first and second heaters may have symbiotic identical (or mirrored) design configurations, shapes, and/or properties, or they may be different. In the open configuration, the heating elements allow for insertion and removal of consumables, and in some embodiments, allow for replacement of the heating elements. In the optional maintenance configuration of other embodiments, heating elements can be replaced. Each heating element can generate heat through a specified electrical resistance which is directly related to the material properties, cross-sectional areas, and path length of the element; attach temporarily or permanently, mechanically and/or electrically from the device by, but not limited to, traditional terminal connectors, binder posts, magnets, electrical spring contacts, soldering, JST connections, and the like; and assume a shape that conforms geometrically to the intended solid consumable either completely or partially.

There is a barrier between the external environment and the heating element while in one or more configurations. This barrier can be made of one or more materials including, but not limited to, wood, polymer, rubber, metal, glass, ceramics, composites, and/or air. This barrier, and the cavity that it defines formed by a barrier between the heating elements and the external environment, can be removed, displaced, or otherwise disrupted by the user as required during any or all of the configurations. This barrier, and the cavity that it defines, are partially or completely sealed from the external environment of the device, and the seal can be enhanced or reinforced through the inclusion of, but not limited to—the addition of compression seals, material overlap, O-rings and/or gaskets. At least one wall or a portion of the barrier is adjacent to the rest of the device. At least one wall or a portion of the barrier has a mechanism or allows for the output of aerosolized product out of the cavity and towards the user for inhalable consumption. At least one wall or a portion of the barrier has a mechanism or provides for the cavity to import a gaseous, inhalable substance including, but not limited to, ambient air, pure oxygen, and nitrous oxide.

A mechanism is provided for the user to activate or trigger the changes in configuration of the device 100, 200, 300, 400, 500, 600. Examples include, but are not limited to, electrical controls, mechanical controls, manual reconfiguration, automation, and/or voice controls. One or more power sources and related charging methods of device 100, 200, 300, 400, 500, 600 includes, but are not limited to electric, induction, magnets, springs, batteries, solenoids, piezoelectric, acoustic, wind, and solar to drive and/or assist one or more of the following functions that include, but not limited to, the changes in configuration of the device, the processing of the consumable, the ejection or removal of the consumable, the display of the status of the device, the transfer of aerosolized substance from the cavity, and the draw of a gaseous, inhalable substance into the cavity.

One or more control systems or controllers of device 100, 200, 300, 400, 500, 600 are included to monitor temperature, turn on, operate or restrict operation, monitor use or other statuses, and/or trigger the energy created by or stored in the power sources specified above. The control system can also provide a method to determine whether the consumable is authorized for use in the device, while using such information to limit the usage of the device for illicit, counterfeit, or unauthorized consumables. The controllers can include a processor and memory. A mechanism is provided for disrupting the barrier of device 100, 200, 300, 400, 500, 600 and allowing user access to the inside of the cavity defined by the barrier for purposes related to the exchanging of heaters, device cleaning, device maintenance, inserting and removing of consumable, or any other reason both known and unknown.

In addition to the features described above, device 100, 200, 300, 400, 500, 600 can include one or more of the following features: 1) a burn prevention method that can include, but is not limited to, making the barrier from a thermally insulated material, adding thermal insulation within the cavity defined by the barrier, an electrical, mechanical, or electro-mechanical lock that maintains integrity of the cavity until otherwise authorized, and/or one or more triggers for the lock including, but not limited to, a timer, a temperature detection system, an override; 2) a non-thermally conductive physical support located within or adjacent to the cavity to hold the consumable, for example, consumable 132, in place during operation, maintenance, and/or loading, whereby options for this support include, but are not limited to, piercing the consumable, being a shelf for the consumable, and cupping and/or bracing the consumable; 3) a method for communicating the status of device 100, 200, 300, 400, 500, 600 to the user is provided with statuses that can be communicated include, but are not limited to, powered state, internal heat, duration remaining, battery life, if device 100, 200, 300, 400, 500, 600 is not closed properly and/or process step, as well as methods of communication that include, but are not limited to, visual, auditory, haptic, peripheral reporting to linked communication device; a mechanism or method to partially or completely eject or remove a consumable from the heating envelope within the cavity; and any mechanism, method, or accessory that partially or fully contains, protects, authorizes operation, and/or charges the device while enclosed, attached, or connected directly or indirectly via Wi-Fi, Bluetooth and/or wireless (e.g., charging); and 4) a multi-action lockout system that has two or more simultaneous or consecutive inputs from sources including, but not limited to, Bluetooth signal, wireless signal, phone or web application signal, fingerprint scanning, physical button, breathalyzer results, age verification, facial recognition, internal sensor data, RFID or other signals communicated by the consumable within the device, and/or Wi-Fi, where a failure to properly input these data will result in an intentional lockout of the device's targeted action, for example, heating the consumable to generate aerosolized product, consumable ejection, or disrupting the cavity while the internal temperature is too high. Safeguards can be included to prevent consumers from getting burned by prematurely opening the device while the heater is still hot. Safeguards against electric shock by preventing electricity conduction while the device is open can be included. Lights, haptics, sounds, vibratory motors, buzzers, and any combination thereof can be utilized to indicate different statuses of the device and communicate to the user vital information about the device, such as whether the device is open or closed, and battery capacity.

Figure 38:
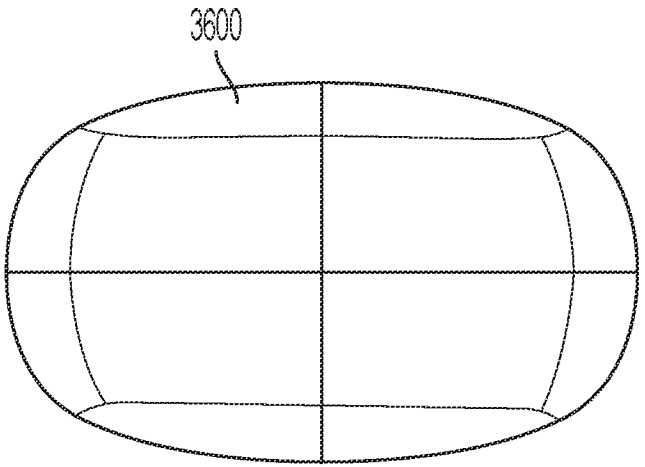
FIG. 38 is a side view of the consumable of FIG. 37.
Figure 37:
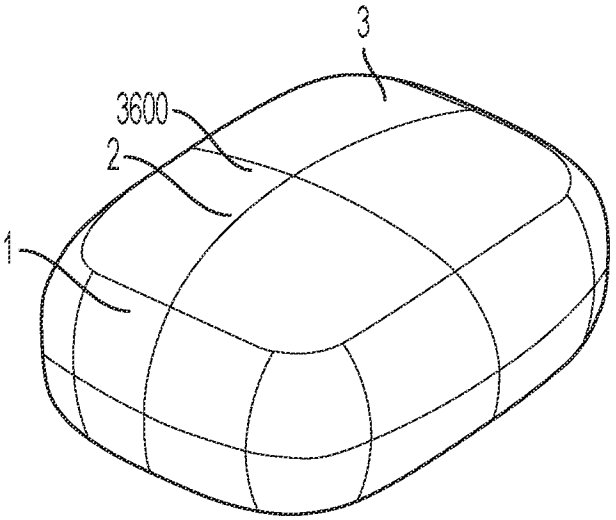
FIG. 37 is a perspective view of a consumable that has a modified shape.
Figure 40:
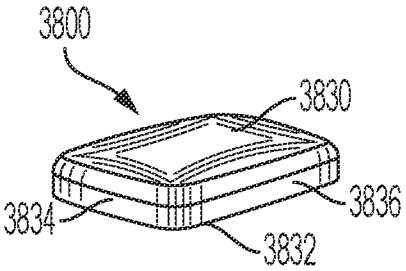
FIG. 40 is a perspective view of a second consumable that has a modified shape.

Referring to FIGS. 37 and 38 the consumable, for example, consumable 132 of FIG. 1 and/or consumable 617, can be modified to consumable 3600 that has a convex shape. The consumable 3600 has specific geometric characteristics and topological qualities that distinguish it from other products and contributes to the desirable functionality of this convex shape. Referring to FIG. 39*c*, as used herein, the term "convex consumable" refers to any of the elements in the collection C. In addition to being convex, the elements in C can be continuously differentiable with a derivative of zero at the center. Other elements in C are convex with a thickness to width ratio no greater than 1:2, many of which attain a maxima or minima near the center. As illustrated in FIGS. 37 and 38, the consumable 3600 has a specific convex shape, but the definition of convexity allows for any unpictured interpretations of shape which adhere to the mathematical proof illustrated in FIGS. 39*a*-39*f*. Referring to FIG. 37, multi-axial convexity of the consumable 3600 can be mathematically defined by the calculations of FIGS. 39*a*-39*f* where section [36.1] is identified by reference numeral 1 in FIG. 37, section [36.2] is identified by reference numeral 2 in FIG. 37 and section [36.3] is identified by reference numeral 3 in FIG. 37. Regarding the calculation of FIGS. 39*a*-39*f*, a statistical mechanical approach is used to analyze the properties of the consumable, and to optimize its malleability and ellipticity for use with the device, under load and during vaporization. Consideration for a symmetric heater and baffles as a system of heat transfer are also made.

This convex shape of consumable 3600 is more desirable than a flat design since the convex shape is easier for the user of device 100, 200, 300, 400, 500, 600 to load consumable 3600 into first heater 128, 228, 328, 428, 528, 615 and second heater 130, 230, 330, 430, 530, 616. Also, owing to the convexity of consumable 3600 and the orientation of particulate within said consumable, closing first heater 128, 228, 328, 428, 528, 615 and second heater 130, 230, 330, 430, 530, 616 to the closed position can also more easily compress and secure the convex shape consumable 3600. Such compression can break-up undesirable crystals that may form. These crystals can block airflow, which in turn could decrease consumable yield. Compressing consumable 3600 also increases density, which strengthens flavor and enhances taste, aerosol constituent (e.g., nicotine yield), and in turn improves consumer sensory experience. The convex shape of the consumable enables the consumer to tactile load the consumable more easily and intuitively into the device. The consumable may be compressed immediately prior to use, which fractures static particle bonds that obstruct airflow through the consumable. Consumable density and optimized airflow deliver a fresher and stronger tobacco flavor, as well as greater consumable yield. Particle breakthrough is not a byproduct of heated tobacco aerosol created at a low temperature. Therefore, no filter is needed; however, filters can be used.

Figure 41:
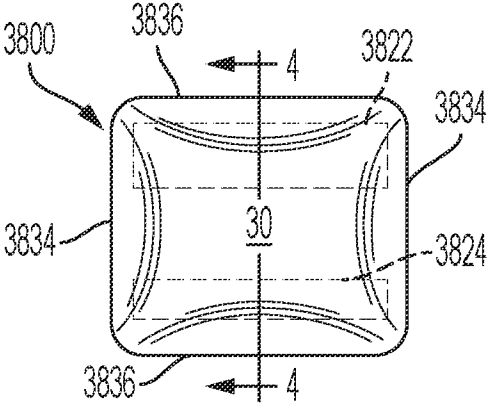
FIG. 41 is a top view of the consumable of FIG. 40.

Alternatively, consumable 132 can be formed in various shapes and sizes. In the illustrated embodiment of FIGS. 40-43, consumable 3800 has a generally rectangular shape when viewed orthogonally as shown in FIG. 41. The consumable 3800 has a pair of opposite major surfaces 3830 and 3832 each of which is generally convex in a direction away from the other major surface. However, each major surface can include a portion that is generally planar or flat in at least one direction. The consumable 3800 also has two opposite side edges 3834 that are generally parallel to each other, and two opposite side edges 3836 that are generally parallel to each other and generally perpendicular to the side edges 3834. The side edges 3834 can be substantially linear in orthogonally view, or it can be concave or convex. The side edges 3836 can have a slight concavity in orthogonally view, or it can be linear or convex in orthogonally view. In a preferred embodiment as shown in FIG. 41, the side edges 3834, 3836 are linear in orthogonally view. Furthermore, consumable 3800 need not be rectangular in orthogonally view, but can have another shape such as elliptical, oval, round, and the like. In the cross-section shown in FIGS. 42 and 43, consumable 3800 can have a generally elliptical or oval shape, round shape, or rectangular shape.

Consumable 3800 is rectangular and has a length (measured between the side edges 3834) exceeding a width of consumable 3800 (measured between the outermost parts of the side edges 3836). Additionally, the consumable could be concave.

Figure 42:
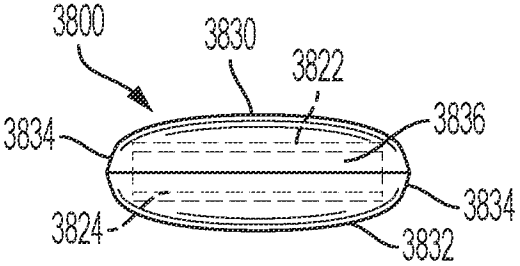
FIG. 42 is a side view of the consumable of FIG. 40.
Figure 43:
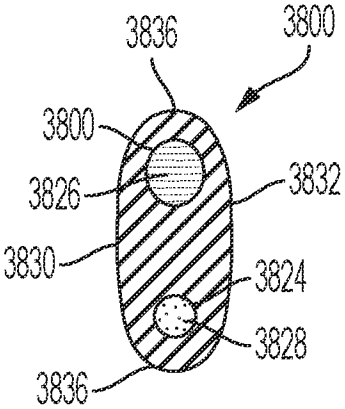
FIG. 43 is a cross-sectional view of consumable of FIG. 40, showing the two separate cavities.

Consumable 3800 can have one or more cavities, for example, cavities 3822, 3824, inside of the consumable material. First and second cavities 3822, 3824 are spaced apart in the width direction. Cavity 3822 advantageously is larger in cross-section than the cavity 3824, although such is not necessarily the case. In cross-section, the cavities 3822, 3824 can be round or non-round. As shown in FIG. 42, the cavity 3822 advantageously has a non-round (e.g., elliptical or oval) shape whose major dimension extends in the width direction of consumable 3800 and whose minor dimension extends in the height direction of consumable 3800. Cavities 3822, 3824 could be filled with liquids 3826 or solids 3828. Solids could include but not be limited to tobacco, capsules, cellulosic materials, reconstituted tobacco, flavoring materials, and any combination thereof. Cavities 3822, 3824 can be one or more cavities that can be filled by different substrates surrounded by a core substrate of the consumable material.

Consumable 3600, 3800 can be enclosed or wrapped in paper, tobacco or botanical sheet, metal, or gel. These wrappings can be perforated, permeable, or impermeable. Consumable cavity or cavities 3822, 3824 can contain cut tobacco, botanicals, tobacco, hemp, or botanical sheets, pharmaceutical drugs, flavoring materials, pellets, and/or liquids. The cavity provides flexibility to add liquid to achieve the ideal aerosol sensory or a specific dose level and/or product composition. Consumable 3600, 3800 can also contain cellulosic materials, such as wood pulp, tobacco fibers, beet fibers, microcrystalline cellulose, botanical, solids, or semi-solids containing aerosolizing substances including, but not limited to, glycerin, propylene glycols, other glycols, or the like, and any mixture thereof or other forms of cellulose.

Figure 44:
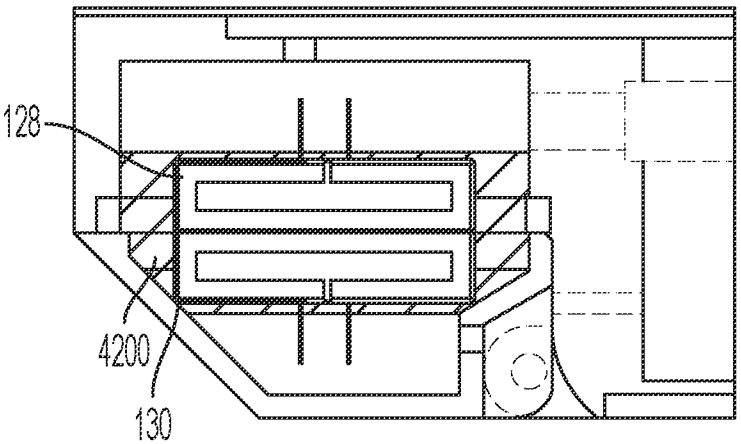
FIG. 44 is a partial enlarged, side, cross-sectional view of the inhaler device FIG. 1 in the closed position that is modified to include heaters with prongs.

Device 100, 200, 300, 400, 500, 600 can have one or more air pockets. Device 100 can be modified to have an air pocket 4200 that is hatched in FIG. 44. First heater 128 and second heater 130 create a consumable cradle in the closed position that holds consumable 132 like a convection oven. Air pockets, for example, air pocket 4200, have a spatial air pocket, in other words, volume of the air pocket, to consumable cradle volume ratio of at least about 1:1 and no greater than about 8:1. Air pocket length and width dimensions substantially and ideally match the length and width dimensions of the consumable cradle. The air pocket(s) 4200 can be located on one or more sides of the cradle. Air pocket depth can vary to reach the optimum convection oven air pocket volume to consumable cradle volume ratio, which in turn maximizes aerosol content yield and consumer sensory experience. Air pockets can include baffles.

First heater 128, 228, 328, 428, 528, 615 and second heater 130, 230, 330, 430, 530, 616 can each be attached to the device via a magnet, prongs and/or snap fastener. Snap fasteners can be similar to snaps found on clothing. For example, round, oval, elliptical, or other shapes, but preferably they should be oval so that they are fitted in the correct axis position and do not inadvertently rotate out of the correct axis position.

Referring to FIG. 45, first heater 128, 228, 328, 428, 528, 615 and/or second heater 130, 230, 330, 430, 530, 616 are modified to modified heater 4300 that has prong fasteners 4302, 4304. First heater 128, 228, 328, 428, 528, 615 and second heater 130, 230, 330, 430, 530, 616 can optionally each be symbiotically shaped as identical or mirrored (i.e., symmetrically inverse) shapes of each other so that (1) if the heater depth sides of first heater 128, 228, 328, 428, 528, 615 and second heater 130, 230, 330, 430, 530, 616 have design grooves that interlock when closed, and (2) first heater 128, 228, 328, 428, 528, 615 and second heater 130, 230, 330, 430, 530, 616 fit and work identically regardless of the chosen plug-in or snap-fastener location. This means the consumer or user does not have to worry about erroneously choosing where to install each heater in device 100, 200, 300, 400, 500, 600. Alternatively, the heaters may be different. If the cavity surface (ceiling or floor) and the heater are one piece, they could be removed together, which in turn would remove particulate overflow into the cavity surface and possibly eliminate the need to clean such surface.

Most devices determine temperature based on the consumable, consumer choice, or technology interface. The conducted electronic current energy of device 100, 200, 300, 400, 500, 600 is constant regardless of the employed heater, for example, first heater 128, 228, 328, 428, 528, 615 and second heater 130, 230, 330, 430, 530, 616, or consumable, for example, consumable 132. The heater design of device 100, 200, 300, 400, 500, 600 instead uses the measure of electric current that determines the heater temperature. The heaters, for example, first heater 128, 228, 328, 428, 528, 615 and second heater 130, 230, 330, 430, 530, 616, can have a temperature range from 140 to 300° C., more preferably about 160 to 240° C., and ideally about 200 to 220° C. For example, the temperature can be 160, 170, 180, 190, 200, 210, 220, 230 or 240° C. This feature may further eliminate the need for integration of a complex electronic circuit and/or thermometer required to accurately modulate temperature settings. Accordingly, the present disclosure reduces the risk of human and/or technology error and related product safety risks. Alternatively, the conducted electronic current energy of device 100, 200, 300, 400, 500, 600 can be provided by different configurations that are not constant regardless of the employed heater and consumable.

FIGS. 46-51 are different heater options in addition to first heater 128, 228, 328, 428, 528, 615 and/or second heater 130, 230, 330, 430, 530, 616, which compare the potential to accommodate different sizes of consumables. Device 100, 200, 300, 400, 500, 600 can have different heaters, for example, heater 6400, heater 6500 and heater 6600, that have different shapes and/or sizes that can heat consumables, for example, consumable 132, 617, 3600, 3800, that also can have different shapes and/or sizes. These different heaters, for example, heater 6400, heater 6500 and heater 6600, and different shaped and sized consumables will allow for consumption of aerosol having different characteristics. In particular, device 100, 200, 300, 400, 500, 600 can have a system of interchangeable and selectively configured heating elements for use within an aerosol-generating device that transfers an appropriate amount of heat to an aerosol generating consumable such that selected chemical compounds are efficiently extracted; and the shape, design, and arrangement of those heating elements can vary in relation to the shape, design, and arrangement of the consumable such that: 1) multiple formulations and size options of the consumables are compatible in the same model of device; 2) capability of use of the consumables in the device is determined by the type of heating elements which are present in the device at the time; 3) the shape of each heating element is such that there are 3 functional zones including an inside, an outside and the device connection zone; 4) the shape of the device connection zone of each heating element is identical between all different configurations of the heating elements to allow for interchangeability; 5) partnered or paired heating elements are specially shaped and formulated to provide specific heating qualities and geometry-specific cradling for their appropriately sized consumable.

The functionality of the heating elements, regardless of the configuration type that makes it ideal for a specific consumable subtype, is guaranteed by the following guidelines and characteristics: 1) that the heating elements all generate heat by electrical resistance, and the resistance of the heating element can be determined through any combination of material configurations, including but not limited to, spiral, serpentine, lattice, and/or mesh; 2) that the temperature that is applied by the device to the consumable is determined either purely by the electrical resistance of the heating element or the combination of the electrical resistance of the heating element and discrete voltage settings from the device, but not solely from discrete voltage selections from the device; 3) that each heating element—regardless of configuration type—must consist of at least one electrically conductive material or combination thereof including but not limited to, copper, stainless steel, or graphene; 4) that the outside zone of each heating element can optionally contain or be covered by an electrically insulative material.

An inhaler device that applies heat to generate consumable aerosol with nominal combustion byproduct can be further described as follows:

The device creates an aerosol from consumables individually loaded into a temporary or permanent cavity within an inhaler device. This cavity envelops two or more heating elements, that can be electrically conductive, which in turn surround and when closed may compress the consumable, which minimizes "static" particle bonding and improves air flow. The heaters are designed to set the temperature for a specific consumable's substrate as well as to minimize HPHC's. In that regard, the heaters and the denser, compressed consumable substrate are designed to produce a symbiotic relationship that maximizes aerosol quality and yield. The heaters could be recyclable. Spent consumables have nominal ESG impact. They can be separately replaced through insertion and removal from the cavity. In addition, aerosol is produced with nominal risks factors.

Regardless of the embodiment design, a cavity is created by a barrier between each heater and the external environment. The heaters create a cradle to hold the consumable. When the device cavity is in a closed position, one or more air pockets envelop the heating elements. The consumable could be in multiple forms and could also contain aerosol forming ingredients. The consumable itself can also contain one or more interior cavities filled with different substrates.

Instead of employing variable electric current, heater design determines cavity temperature from a constant electric current. This approach eliminates temperature adjustment risk from human and/or technology application error. The heating elements are positioned to consistently and uniformly conduct and radiate heat across the surface area of the consumable. The elements themselves may be mirror (inverse) or identical interchangeable parts to reduce consumer installation confusion or error. Finally, they may be easily snap-fastened to the electrical charge, eliminating risky and tedious prong plug-in. Depending on the wrapper insulation factor, anticipated heat-up time could be less than two seconds. Alternatively, device 100, 200, 300, 400, 500, 600 can employ variable electric current for first heater 128, 228, 328, 428, 528, 615 and second heater 130, 230, 330, 430, 530, 616, The inhaler device of the present disclosure can incorporate novel features that distinguish it from prior inhalers, including: (1) the elimination of consumable cartridge environmental waste (with or without a built-in heater); (2) a consumable that has a convex shape coupled with internal cavities capable of holding different substrates; (3) a uniquely defined "convection oven" cavity configuration for holding the consumable; and (4) pairing specially designed and configured heating elements to particular consumables. It is noted that conventional inhalers have two basic types in which: (1) the cartridge or cigarette-like sticks are attached to or inserted into a heater permanently affixed to the inhaler; or (2) the heating element resides within the cartridge or cigarette-like sticks that are attached to or inserted into the inhaler. The former requires periodic cleaning of the heater to optimize consumable aerosol quality, which if too difficult may cause the consumer to discard the device prematurely, leading to environmental waste and added consumer replacement costs. With the latter, each built-in heater is intended to be thrown away along with the spent consumable, leading again to waste and litter. The device of the present disclosure overcomes these adverse effects by eliminating the separate cartridge, while making both the heater and consumable separately replaceable through insertion and removal, and in turn respectively potentially recyclable and potentially biodegradable.

Advantageously, the convex-shaped consumable maximizes the consumable surface area that will be heated relative to the cross-section or thickness of the consumable. The consumable may be compressed when heaters are closed, which minimizes "static" particle bonding and improves air flow. The convex shape of the consumable enables the consumer to load the consumable more easily and intuitively into the device.

Another advantage of the present disclosure includes that the heaters create a consumable cradle between the air pocket(s), which form a "convection oven" in the closed position. Air pocket length and width dimensions substantially and ideally match the length and width dimensions of the consumable cradle. Air pocket depth can vary to achieve the optimum air pocket to consumable cradle volume ratio to maximize aerosol content yield and consumer sensory experience.

A further advantage of the device of the present disclosure is that it can accommodate heating elements with different shapes, designs, and arrangements in relation to the shape, design, and arrangement of the consumable. This enables the consumption of consumables having different heating temperatures. In particular, the device would utilize a system of interchangeable and selectively configured heating elements that transfer an appropriate amount of heat to a consumable, such that selected chemical compounds are efficiently extracted in the aerosol. Multiple formulation and size options of consumables would be compatible in the same model, with partnered or paired heating elements specially formulated and configured to provide optimal heating and surrounding conditions for the appropriately specified consumable.

The device of the present disclosure generates aerosol in a heating device (known as a Heated Tobacco Product [HTP] or Heat Not Burn [HNB] product within the industry) without the need for a separate cartridge to generate the aerosol.

Conventional HTP devices that generate aerosols generally utilize either a consumable shaped similar to a cigarette or a separate cartridge that contains an aerosol generating formulation. When there is a separate cartridge, the consumable generally contains a built-in heater. Heaters in these conventional devices are concealed in or attached to the consumable and are intended to be thrown away once the consumable is used up leading to waste and litter. When the HTP consumables look similar to cigarettes and the consumable is spent, the entire consumable configuration remains, resulting in excessive litter and higher product cost.

Some HTP devices have heaters that are permanently affixed to the device. These permanently affixed heaters must be cleaned to optimally generate aerosol from the device. If the cleaning process is too difficult, the consumer can become annoyed or exasperated enough to discard the entire device prematurely, wasting usable lifespan and leading to both excessive environmental waste and needless consumer replacement costs.

The device of the present disclosure overcomes, alleviates, and/or mitigates one or more of the aforementioned deficiencies in other HTP devices utilizing some of the following product attributes.

The consumable for the device of the present disclosure is a pillow, pellet, or wafer in a convex shape, made from reconstituted tobacco. For subsequent products, it could also be made from other herbs or plants and/or synthetic (e.g., pharmaceutical) products and other ingredients as discussed herein. The consumable further contains aerosol forming ingredients such as glycerin, propylene glycol, and other ingredients as discussed. The consumable does not have a heater; therefore, it is more environmentally sensitive, as well as economical for the consumer.

The device of the present disclosure has two heating elements located in a cavity at the end of the device. These heaters surround and envelop the consumable in order to consistently and uniformly conduct and radiate heat across the surface of the consumable. This maximizes product yield and produces aerosol through minimal energy expenditure. The cavity separately allows for (i) the insertion and removal of consumables; and (ii) the replacement of the device's heating elements. This configuration enables the user to insert new heaters easily into the device and clean and/or recycle "old" heaters for subsequent use.

The device of the present disclosure further provides safeguards that protect the user from burns or electric shock throughout operation and maintenance of the heating device. The product additionally has lights and haptics to indicate different statuses of the device relating to whether the device is open or closed, and battery capacity.

The device of the present disclosure is a HTP device that creates inhalable aerosol and that operates with: (1) two heating elements; (2) a cavity found at the end of the device; (3) a method or mechanism that allows for the insertion and removal of consumables from the cavity; (4) a method or mechanism that allows for the replacement of the heating elements within the cavity; (5) a method of burn prevention for the consumer; and (6) a method to use different heaters depending on the consumable. The device is rechargeable.

The consumable in one form (1) is a convex rectangular consumable, (2) is made from reconstituted tobacco, and (3) contains aerosol generating elements such as glycerin and propylene glycol. The convex shape is easier for the consumer to load into the heater cradle. The consumable, however, will be pliable enough to be compressed upon insertion and closure of the device. This way a greater amount of the consumable comes into contact with the heater resulting in the consumable being heated more evenly. This method maximizes aerosol and product yield, up to 100 percent, with minimal energy. The consumable will be available in multiple taste profiles, The consumable will be blister-packed to prevent moisture changes.

The device ("device 200") in an embodiment labelled "Gator". The device has an on/off switch which can be button 215 to disable the device. This is useful for assuring the product does not turn on unexpectedly and to provide a secondary method for activating the device. To turn on the device, the user must have the on/off switch in the "on" position and must push the activation button 215 and hold for 3 seconds. When the device has activated, the user will feel a slight vibration and the light around the activation button will illuminate with a white light. If there is an issue with the device (such as the cavity being open), the light around the activation button will be red. The device has 5 small white LED lights 207 to indicate battery charge level. When the battery is completely charged, all 5 white lights will be illuminated. As the battery charge decreases, the number of lights illuminated decreases. These lights flash white when the device is charging. Device 200 has a detachable mouthpiece 204. Attached to the mouthpiece is a tube that allows the aerosol to flow from the cavity to the mouthpiece. The tube is meant to be disposable and additional tubes are provided to the consumer. The mouthpiece 204 has three openings 206. The user can inhale the aerosol generated in device 200 through openings 206. The device is believed to create inhalable aerosol without particle breakthrough so that no filter is needed, although the device can also be used with filters.

A user can move device 200 between a closed position to a fully opened position. In the open position, consumable 132, first heater 228, and second heater 230 can be removed and replaced. To move device 200 from the closed position to the open position, the user triggers the action to open hinged lower portion 210 and hinged upper portion 211. The device is held shut by an electromagnetic lock. The device will have two open positions—a partially opened position for removal and insertion of the consumable (not shown) and a fully opened position for cleaning/maintenance of the device. This position also allows consumers to easily change heaters.

Device 200 provides burn prevention via an electromagnetic lock. One or more control systems are included to control the electromagnetic lock for the cavity. The control system monitors the on/off mode of the device. If the device is in the "on" or "off" position and a specified time has elapsed after deactivation, the electromagnetic lock will not allow the cavity to open. This ensures that a consumer will not be burned via hot heaters within the cavity. Additionally, the exterior of device is insulated from the heat within the cavity. This insulation can be air, insulating material such as glass fiber, or other high heat resistant material, or any other non-thermally conducting material.

Each heating element can generate heat through a specified electrical resistance that is directly related to the material properties, cross-sectional areas, and path length of the element. The heaters can have a temperature range from 140 to 300° C., more preferably 160 to 240° C., and ideally 200 to 220° C. The heaters can be attached to the device by prongs, snaps, or magnets. The heaters will have identical or mirrored (i.e., inverse) shapes so that the consumer does not get confused as to how the heaters should be positioned when replacing them. Different heater options in addition to first heater 228 and/or second heater 230 are available. The alternate heaters are available to accommodate different consumable sizes or consumables made from different materials that need a different heat profile.

While the present disclosure has been described with reference to one or more exemplary embodiments, it will be understood by those skilled in the art, that various changes can be made and equivalents can be substituted for elements thereof without departing from the scope of the present disclosure. In addition, many modifications can be made to adapt a particular situation or material to the teachings of the present disclosure without departing from the scope thereof. Therefore, it is intended that the present disclosure will not be limited to the particular embodiments disclosed herein, but that the disclosure will include all aspects falling within the scope of a fair reading of appended claims.

What is claimed is:

1. A heating inhaler device comprising:

heating elements that envelope a compressible consumable; and an established cavity that envelops the heating elements to allow the insertion and removal of the compressible consumable from the cavity and the replacement of the heating elements in the device, each of the heating elements having conductors that connect to and disconnect from terminals in the heating inhaler device, and the established cavity that envelops the heating elements allows insertion and removal of the compressible consumable from the cavity without removing the heating elements and each of the heating elements are selectively replaceable in the heating inhaler device without replacing the compressible consumable.

2. The device of claim 1, further comprising a control mechanism that prevents the consumer from opening the device while the heating elements are hot.

3. The device of claim 1, further comprising a control mechanism that prevents the heating elements from turning on while the device is open.

4. The device of claim 1, further comprising a mechanism for verifying the user and/or the user's age.

5. The device of claim 1, further comprising a structure for puncturing an encasement around the compressible consumable.

6. The device of claim 1, wherein the heating elements are a first heater and a second heater that are identical or mirrored (i.e., symmetrically inverse) shapes.

7. The device of claim 1, wherein the compressible consumable is a convex or biconvex shape.

8. The device of claim 7, wherein the convex shape when compressed maximizes the surface area of the consumable that will be heated relative to the cross-section or thickness of the compressible consumable.

9. The device of claim 7, wherein the convex or biconvex consumable shape when compressed improves airflow by fracturing static particle bonds.

10. The device of claim 1, wherein the device in the closed position creates both a temporary cavity and cradle formed by the heating elements that holds and compresses the compressible consumable to increase density, which strengthens yield and improves consumer sensory experience.

11. The device of claim 10, wherein the cavity forms an air pocket that has spatial air pocket to consumable cradle volume ratio that is at least about 1:1.

12. The device of claim 11, wherein the air pocket to consumable cradle volume ratio is no greater than about 8:1.

13. The device of claim 11, wherein the convex or biconvex consumable shape has a thickness to width ratio no greater than 1:2.

14. The device of claim 11, wherein the convex or biconvex consumable shape attains a maxima or minima near the center.

15. The device of claim 11, wherein the consumables have one or more cavities inside of the compressible consumable material.

16. The device of claim 1, wherein the device conducts electronic current energy that is constant regardless of the heating elements, so that a heater design with the same current energy determines temperature.

17. The device of claim 1, wherein the heating elements are new or replaceable heaters designed specifically for the consumable's formulation.

18. The device of claim 1, wherein the cavity forms an air pocket that has a baffle.

19. The device of claim 1, wherein the compressible consumable is formed by materials selected from the group consisting of: cut, reconstituted, shredded, diced, extruded, or pelleted substances; made of tobacco, hemp, plants, other cellulosic materials, wood fibers, beet fibers, microcrystalline cellulose, botanicals, synthetics solids or semi-solids, flavoring compounds, aerosolizing substances, glycerin, propylene glycols, other glycols, and any mixture thereof.

20. The device of claim 19, wherein the compressible consumable can be wrapped.

21. The device of claim 19, wherein the compressible consumable is wrapped with a wrapping that is selected from the group of porous non porous permeable and impermeable.

22. The device of claim 21, wherein the consumable wrapping is selected from paper, tobacco, botanical sheet, metal, and gel.

23. The device of claim 19, wherein the consumable wrapper contains, screens or blocks particle breakthrough, which reduces related health risks.

24. The device of claim 19, wherein the consumable is free of a filter which in turn reduces ESG impact.

25. The device of claim 1, wherein the compressible consumable creates a signal or other data to transmit to and be interpreted by the device for the purpose of limiting the use of unauthorized consumables.

26. The device of claim 1, wherein the established cavity is temporary.

27. The device of claim 1, wherein the heating elements each have snaps to assure that each of the heating elements are fitted in the correct position and will not rotate.

* * * * *